US010036156B1

(12) United States Patent
Macdonald et al.

(10) Patent No.: US 10,036,156 B1
(45) Date of Patent: Jul. 31, 2018

(54) METHOD OF FORMING A THREE-DIMENSIONAL STRUCTURE HAVING RIGID WALL PANELS

(71) Applicant: Exterior Wall Systems Limited, London, Ontario (CA)

(72) Inventors: Robert B. Macdonald, London (CA); Philip A. Macdonald, London (CA); Alexander K. Williams, Normandy Gardens (CA); Jonathan W. Hoy, Normandy Gardens (CA)

(73) Assignee: Exterior Wall Systems Limited, London, Ontario ( * ) Notice: Subject to any disclaimer, the term of this patent is extended or adjusted under 35 U.S.C. 154(b) by 0 days.

(21) Appl. No.: 15/838,903

(22) Filed: Dec. 12, 2017

Related U.S. Application Data

(63) Continuation-in-part of application No. 29/592,471, filed on Jan. 31, 2017, and a continuation-in-part of (Continued)

(51) Int. Cl.

| | |
|---|---|
| ***E04B 1/19*** | (2006.01) |
| ***E04F 13/14*** | (2006.01) |
| ***E04F 13/08*** | (2006.01) |

(52) U.S. Cl.
CPC ..... *E04B 1/1912* (2013.01); *E04F 13/083* (2013.01); *E04F 13/0894* (2013.01); *E04F 13/0896* (2013.01); *E04F 13/14* (2013.01); *E04B 2001/199* (2013.01); *E04B 2001/1957* (2013.01)

(58) Field of Classification Search
CPC ..... E04B 1/1912; E04B 2001/199; E04B 2001/1957; E04F 13/14; E04F 13/0894; E04F 13/0896; E04F 13/083
See application file for complete search history.

(56) References Cited

U.S. PATENT DOCUMENTS 3,218,097 A * 11/1965 Bowers ..... A47B 47/0008 285/231
3,645,569 A * 2/1972 Reilly ..... A47B 47/0008 403/217

(Continued)

OTHER PUBLICATIONS

Screen shots taken from www.keithpanel.com (Keith Panel Systems), accessed Mar. 6, 2017.

(Continued)

*Primary Examiner* — Rodney Mintz
(74) *Attorney, Agent, or Firm* — Peter L. Brewer; Thrive IP

(57) ABSTRACT

A method of forming a three-dimensional frame structure is provided. The structure includes a plurality of rigid wall panels that are adhesively secured to components of a system. The components are specially designed to allow for adjusting the dimensions of a wall panel. The method generally comprises providing a series of corner castings, and providing a series of linear extrusion members. The method also includes connecting the series of corner castings and the plurality of linear extrusion members to form a three-dimensional frame, and adhesively securing rigid wall panels to the three-dimensional frame to form the frame structure. The rigid panels may include porcelain ceramic tiles, natural stone tiles, or other panels.

30 Claims, 45 Drawing Sheets

Related U.S. Application Data application No. 29/592,514, filed on Jan. 31, 2017, and a continuation-in-part of application No. 29/592,475, filed on Jan. 31, 2017, and a continuation-in-part of application No. 29/592,493, filed on Jan. 31, 2017.

(60) Provisional application No. 62/480,611, filed on Apr. 3, 2017.

(56) References Cited

U.S. PATENT DOCUMENTS 4,101,229 A * 7/1978 Weibull ..... E04B 1/2403 403/171
4,161,375 A * 7/1979 Murphy ..... F16B 7/0446 403/169
4,271,654 A * 6/1981 Jungbluth ..... E04B 1/1912 52/637
4,439,960 A 4/1984 Jenkins
4,844,648 A * 7/1989 Fentiman ..... E04B 1/2403 403/171
4,999,960 A 3/1991 Herwegh et al.
5,067,293 A 11/1991 Reynolds
5,220,759 A 6/1993 Hossli
5,226,274 A 7/1993 Sommerstein
5,239,798 A 8/1993 Saito
5,263,292 A 11/1993 Holland et al.
5,301,484 A 4/1994 Jansson
5,345,737 A * 9/1994 Latchinian ..... A47B 57/565 403/172
5,379,561 A 1/1995 Saito
D360,267 S 7/1995 DiGiorgio
5,435,110 A * 7/1995 Stol ..... B62D 23/005 403/170
5,522,193 A 6/1996 Sommerstein et al.
D373,200 S 8/1996 Colitto
5,556,218 A * 9/1996 Homer ..... E04B 1/5831 403/170
5,590,974 A * 1/1997 Yang ..... A47B 47/005 403/171
D379,242 S 5/1997 Lin
5,634,300 A 6/1997 Huebner et al.
D388,887 S 1/1998 Hersh et al.
5,809,729 A 9/1998 Mitchell
D400,080 S 10/1998 Beard, Jr.
5,820,289 A * 10/1998 Kern ..... H02B 1/01 403/231
D405,197 S 2/1999 Arcati et al.
5,893,245 A 4/1999 Sekiguchi et al.
5,904,437 A * 5/1999 Allen ..... A47B 47/0008 403/170
5,966,890 A * 10/1999 Inman ..... E04B 1/24 52/643
D417,737 S 12/1999 Stansfield
5,997,117 A * 12/1999 Krietzman ..... H02B 1/301 312/265.4
6,035,598 A 3/2000 Sukolics et al.
D423,910 S 5/2000 Cyrell
6,065,259 A 5/2000 Clear
D429,347 S 8/2000 Doyle et al.
6,098,364 A 8/2000 Liu
D461,014 S 7/2002 Marshall
6,427,408 B1 8/2002 Krieger
6,484,465 B2 11/2002 Higgins
6,745,527 B1 6/2004 Sherman et al.
6,748,709 B1 6/2004 Sherman et al.
D496,248 S 9/2004 Liebendorfer
D501,936 S 2/2005 Kim
7,096,629 B1 8/2006 Cox
7,603,823 B2 10/2009 Cann
7,628,563 B2 * 12/2009 Winkler ..... A47B 43/003 211/189
D619,447 S 7/2010 Liu
D619,880 S 7/2010 MacDonald et al.
7,752,818 B1 7/2010 Roegge et al.
D626,663 S 11/2010 Stephens
8,151,533 B2 4/2012 Krieger
8,166,716 B2 5/2012 Macdonald et al.
D662,805 S 7/2012 Macdonald et al.
D666,321 S 8/2012 Morton
D675,046 S 1/2013 Kloppers
D692,592 S 10/2013 Kosonen
8,595,996 B2 12/2013 Korman et al.
8,615,936 B2 12/2013 Von Hoyningen Huene et al.
8,726,583 B2 * 5/2014 Verdecia ..... E04B 1/24 52/126.1
8,745,941 B2 6/2014 MacDonald et al.
D718,888 S 12/2014 Schwarz et al.
D720,608 S * 1/2015 Yamaguchi ..... D8/382
D731,677 S 6/2015 Bernier
9,068,358 B2 6/2015 MacDonald et al.
D736,958 S 8/2015 Chaney et al.
D744,667 S 12/2015 Macdonald et al.
D745,192 S 12/2015 Suciu et al.
D760,403 S 6/2016 Bilge
D767,786 S 9/2016 Smith
D778,465 S 2/2017 Zombek
9,631,365 B2 4/2017 Bottin et al.
9,803,361 B2 10/2017 Von Hoyningen Huene et al.
9,816,269 B2 11/2017 Glick et al.
9,850,666 B2 12/2017 Libreiro et al.
2001/0037988 A1 * 11/2001 Knab ..... H02B 1/01 211/189
2005/0060950 A1 3/2005 Hauschildt et al.
2007/0119105 A1 5/2007 MacDonald et al.
2008/0222990 A1 * 9/2008 Winkler ..... A47B 43/003 52/655.1
2010/0186343 A1 7/2010 MacDonald et al.
2013/0031851 A1 * 2/2013 Verdecia ..... E04B 1/24 52/126.1
2013/0306808 A1 * 11/2013 Huang ..... A47B 13/06 248/163.1
2016/0073526 A1 * 3/2016 Chen ..... H05K 7/02 312/283
2017/0362811 A1 * 12/2017 King, Jr. ..... A63H 33/108

OTHER PUBLICATIONS

Screen shots taken from www.dri-design.com (Dri-Design Wall Panel System), accessed Mar. 6, 2017.
Screen shots taken from www.elward.com (Elward Systems Corporation), accessed Mar. 6, 2017.
Co-Pending U.S. Appl. No. 29/592,471, filed Jan. 31, 2017, 13 pages.
Co-Pending U.S. Appl. No. 29/592,514, filed Jan. 31, 2017, 9 pages.
Co-Pending U.S. Appl. No. 29/592,475, filed Jan. 31, 2017, 13 pages.
Co-Pending U.S. Appl. No. 29/592,527, filed Jan. 31, 2017, 13 pages.
Co-Pending U.S. Appl. No. 29/592,480, filed Jan. 31, 2017, 16 pages.
Co-Pending U.S. Appl. No. 29/592,485, filed Jan. 31, 2017, 7 pages.
Co-Pending U.S. Appl. No. 29/592,489, filed Jan. 31, 2017, 7 pages.
Co-Pending U.S. Appl. No. 29/592,493, filed Jan. 31, 2017, 26 pages.
Co-Pending U.S. Appl. No. 29/592,500, filed Jan. 31, 2017, 16 pages.
Co-Pending U.S. Appl. No. 29/592,501, filed Jan. 31, 2017, 5 pages.
Co-Pending U.S. Appl. No. 29/592,503, filed Jan. 31, 2017, 6 pages.
Co-Pending U.S. Appl. No. 29/592,505, filed Jan. 31, 2017, 6 pages.
Co-Pending U.S. Appl. No. 29/592,508, filed Jan. 31, 2017, 6 pages.
Co-Pending U.S. Appl. No. 29/592,510, filed Jan. 31, 2017, 8 pages.
Co-Pending U.S. Appl. No. 29/592,529, filed Jan. 31, 2017, 10 pages.
Co-Pending U.S. Appl. No. 29/593,256, filed Jan. 31, 2017, 16 pages.

* cited by examiner

METHOD OF FORMING A THREE-DIMENSIONAL STRUCTURE HAVING RIGID WALL PANELS

CROSS REFERENCE TO RELATED APPLICATIONS

This application claims the benefit of U.S. Ser. No. 62/480,611 entitled "Method of Forming a Three-Dimensional Structure Having Rigid Wall Panels." That application was filed on Apr. 4, 2017.

This application claims priority to U.S. Ser. No. 29/592,471 entitled "Two-Legged Cube Connector For Wall Panel System." That application was filed on Jan. 31, 2017.

This application also claims priority to U.S. Ser. No. 29/592,514 entitled "Two-Legged Cube Connector For Wall Panel System." That application was filed on Jan. 31, 2017.

This application also claims priority to U.S. Ser. No. 29/592,475 entitled "Three-Legged Cube Connector For Wall Panel System." That application was filed on Jan. 31, 2017.

This application also claims priority to U.S. Ser. No. 29/592,527 entitled "Three-Legged Cube Connector For Wall Panel System." That application was filed on Jan. 31, 2017.

This application also claims priority to U.S. Ser. No. 29/592,493 entitled "Perimeter Clip For Wall Panel System." That application was filed on Jan. 31, 2017.

STATEMENT REGARDING FEDERALLY SPONSORED RESEARCH OR DEVELOPMENT

Not applicable.

BACKGROUND OF THE DISCLOSURE

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present inventive concept relates to the field of architectural building components. More particularly, the invention relates to a system for creating three-dimensional features of varying geometries and dimensions along an edifice using prefabricated connectors. The invention further relates to a method of installing ceramic tiles, or panels, along the edifice of a building which includes three-dimensional profiles.

TECHNOLOGY IN THE FIELD OF THE INVENTION

In the design and construction of commercial buildings, it is often desirable to place a facade around the structure. Historically, such facades have been in the form of stucco, brick or composite boards. Facades enhance the appearance of the business or institution and enclose the building's structure, including the substrate, the air/vapor barrier, the insulation and the sub-framing elements.

Recently, aluminum (or aluminum composite material ("ACM")) panels have been employed. These panels consist of an extruded aluminum frame, with a sheet of ACM placed over the frame. The peripheral edges of the ACM panels are wrapped around the outer sides of the frame, and are then secured to the outer sides using screws or, more preferably, hollow rivets.

For installation, the ACM sheets are pre-attached to individual frames. The frames are hung onto the exterior of the planar structure using elongated wall mounting brackets and small attachment clips. The wall mounting brackets are secured to a wall, or sub-girting for the wall, while the attachment clips are secured to the wall mounting brackets themselves. The attachment clips are configured to carry the dead loads of the respective wall panels.

FIG. 1A is a perspective view of a wall 100 having a series of wall mounting brackets, or bracket assemblies 110. The bracket assemblies 110 are secured to the wall 100 horizontally, and are spaced apart equi-distantly. Each bracket assembly 110 receives a series of attachment clips (shown at 116 in FIG. 1B). The attachment clips 116, in turn, gravitationally support individual panels 115.

In practice, ACM sheets are cut and placed onto respective extruded frames. The edges of the ACM sheets are bent over the outer surfaces of the frames, leaving a hollow interior portion. Each sheet is then secured to the edges of its respective panel using rivets. In this way, a plurality of panels 115 may be formed at a manufacturing facility and then transported to the job site to be hung on a wall 100. Bent edges are shown at 102 in FIG. 1A.

Each of the panels 115 includes a set of panel perimeter strips (seen at 114 in FIG. 1B). Each panel perimeter strip 114 will preferably have a generally C-shaped member configured to reside along an inside portion of one of the bent ACM edges 102. Each panel perimeter strip 114 will also have a receiving member integrally attached to the C-shaped member that extends beyond the side surface 102 of the ACM wall panel 115. The receiving member provides a slot adapted to gravitationally interlock a wing member of an attachment clip.

Each panel 115 will typically have four sides. This means that four separate panel perimeter strips are placed in orthogonal relation to form a square or rectangle. The panels 115 are hung onto the wings of attachment clips, which are secured to the outer framing of the building 100 horizontally. Each attachment clip 114 will typically have a central fastening surface and two opposing wing members, with each wing member extending outwardly from the central fastening surface.

Additional details concerning wall panel attachment systems is provided in U.S. Pat. No. 8,166,716 entitled "Dry Joint Wall Panel Attachment System," and U.S. Pat. No. 8,745,941 entitled "Method For Installing Wall Panels To The Exterior Wall Of A Building." Each of these co-owned patents is incorporated by reference herein in its entirety.

An example of a known attachment system is presented in U.S. Pat. No. 5,226,274, entitled "Panel Mounting Clip." The '274 patent discloses a first "clipping member" that is secured to a panel adjacent an edge of the panel. The '274 patent also discloses a second "clipping member" that is pre-attached to the building structure itself. The second clipping member has a channel (shown in the patent at 26 in FIG. 6) that snugly receives a male member (shown at 20 in FIG. 6) of the first clipping member. In this way, the panel may be connected to the building structure.

The attachment system of the '274 patent relies upon the placement of mounting clips around all peripheral edges of composite panels. "The first clipping member 10 is secured to each edge of a panel 12." (col. 4, lines 8-9). This may be done either by connecting the first clipping member to the panel using a screw (seen at 18 in FIG. 1) or by sliding the panel edges into panel engaging channels (seen at 34 in FIG. 2). "Then, a plurality of second clipping members 24 are secured to a sub-girt 38 of a building in a position to secure the lower edge, for example, of the panel 12." (col. 4, 1. 8-5).

U.S. Pat. No. 4,070,835 describes another mounting system. The system of the '835 patent employs a plurality of individual components for hanging panels onto a building structure. The components include an elongated "sole plate 30" that attaches to the back of each panel by means of two or more connecting screws 38. The sole plate 30 hangs on to so-called "profile members 13," which in turn are connected to a bracket 24 by means of a "hooking groove 15." The sole plate 30 and the bracket 24 include slots that allow the position of the panel "P" relative to the wall to be selectively adjusted. (See FIGS. 1 and 2 and corresponding portion of specification).

U.S. Pat. No. 7,854,099 provides yet another panel mounting system, wherein architectural panels are supported by a combination of a frame (referred to as sides 101, 103) (see FIG. 2 and corresponding portions of specification) and stiffeners 117 (see FIG. 2 and corresponding portions of specification). The mounting system is used for hanging panels having flanged edges, that is, aluminum composite panels. The stiffeners connect to the frame using screws 111, clips 155 (see FIGS. 2, 6, and corresponding portions of specification), and plates 159, 161 (see FIG. 7 and corresponding portion of specification). The stiffeners connect to the panels using a silicone adhesive. The panels of the '099 patent are designed to be particularly rugged so as to withstand hurricane-force winds.

U.S. Pat. No. 5,956,910, entitled "Panel Mounting Structure," describes another mounting system for wall panels. In this system, the upper edge of a first panel is mechanically connected to a lower edge of a second panel by means of an attachment clip. In this way, vertically adjacent panels are spaced apart while being secured together to a wall using a screw. In this system, the upper edge of each lower panel has an upstanding flange disposed within a first downwardly open channel of the support, with screw members extending through the upstanding flange and into the support to retain the upstanding flange in the first channel. At the same time, the lower edge of an associated upwardly adjacent panel has a further upstanding flange disposed within a second downwardly open channel of the support, thereby mounting the upper edge portion of the panel and the lower edge portion of the upwardly adjacent panel on the supporting wall.

The above systems are generally designed to support flexible panels, in particular, panels using "ACM." It is noted that the '835 patent is silent as to the type of panel used, but appears to be suited for any panel that can receive a screw or rivet.

The Applicant herein has conceived of an attachment system wherein rigid wall panels may be used instead of ACM panels. The rigid wall panels may be porcelain or ceramic tiles, or may consist of frames supporting photovoltaic cells that use solar energy to generate electrical current. Each rigid wall panel is secured to an outer flat surface of a panel perimeter clip (or panel bracket) using an adhesive. Co-owned U.S. Pat. No. 9,068,358 entitled "Wall Panel Systems For Rigid Wall Panels" discloses illustrative attachment systems, and is also incorporated by reference herein in its entirety.

Another embodiment conceived of by Applicant is found in U.S. Patent App. Publ. No. 2012/0085042, also entitled "Wall Panel Systems For Rigid Wall Panels." In this application, an architectural system is provided comprising a plurality of rigid wall panels, wherein a majority of the wall panels are fabricated from a material comprising ceramic. The wall panels are gravitationally secured to attachment clips, which in turn are fastened to respective bracket assemblies using threaded fasteners.

As briefly introduced above, FIG. 1B shows a cross-sectional view of a portion of a wall panel system described in the U.S. Patent App. Publ. No. 2012/0085042. More particularly, FIG. 1B is a cross-sectional view of a porcelain ceramic tile ("PCT") wall panel attachment system 101 in one embodiment. Here, two porcelain ceramic wall panels 105 are placed on an exterior wall 100 adjacent to one another.

In the attachment system 101 of FIG. 1B, a plurality of ceramic panels 105 may be installed onto a wall 100 in any sequence. In operation, a plurality of bracket assemblies 110 are fastened to the exterior wall 100 of a structure. The bracket assembly 110 may comprise one or more L-angle brackets 104, 106, and can be configured to accommodate adjacent panels, as needed. The brackets 104, 106 may be two back-to-back galvanized steel "L" angles or a single galvanized steel "L" angle attached to a thermally broken gusset. The bracket assembly 110 may be constructed of multiple bracket components affixed to one another to form a unitary structural foundation or sub-framing for the remainder of the system 101.

A proximal end of the bracket assembly 110 is secured to the wall 100 by fastener 103. In turn, the two L-angle brackets 104, 106 are secured together using fasteners, such as stainless steel screws 108. Bracket 104 is a wall bracket while bracket 106 is an attachment clip bracket. The L-angle brackets 104, 106 serve as brackets that allow the installer to level the substrate in three axes before installation of PCT panels 105.

A plurality of attachment clips 116 are fastened to respective bracket assemblies 110. This may be done by using stainless steel screws 128. Of interest, each attachment clip 116 includes a central fastening surface that receives the screw, or other fastener 128. The attachment clip 116 is thus secured to a bracket assembly 110, wherein the bracket assembly runs horizontally along an optional layer of sub-girting 120, and attachment clips may be oriented vertically and horizontally.

The attachment clip 116 also includes a pair of integrally formed, opposing wing members extending outwardly from the central fastening surface. In this way, the attachment clips 116 are configured to carry the dead loads of the respective PCT wall panels 105. In most cases, the panels 105 are connected by the attachment clips 116 in both horizontal and vertical directions.

As noted above, a pair of perimeter strips 114 is shown in FIG. 1B. Each perimeter strip 114 comprises a generally C-shaped member configured to extend along a rear surface 112 of a respective wall panel 105. Each perimeter strip 114 also has a planar outer surface. The planar outer surfaces receive a ceramic tile 105.

Optionally, the wall panel attachment system 101 may include one or more panel stiffeners 132. A panel stiffener 132 may be placed in the C-shaped member of the panel perimeter strip 114 to provide lateral support for an adjacent panel 105. Each panel stiffener 132 is fixed between the C-shaped members of opposing perimeter strips. The panel stiffeners 132 may connect under one embodiment to the perimeter strips 114 using conventional fasteners (not shown), that is, screws or rivets.

The wall panel attachment system 101 may also include a high-density, closed-cell foam tape 122. The tape 122 may be applied to either the rear perimeter surface 112 of the rigid wall panel 105 or to the planar surface of the perimeter strip 114. The high-density, closed-cell foam tape 122 creates spacing for the necessary thickness needed for the adhesive 124. The adhesive 124 adheres the wall panels 105 to the adjoining panel perimeter strips. The foam tape 122 also acts as a backstop as silicone adhesive 124 is squeezed into the gap between the panel perimeter strip 114 and the rear surfaces 112 of the rigid PCT (or sinter ceramic) wall panels 105. Of course, materials other than foam tape may be used as a spacing element 122.

Despite the benefits offered by the architectural wall panel system of U.S. Patent Publ. No. 2012/0085042 and FIG. 1B, the frames for the individual panels (made up of the perimeter strips 114) must still be custom measured and cut. Further, the frames have a fixed 90-degree configuration for the panels 105. Accordingly, a need exists for a wall panel system that permits something of a "one-size-fits-all" framing for the panels, meaning that dimensions of the framing may be readily adjusted as needed for panel fabrication. Further, a need exists for such a system that allows for non-orthogonal connections between perimeter strips. Still further, a need exists for a method of forming a three-dimensional wall structure that uses ceramic (or other rigid) wall panels adhesively connected to size-adjustable connectors.

BRIEF SUMMARY OF THE INVENTION

A method of forming a three-dimensional frame structure for a wall is provided herein. The frame structure supports rigid wall panels, such as ceramic wall tiles, that are gravitationally hung onto an edifice of a wall. Preferably, the ceramic wall panels comprise porcelain ceramic, although a non-porcelain ceramic may be employed. Alternatively, the rigid wall panels may be fabricated from a natural stone material such as marble, limestone, travertine, slate or granite. Alternatively still, the rigid wall panels may include layers of glass or metal. In one aspect, combinations of panels having different materials, textures, colors, glazes and finishes may be employed, depending on architectural preferences.

In one embodiment, the method first comprises providing a series of corner castings. Each of the corner castings comprises,

- two or more two-legged cube connectors, wherein legs of each of the two-legged cube connectors form an orthogonal x-y coordinate;
- two or more planar three-legged cube connectors, wherein legs of each of the planar three-legged cube connectors also form an orthogonal x-y coordinate;
- two or more orthogonal three-legged cube connectors, wherein legs of each of the orthogonal three-legged cube connectors form an orthogonal x-y-z coordinate;
- and wherein each leg of each of the corner castings comprises a male member.

Preferably, each male member has a polygonal profile, such as a square shape.

In addition, the method includes providing a plurality of linear extrusion members. Each linear extrusion member comprises a female opening at both a first end and a second opposite end. The female openings are dimensioned to slidably receive the male members of the corner castings. Preferably, each female opening also has a polygonal profile that matches (or mates with) the profile of its corresponding male leg member.

In the method, some of the linear extrusion members include a receiving member for an attachment clip. These linear extrusion members may be referred to herein as "perimeter strips." The receiving members of the perimeter strips are configured to gravitationally hang onto respective attachment clips. The attachment clips, in turn, are operatively secured to the edifice of a building structure such as through the use of bracket assemblies 110 as described above in connection with FIG. 1B.

Optionally, some of the linear extrusion members are corner connectors, sometime referred to as "box connectors" due to their shape. In the present inventions, the corner connectors do not have a receiving member and do not hang from an attachment clip along the building's exterior surface; instead, they adhesively connect to wall panels at corners of the three-dimensional structure. The corner connectors are also female linear extrusions that accept and connect two-dimensional and three-dimensional multi-projection legs (the male members) that are a part of the corner castings (or "cube connectors"). The corner connectors may be either inside connectors or outside connectors. In any instance, both the perimeter strips and the corner connectors reside between the cube members, and include outer planar surfaces that adhesively connect to the rear surface of respective rigid panels.

In addition, the method includes connecting the series of corner castings and the series of linear extrusion members to form a three-dimensional structure, or frame.

In addition, the method includes securing panels to the three-dimensional structure to form a wall panel. The panels are secured using an adhesive. Preferably, the adhesive is a liquid adhesive such as structural silicone, although an adhesive tape may alternatively be employed.

Each of the two-legged cube connectors and each of the three-legged cube connectors comprises a cube member. Polygonal legs of each of the connectors extend from its respective cube member. In one aspect, an outward-facing surface of each of the cube members contains a slot that is configured to receive a gasket. The slots reside along otherwise generally planar outer surfaces of the cube connectors. The gaskets extend upward from the slots and the cubes, and serve as spacers. In this way, a predetermined space is reserved for liquid adhesive to reside between the outer planar surfaces of the linear extrusion members and the rear surfaces of the rigid wall panels. The gaskets also enclose the edge of the panel between the extrusion and the rigid wall panel, acting as a back-stop, and preventing the adhesive from flowing out onto the perimeter extrusion's outer edge.

In this embodiment, the method also includes placing gaskets along the outer surfaces of selected corner castings and linear extrusion members. The method will then include injecting a liquid silicone into a space formed between the respective outer planar surfaces and the under surfaces of the panels.

In one aspect, the method further comprises providing a series of keys. The keys are configured to optionally connect selected perimeter strips without the use of the cube connectors. The keys generally define aluminum pieces at generally right angles. The right angles may be at 87-degrees, 90-degrees, or 93 degrees, depending on the desired angle of connection.

A façade package is also provided herein. The façade package is used to form a three-dimensional structure for a wall. The façade package first comprises a plurality of corner castings. The corner castings comprise:

two or more two-legged cube connectors, wherein legs of each of the two-legged cube connectors form an orthogonal x-y coordinate;

two or more planar three-legged cube connectors, wherein legs of each of the planar three-legged cube connectors also form an orthogonal x-y coordinate; and two or more orthogonal three-legged cube connectors, wherein legs of each of the orthogonal three-legged cube connectors form an orthogonal x-y-z coordinate.

The façade package further comprises a plurality of linear extrusion members. Each linear extrusion member comprises an opening at both a first end and a second end. The openings are configured to slidably receive the legs of the two-legged and the three-legged cube connectors.

Some of the plurality of linear extrusion members serve as panel perimeter strips. The panel perimeter strips comprise a receiving member configured to gravitationally hang onto wing members of respective attachment clips secured to an edifice of a building. In this way, the attachment clips support a dead load of the three-dimensional structure. Additionally, some of the linear extrusion members serve as corner connector strips and do not have a receiving member for an attachment clip. The corner connector strips are not configured to gravitationally support the three-dimensional structure.

The corner castings and the linear extrusion members are configured to be telescopically connected to form a three-dimensional structure. Specifically, the corner castings are connected by means of linear extrusion members through a telescoping arrangement. In one aspect, the façade package contains linear extrusion members of pre-selected lengths. In this way, no cutting of the frame components (or aluminum extrusions) is required at the construction site.

The façade package also includes a collection of rigid wall panels. The rigid wall panels are configured to be adhesively secured to exterior surfaces of the three-dimensional structure. It is understood that some cutting of the wall panels at the construction site may be required.

The façade package may also comprise a series of keys. The keys are configured to connect selected perimeter strips without the use of the cube connectors. The keys define aluminum pieces at generally right angles. The right angles may be at 87-degrees, 90-degrees, or 93 degrees, depending on the desired angle of connection.

DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 18D is an exploded view of a three-dimensional frame structure using components of the wall panel system of the present invention, in one embodiment. In FIG. 18E, the cube connectors and the linear extrusion members of the three-dimensional structure have been moved together to form the three-dimensional structure. In FIG. 18F, the three-dimensional structure has received rigid wall panels, forming a frame structure.

DETAILED DESCRIPTION OF CERTAIN EMBODIMENTS

Definitions

For purposes of the present disclosure, it is noted that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Description of Selected Specific Embodiments

A method of forming a three-dimensional frame structure along an edifice of a building is provided herein. The method employs a unique combination of building components that allow for a "one-size-fits-all" panelization system. Beneficially, the system allows for rigid wall panels to be adhesively secured to pre-formed frames, which may then be quickly secured to a building edifice at a construction site. In addition, frames having rigid wall panels may be mixed with frames using ACM panels and other cladded panels of different materials, to form a building edifice having a diverse, creative and attractive architectural design.

Figure 2:
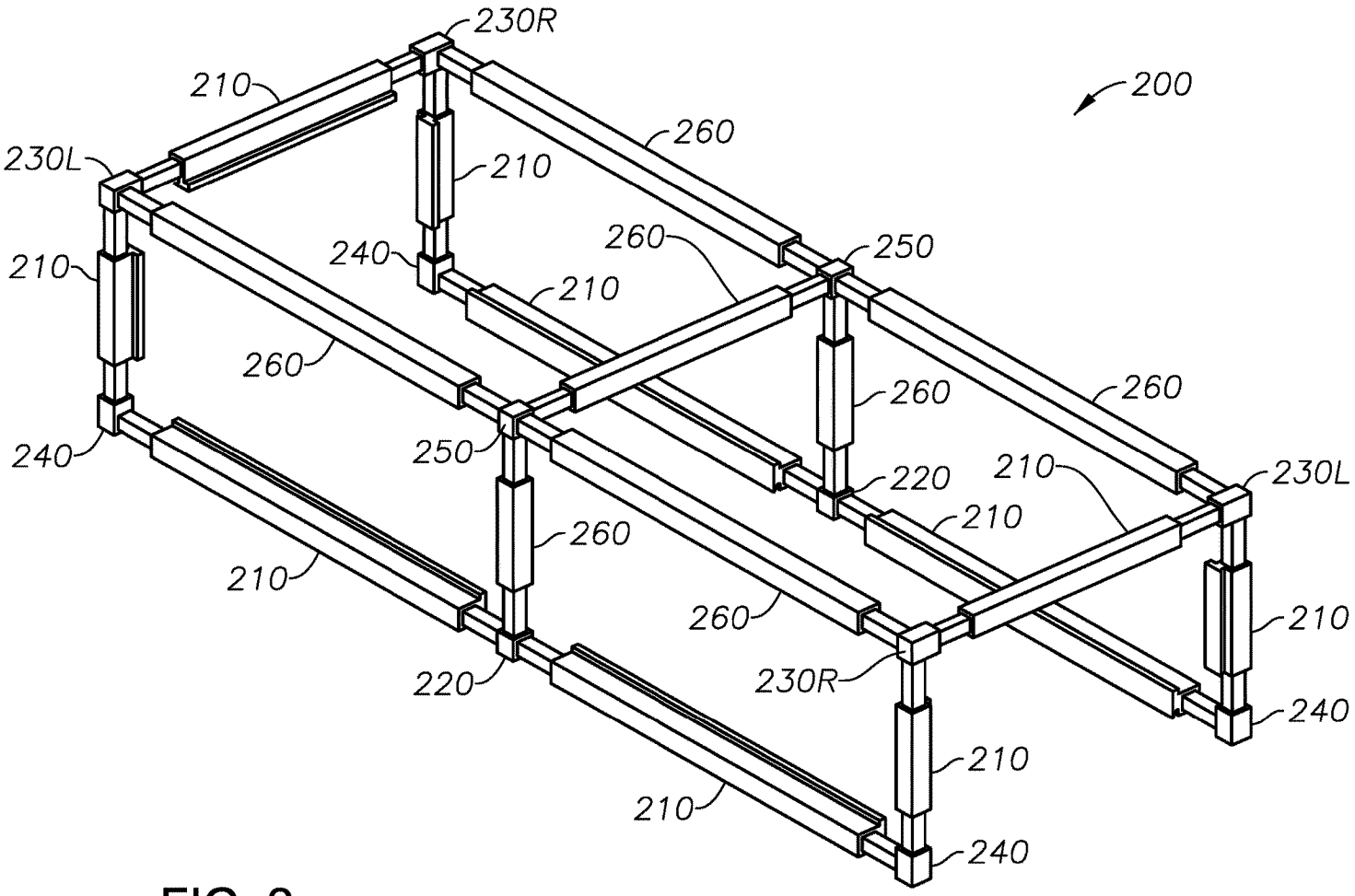
FIG. 2 is a perspective view of various components that may be used together in a method of forming a three-dimensional structure, of the present invention. The components are configured to adhesively receive rigid wall panels (not shown).

FIG. 2 is a perspective view of various components that may be used together in a method of forming a three-dimensional structure 200. FIG. 2 shows cube connectors 220, 230 (shown as 230L and 230R to indicate left-handed vs. right-handed components), 240 and 250. FIG. 2 also shows linear extrusion members 210 and 260. The cube connectors 220, 230, 240, 250 and the linear extrusion members 210, 260 may be used to form varying three-dimensional structures. For example, the three-dimensional structure 200 may include two or more two-legged cube connectors 240. Each two-legged cube connector 240 has two legs that form an orthogonal x-y coordinate. The components of the three-dimensional structures may also be configured to adhesively receive rigid wall panels as further described below.

Figure 3A:
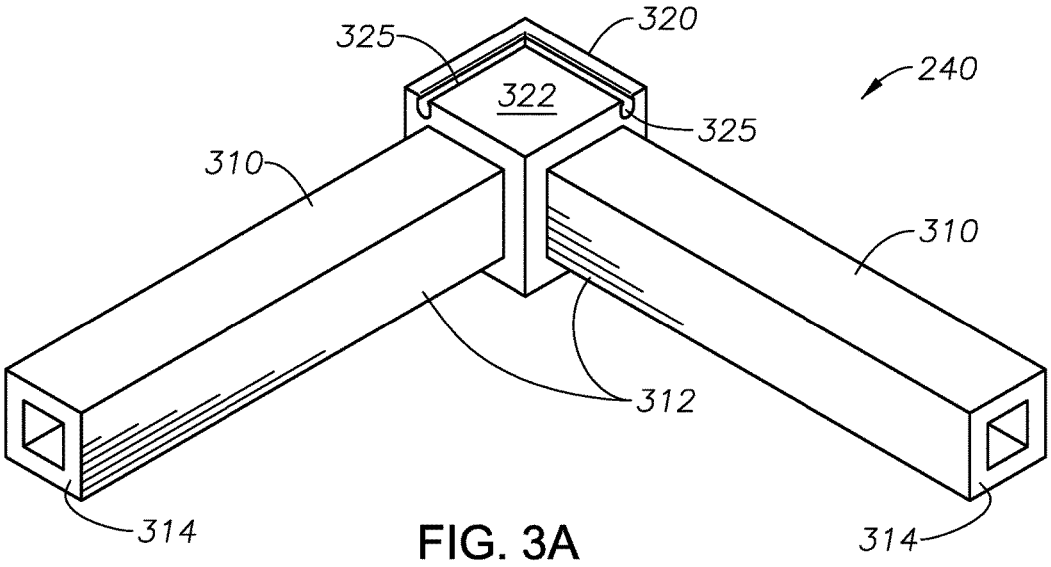
FIG. 3A is a first perspective view of a two-legged cube connector that may be used as one of the components in the three-dimensional structure of FIG. 2, in one embodiment.

FIG. 3A is a first perspective view of a two-legged cube connector 240 that may be used as one of the components of the three-dimensional structure 200 of FIG. 2, in one embodiment.

FIG. 3A first shows two legs 310 that extend out from a cube 320. Each leg 310 has a proximal end 312 and a distal end 314. Each leg 310 preferably forms a four-sided polygon, though other geometries may be used. Preferably, each leg 310 serves as a male component that is slidably received within an end of a linear extrusion member, such as the perimeter strip shown in, for example, FIGS. 12A, 12B and 12C.

Figure 3B:
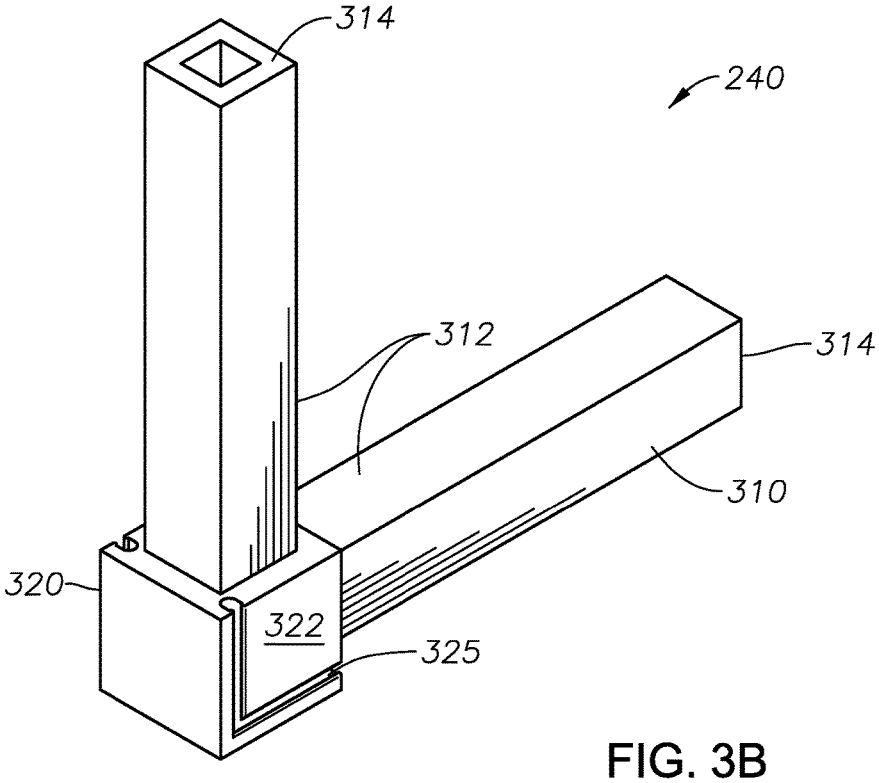
FIG. 3B is another perspective view of the two-legged cube connector of FIG. 3A.

FIG. 3B is another perspective view of the two-legged cube connector 240 of FIG. 3A. Both FIG. 3A and FIG. 3B show recessed portions 325 for receiving a gasket (such as gasket 430 shown in FIG. 4C and described below). The recessed portions 325 serve as slots, and reside along an outward-facing surface 322 of the cube 320.

Preferably, each gasket 430 is fabricated from an elastomeric material having a base. The base is slidably or frictionally received within the recessed portions 325. Illustrative materials for the gaskets 430 include rubber, silicone, neoprene and polytetrafluoroethylene.

Figure 4A:
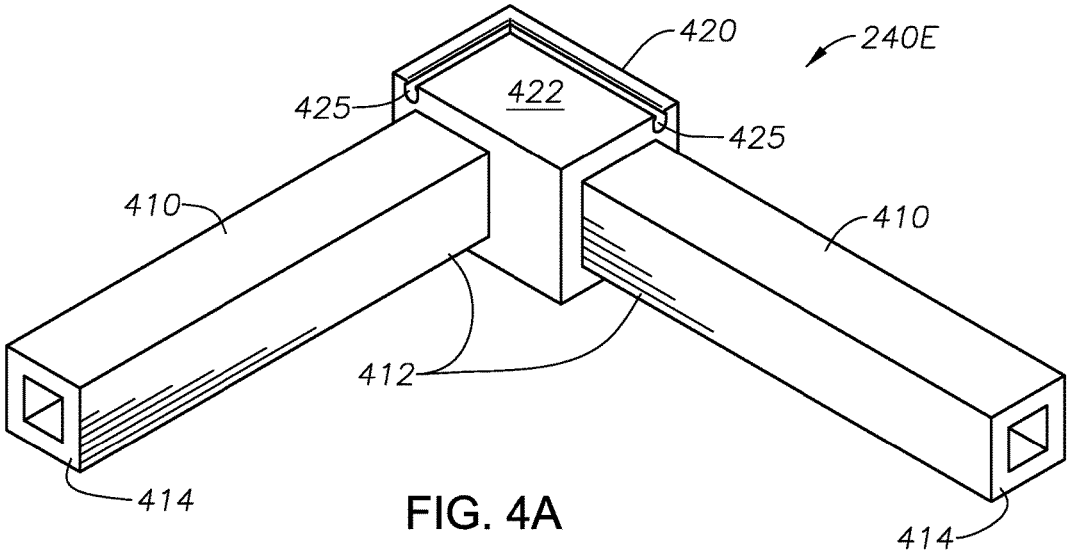
FIG. 4A is a first perspective view of a two-legged cube connector that may be used as one of the components in the three-dimensional structure of FIG. 2, in an alternate embodiment.

Alternate embodiments for the two-legged cube connectors 240 may be used. FIG. 4A is a first perspective view of a two-legged cube connector 240E that may be used as one of the components of the three-dimensional structure 200 in FIG. 2, in an alternate embodiment. The designation "E" indicates that the cube 420 of the connector 240E has an elongated shape. It is noted that the two-legged cube connectors 240 of FIG. 2 are actually connectors 240E.

FIG. 4A shows two legs 410, with each leg 410 having a proximal end 412 and a distal end 414. The proximal ends 412 extend from a cube member 420. The cube member 420 has an outward-facing surface 422.

Figure 4B:
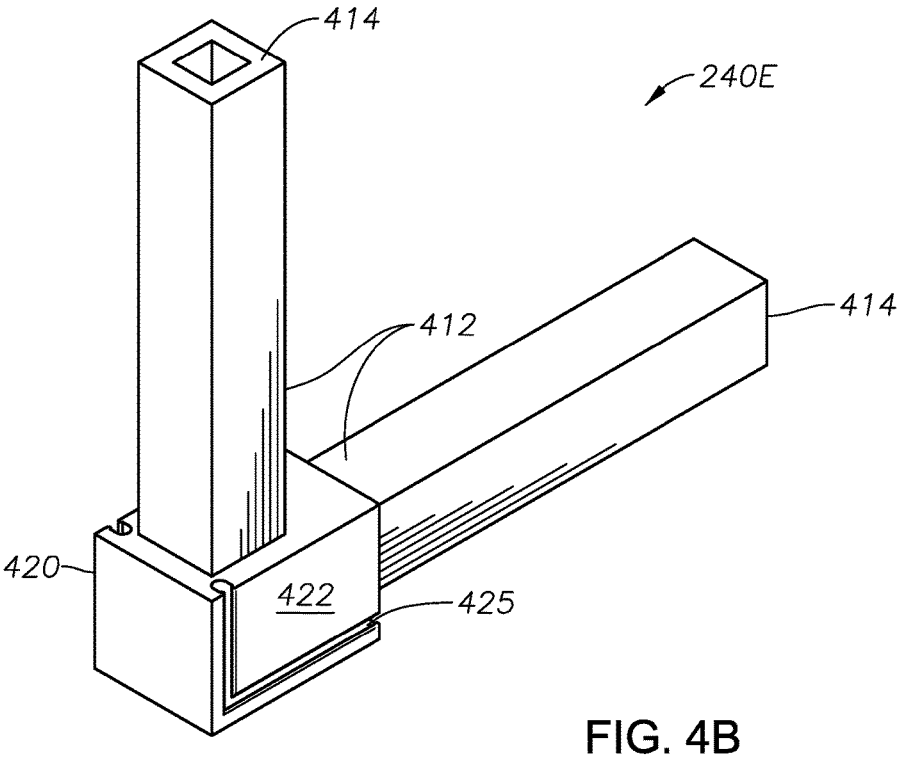
FIG. 4B is another perspective view of the two-legged cube connector of FIG. 4A.

FIG. 4B is another perspective view of the two-legged cube connector 240E of FIG. 4A. FIG. 4A and FIG. 4B show recessed portions 425 for receiving a gasket 430.

Figure 4C:
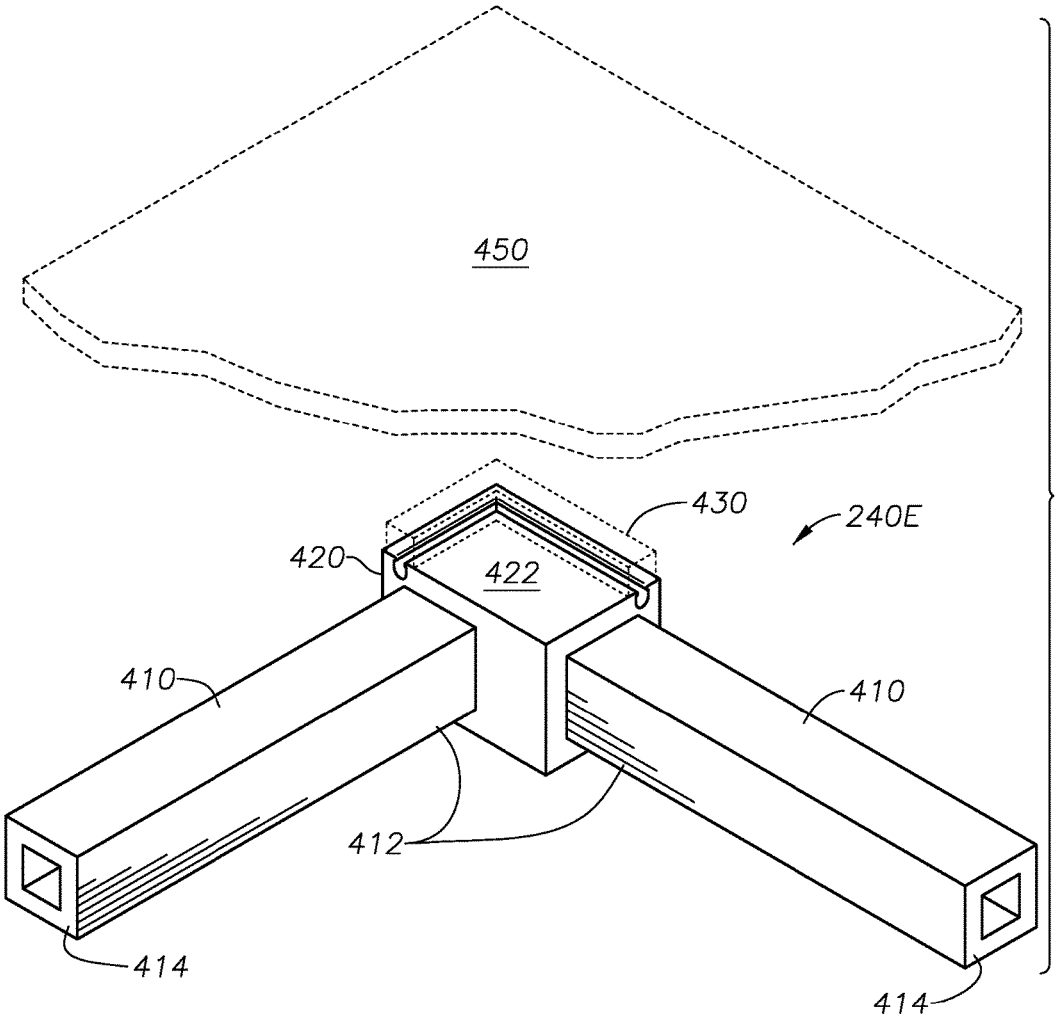
FIG. 4C is a perspective view of the two-legged cube connector of FIG. 4A, having received a gasket (in phantom for clarity) in slots of the cube. A cut-out portion of a rigid wall panel is shown in phantom and exploded away from the connector.

FIG. 4C is a perspective view of the two-legged cube connector of FIG. 4A, having received a gasket 430. A cut-out portion of a rigid wall panel 450, or tile, is shown exploded away from the connector 240E. The tile 450 is preferably a porcelain ceramic tile. However, it should be noted that the embodiments described herein are not limited to ceramic tiles. Embodiments of the three-dimensional structures described herein may use different types of rigid panels including non-porcelain ceramic tiles, natural stone tiles, synthetic rigid panels or composite rigid panels. Additional alternatives include glass layers, PVC panels and aluminum plates.

Figure 5A:
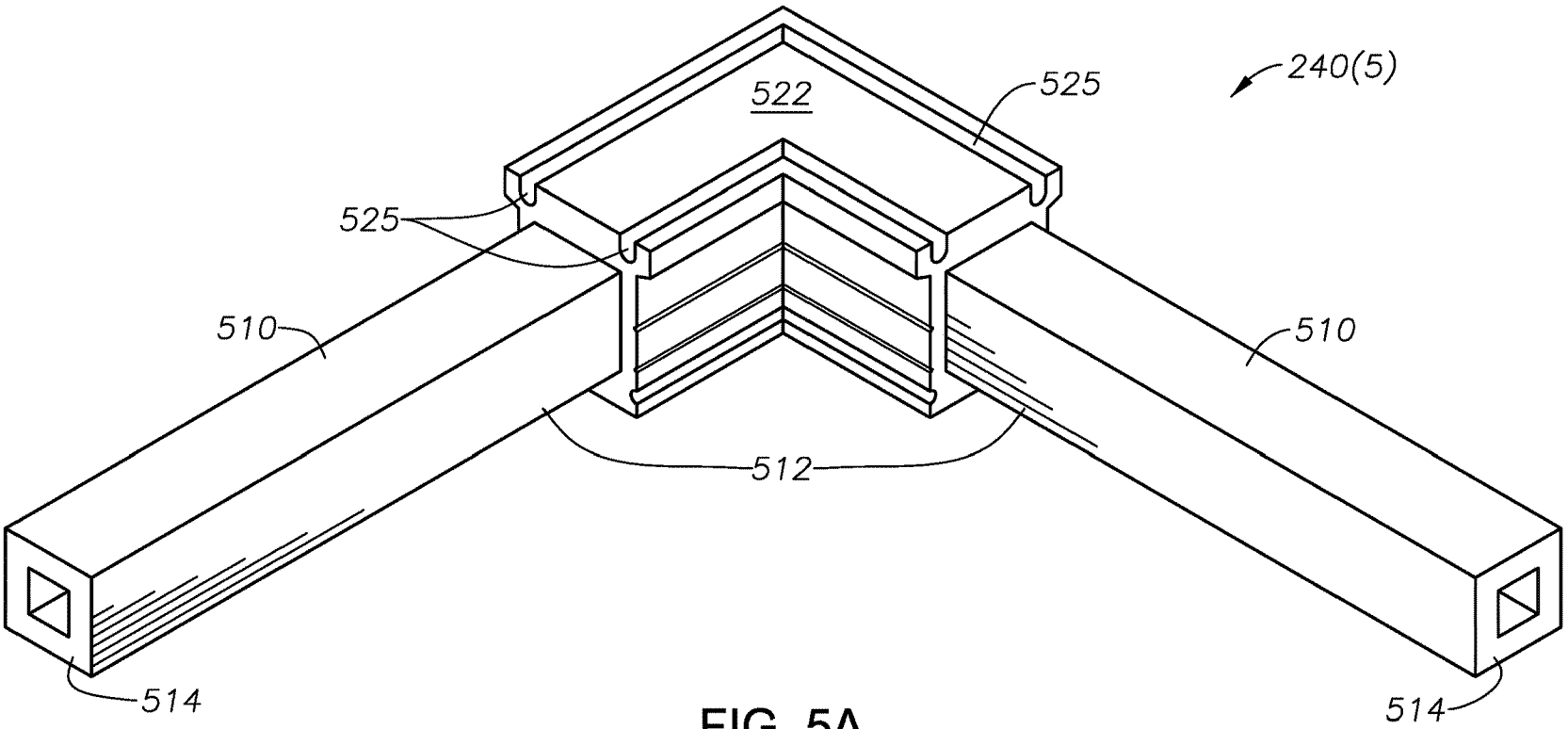
FIG. 5A is a first perspective view of a two-legged cube connector that may be used as one of the components in the three-dimensional structure of FIG. 2, in another alternate embodiment.

FIG. 5A is a first perspective view of a two-legged cube connector 240(5) that may be used as one of the components of the three-dimensional structure 200 of FIG. 2, in another alternate embodiment. In this instance, "240(5)" refers to the embodiment shown in FIGS. 5A and 5B. FIG. 5A shows two legs 510 extending from a cube (indicated in FIG. 5B at 520) with an outward-facing surface 522. Each leg 510 has a proximal end 512 and a distal end 514 and is configured to matingly connect with square female components of panel perimeter strips, described further below.

Figure 5B:
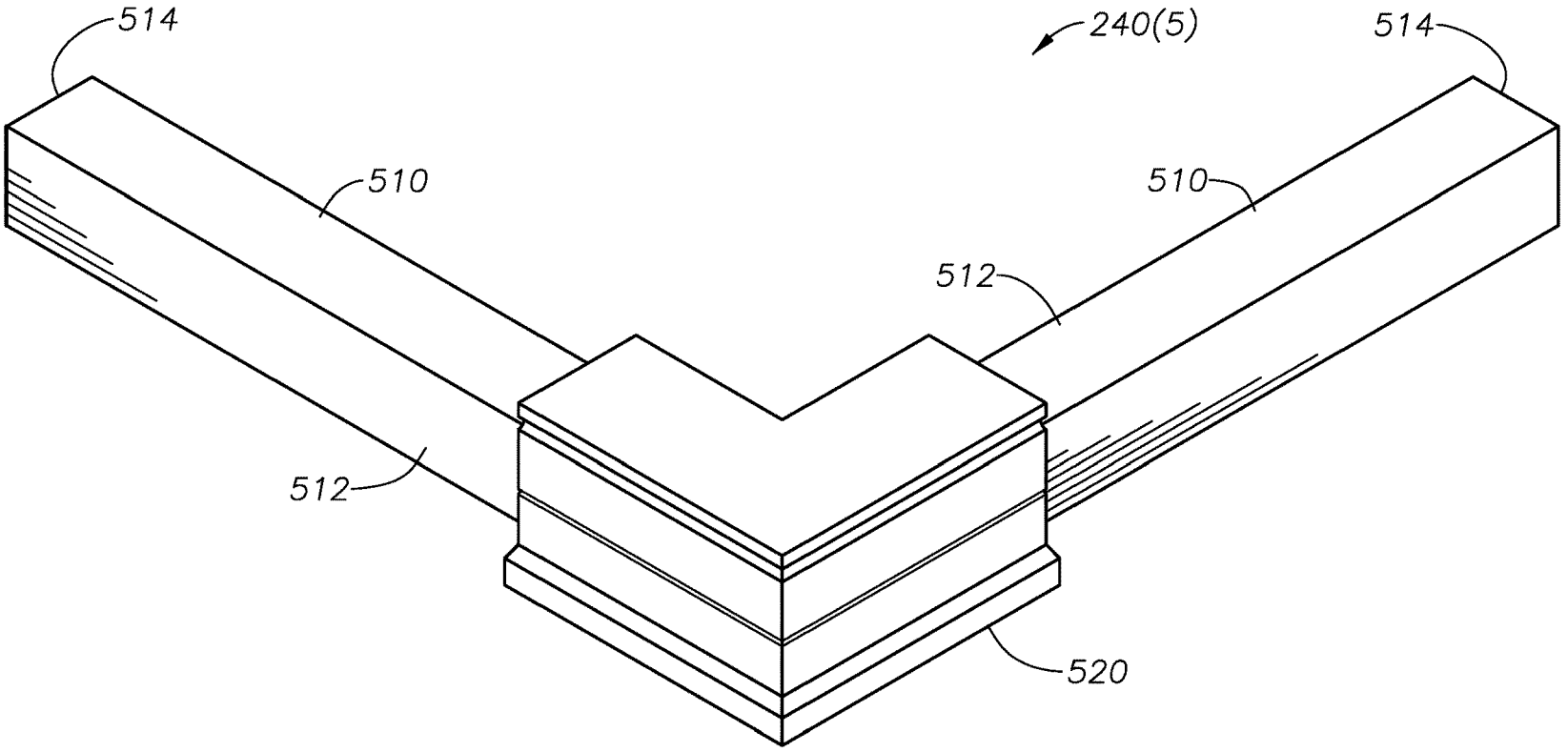
FIG. 5B is another perspective view of the two-legged cube connector of FIG. 5A.

FIG. 5B is another perspective view of the two-legged cube connector 240(5) of FIG. 5A. FIG. 5A shows recessed portions 525 for receiving a gasket 430 to support a tile 450 and to space the panel 450 away from the cube connector 240. In this way, a liquid adhesive may be applied in the space preserved between the outward-face 522 of the cube connector 240(5) and a rear surface (illustrated at 112 in FIG. 5B) of the panel 450.

Figure 6A:
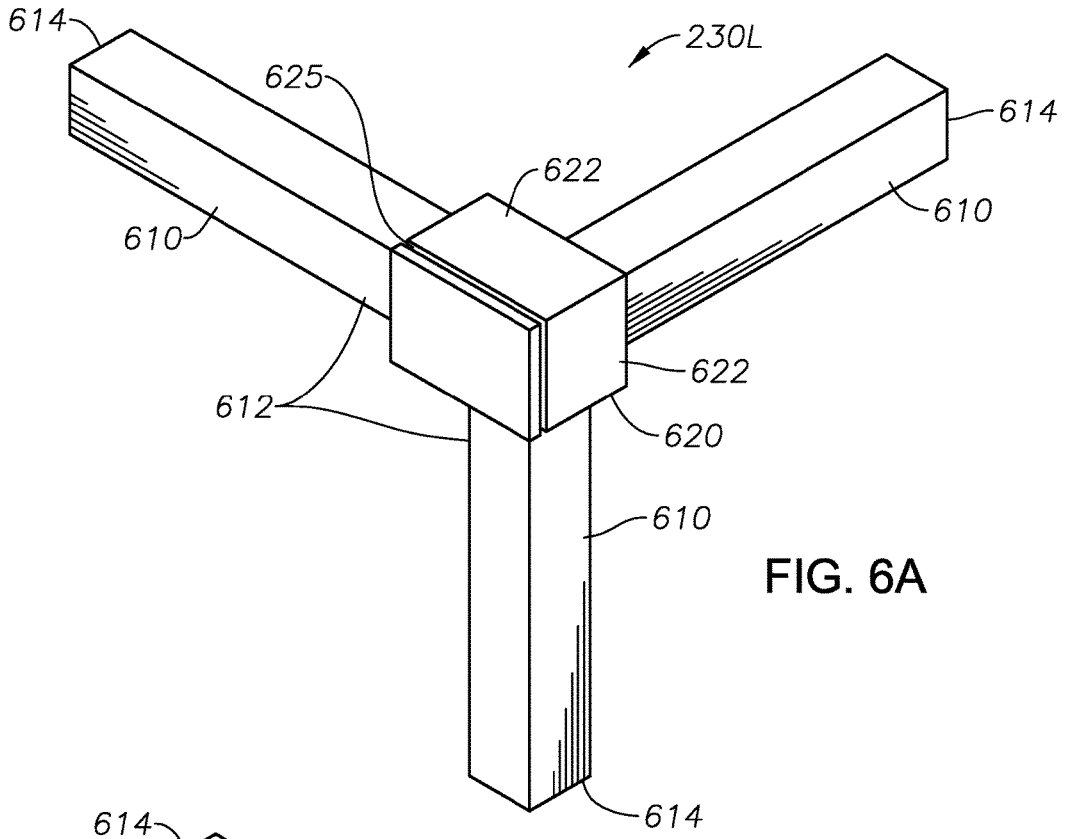
FIG. 6A is a first perspective view of a three-legged cube connector that may be used as one of the components in the three-dimensional structure of FIG. 2, in one embodiment.

Returning to FIG. 2, the three-dimensional structure 200 may also include two or more orthogonal three-legged cube connectors 230. Each orthogonal three-legged cube connector 230 has three legs that form an orthogonal x-y-z coordinate. FIG. 6A is a first perspective view of an orthogonal three-legged cube connector 230 that may be used as one of the components of the three-dimensional structure 200 of FIG. 2, in one embodiment.

Figure 6B:
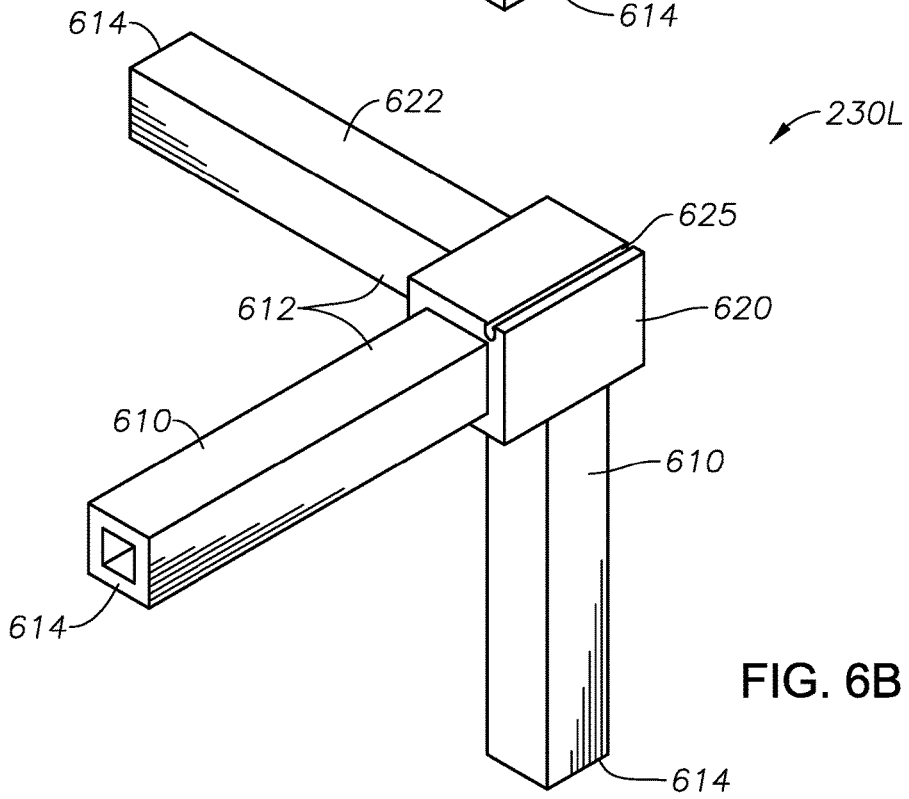
FIG. 6B is another perspective view of the three-legged cube connector of FIG. 6A.

FIG. 6A shows three legs 610, with each leg 610 having a proximal end 612 and a distal end 614. The proximal ends 612 extend from a cube member 620. Each leg 610 is configured to matingly connect with square female components of panel perimeter strips. (See FIGS. 10-20 for various embodiments of panel perimeter strips). FIG. 6B is another perspective view of the three-legged cube connector of FIG. 6A. Both FIG. 6A and FIG. 6B show recessed portions 625 for receiving a gasket as further described below.

Figure 7A:
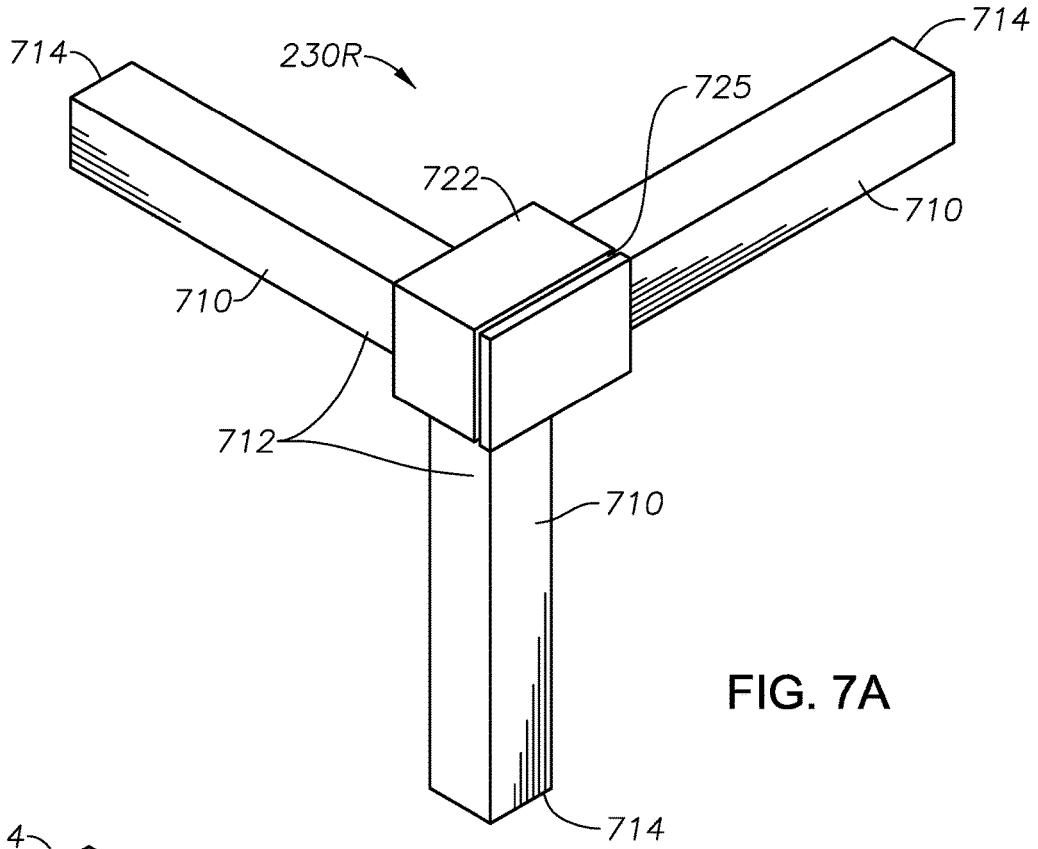
FIG. 7A is a first perspective view of a three-legged cube connector that may be used as one of the components the three-dimensional structure of FIG. 2, in an alternate embodiment.
Figure 7B:
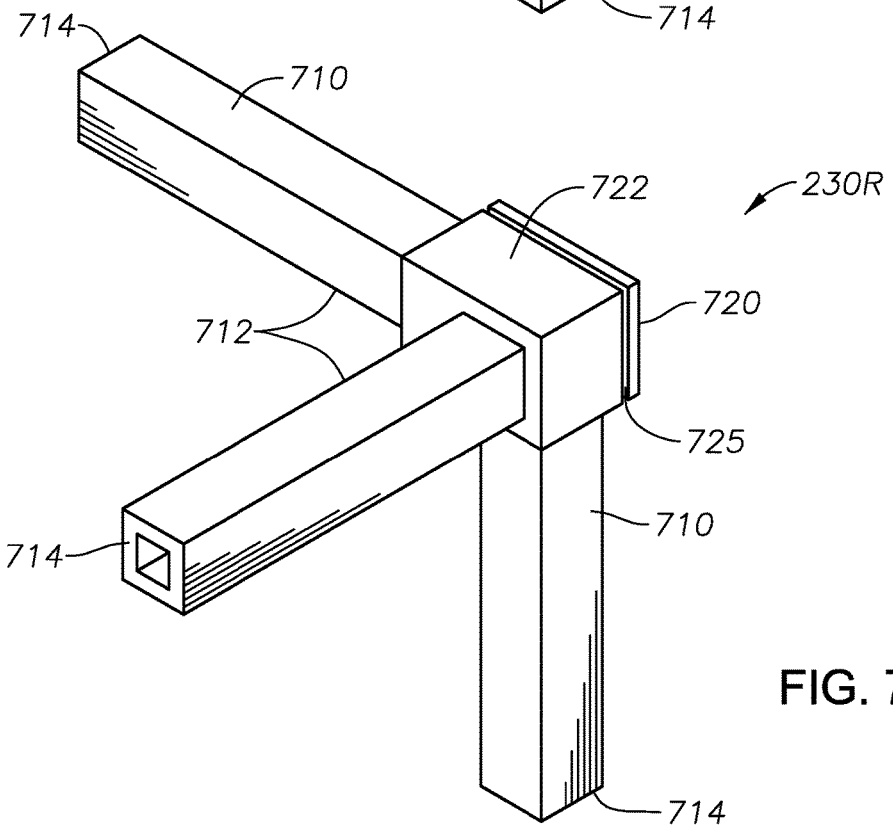
FIG. 7B is another perspective view of the three-legged cube connector of FIG. 7A.

FIG. 7A is a first perspective view of a three-legged cube connector 230R that may be used as one of the components in FIG. 2, in an alternate embodiment. FIG. 7A shows three legs 710, with each leg 710 having a proximal end 712 and a distal end 714 that matingly connects with square female components of panel perimeter strips. (See FIGS. 10-20 for various embodiments of panel perimeter strips). FIG. 7B is another perspective view of the three-legged cube connector 230R of FIG. 7A.

Figure 7C:
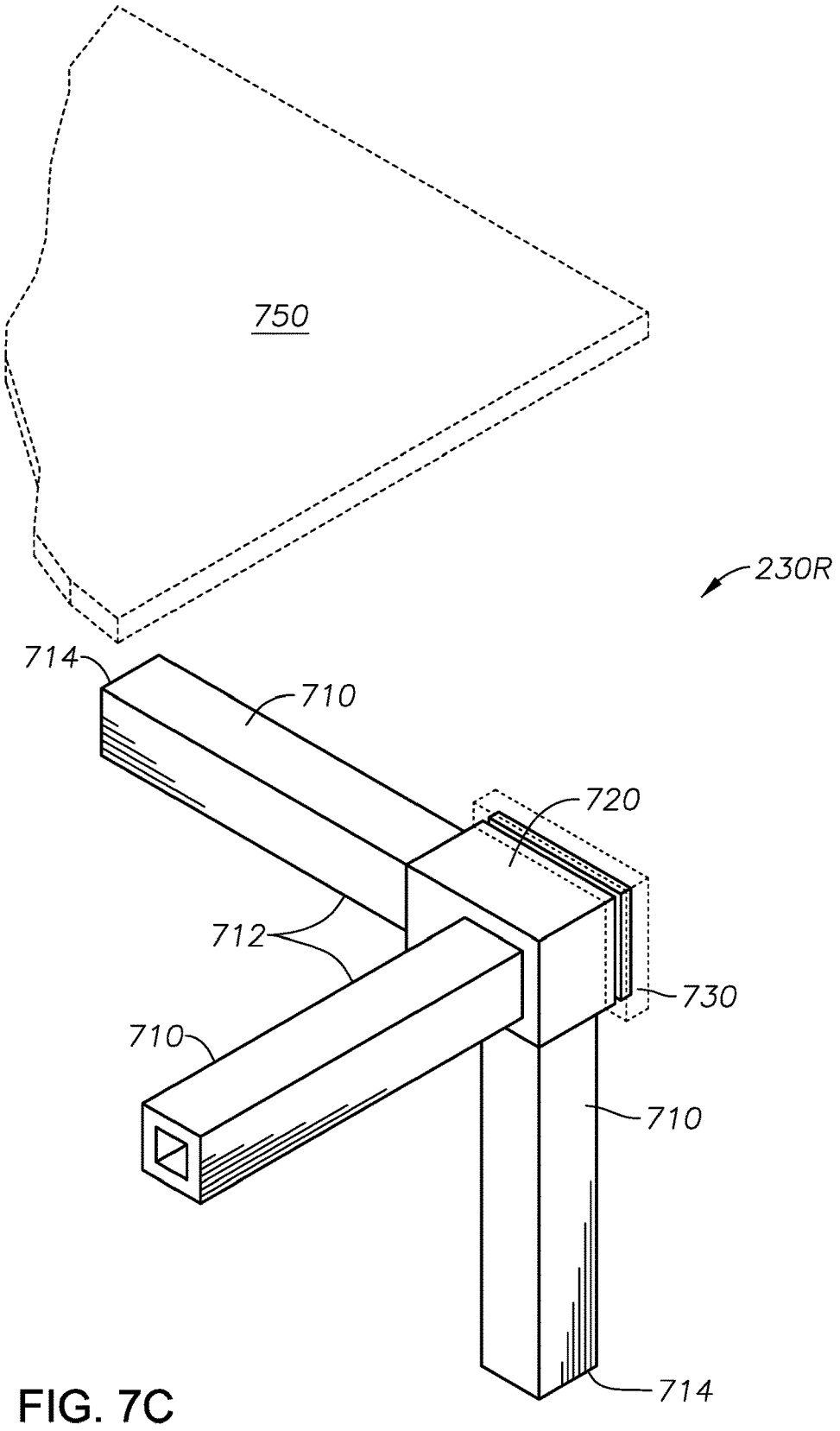
FIG. 7C is a perspective view of the three-legged cube connector of FIG. 7A, having received a gasket (in phantom for clarity) in slots of the cube. A cut-out portion of a rigid wall panel is shown in phantom and exploded away from the connector.

Both FIG. 7A and FIG. 7B show recessed portions 725 for receiving a gasket as further described below. FIG. 7C is a perspective view of the three-legged cube connector of FIG. 7A, having received a gasket 730. A cut-out portion of a rigid wall panel 750 is shown exploded away from the connector 230R.

Figure 8A:
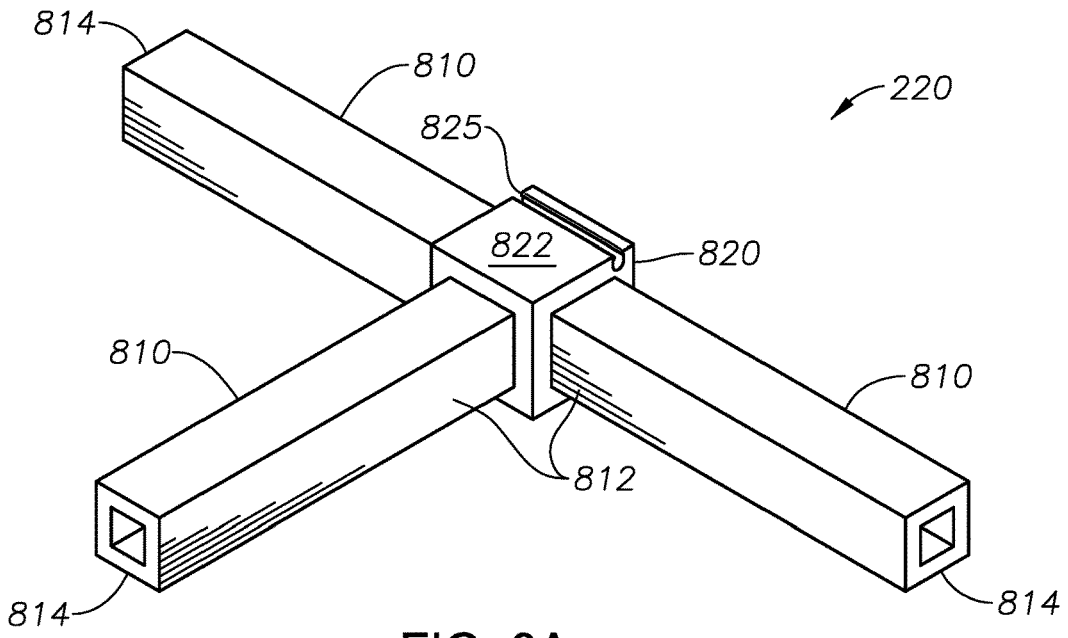
FIG. 8A is a first perspective view of a tee cube connector (also described as a planar three-legged cube connector) that may be used as one of the components in the three-dimensional structure of FIG. 2, in one embodiment.

Returning again to FIG. 2, the three-dimensional structure 200 may next include two or more planar three-legged cube connectors 220. Each planar three-legged cube connector 220 has three legs that form an orthogonal x-y coordinate. FIG. 8A is a first perspective view of a planar three-legged cube connector 220 that may be used as one of the components of the three-dimensional structure 200 of FIG. 2, in one embodiment.

Figure 8B:
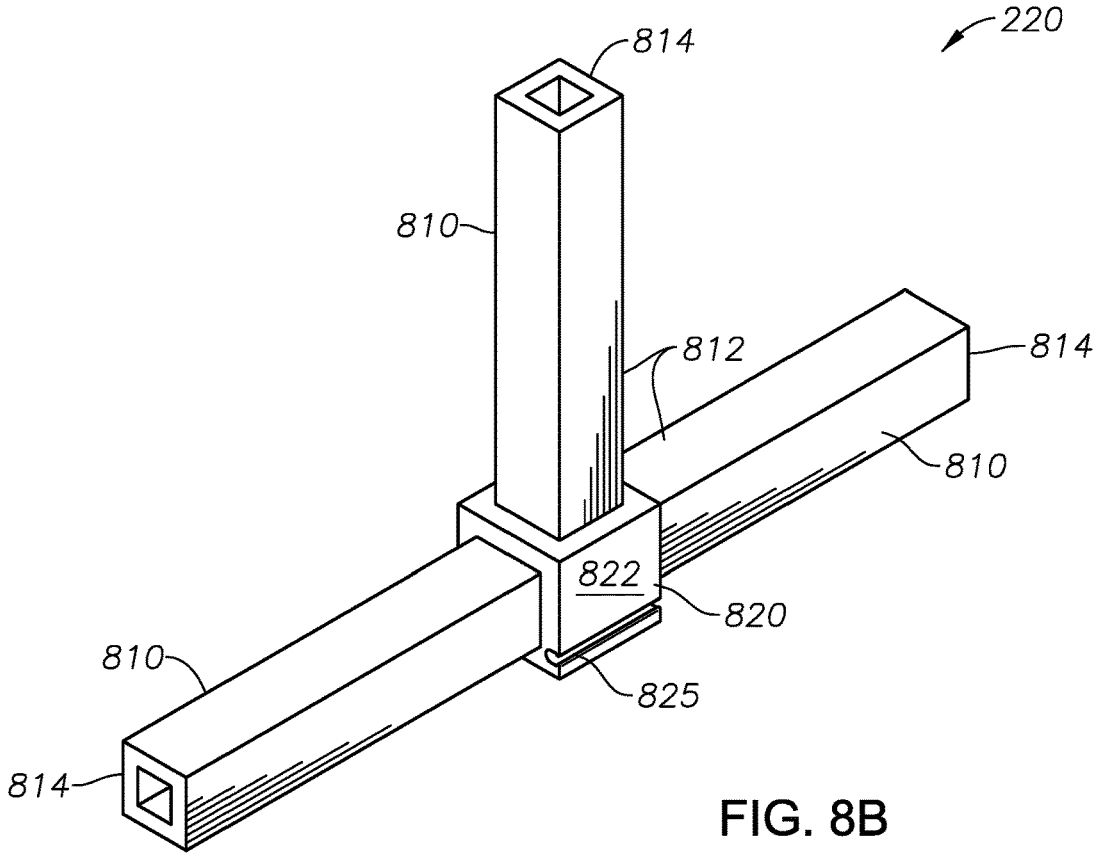
FIG. 8B is another perspective view of the tee cube connector of FIG. 8A.

FIG. 8A shows three legs 810, with each leg 810 having a proximal end 812 and a distal end 814 that matingly connects with square female components of panel perimeter strips. (See FIGS. 10-20 for various embodiments of panel perimeter strips). FIG. 8B is another perspective view of the three-legged cube connector 220 of FIG. 8A. Both FIG. 8A and FIG. 8B show recessed portions 825 for receiving a gasket, such as gasket 730 of FIG. 7C.

Figure 9A:
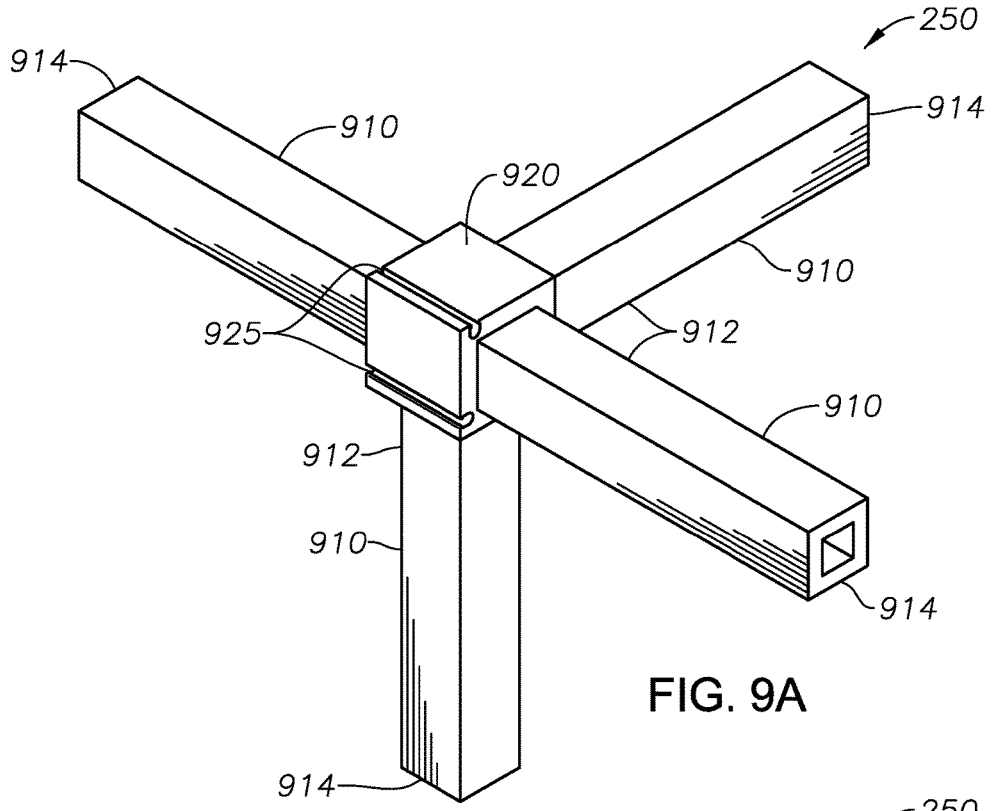
FIG. 9A is a first perspective view of a four-legged cube connector that may be used as one of the components in the three-dimensional structure of FIG. 2, in an alternate embodiment.

Returning again to FIG. 2, the three-dimensional structure 200 may next comprise two or more four-legged cube connectors 250. Each four-legged cube connector 250 has four legs that form an orthogonal x-y-z coordinate. FIG. 9A is a first perspective view of a four-legged cube connector 250 that may be used as one of the components of the three-dimensional structure 200 of FIG. 2, in one embodiment.

Figure 9B:
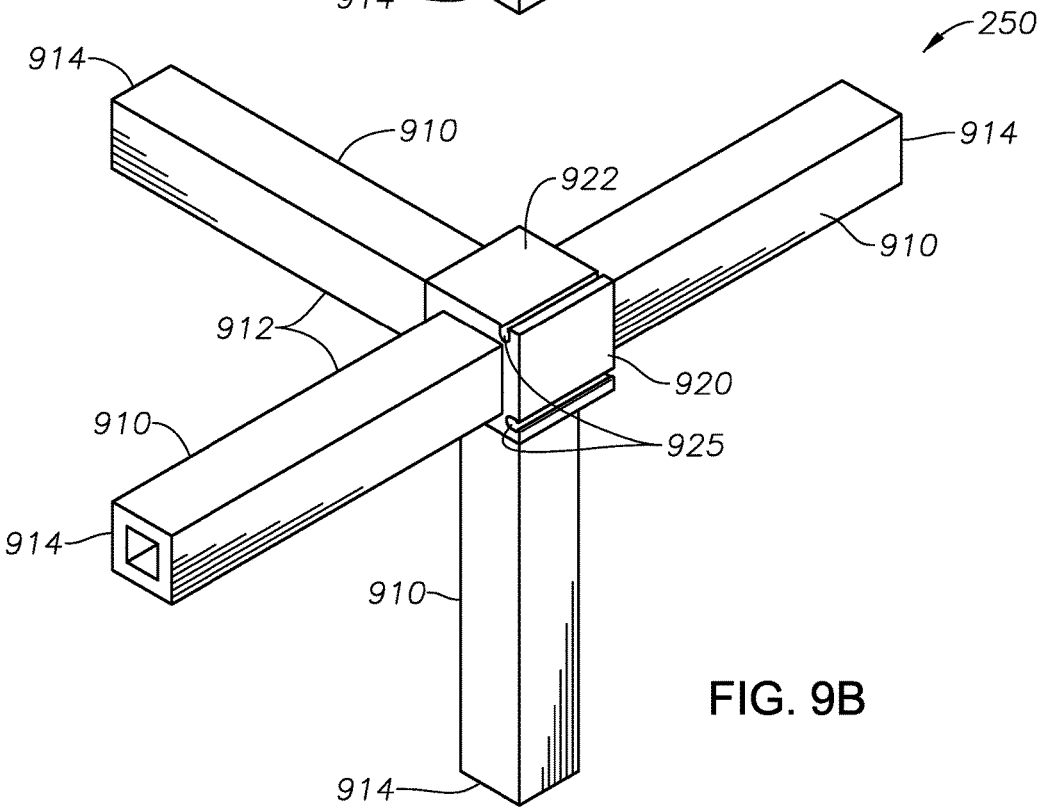
FIG. 9B is another perspective view of the four-legged cube connector of FIG. 9A.

FIG. 9A shows four legs 910, with each leg 910 having a proximal end 912 and a distal end 914 that matingly connects with square female components of panel perimeter strips. (See FIGS. 10-20 for various embodiments of panel perimeter strips). FIG. 9B is another perspective view of the four-legged cube connector of FIG. 9A. Both FIG. 9A and FIG. 9B show recessed portions 925 for receiving a gasket, such as gasket 730 of FIG. 7C.

Each cube connector 220, 230, 240, 250 participates in securing linear extrusion members to form the three-dimensional structure. For example, square female components of panel perimeter strips 210 matingly receive respective legs 310, 410, 510, 610, 710, 810 and 910 of selected cube connectors. Additionally, square female components of panel perimeter strips 260 matingly receive respective legs 310, 410, 510, 610, 710, 810 and 910 of selected cube connectors.

As noted in connection with FIG. 2, the three-dimensional structure 200 also utilizes a plurality of linear extrusion members. These are generally panel perimeter strips 210 and corner connectors 260.

Figure 10A:
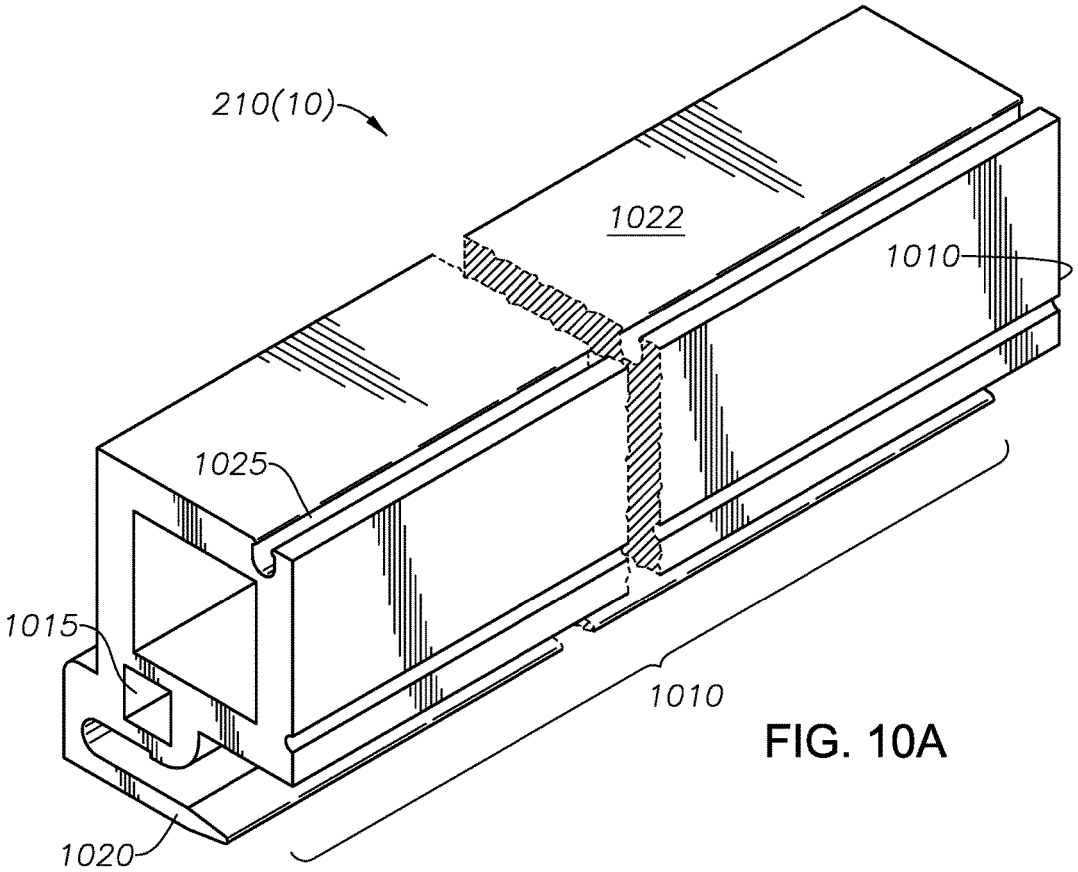
FIG. 10A is a perspective view of a perimeter strip that may be used as one of the components in the three-dimensional structure of FIG. 2, in one embodiment.
Figure 10B:
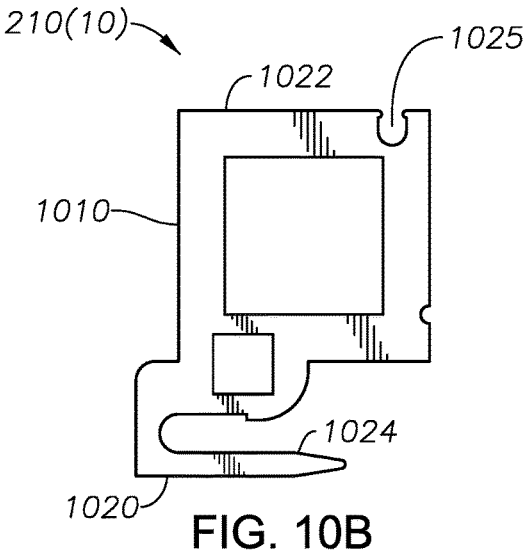
FIGS. 10B and 10C are opposing end views of the perimeter strip of FIG. 10A. In this arrangement, the perimeter strip does not have stiffener legs.
Figure 10C:
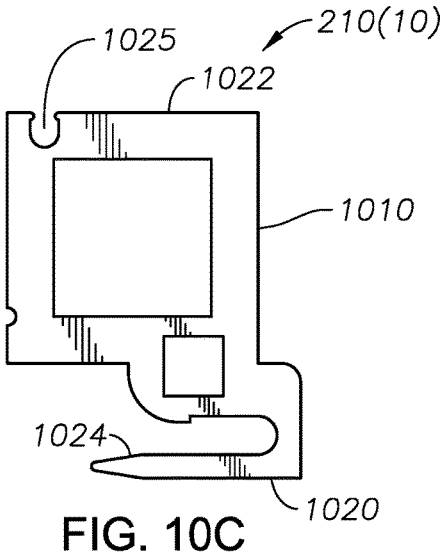

FIG. 10A is a perspective view of an illustrative panel perimeter strip 210(10) that may be used as one of the linear extrusion members of FIG. 2, in one embodiment. Here, the designation "210(10)" refers to the embodiment shown in FIGS. 10A-10C. In this example, a length of the panel perimeter strip 210(10) may be relatively long; therefore, it is shown partitioned to provide a more detailed view. FIGS. 10B and 10C are opposing end views of the perimeter strip 210(10) of FIG. 10A.

The perimeter strip 210(10) comprises an elongated body 1010 fabricated from a metal, preferably aluminum. The body 1010 includes an outward-facing surface 1022, wherein the outward-facing surface includes a recessed portion 1025. As with recessed portions 325, 425, 525, 625, 725, 825 and 925, recessed portion 1025 is configured to receive an elongated spacing element, such as gasket strip 430 or 730. Thus, the panel perimeter strip 210(10) may also be used to adhesively receive and support a rigid panel 450 or 750.

The panel perimeter strip 210(10) includes an integrally formed receiving member 1020. The receiving member 1020 is configured to gravitationally hang on an attachment clip, such as the attachment clip 116 of FIG. 1B. Thus, the receiving member 1020 functions in a manner analogous to the receiving portion of the perimeter strip 114 described above with respect to FIG. 1B. In this respect, the receiving member 1020 engages and interlocks one of the wing members of an attachment clip 116, which attaches the perimeter strip 210(10) to an exterior wall 100.

Note that FIG. 10A also shows a rectangular slot 1015. This is provided primarily for structural and aesthetic purposes. At the same time, the panel perimeter strip 210(10) does not include the C-shaped member of perimeter strip 114 used in the prior art.

Figure 11A:
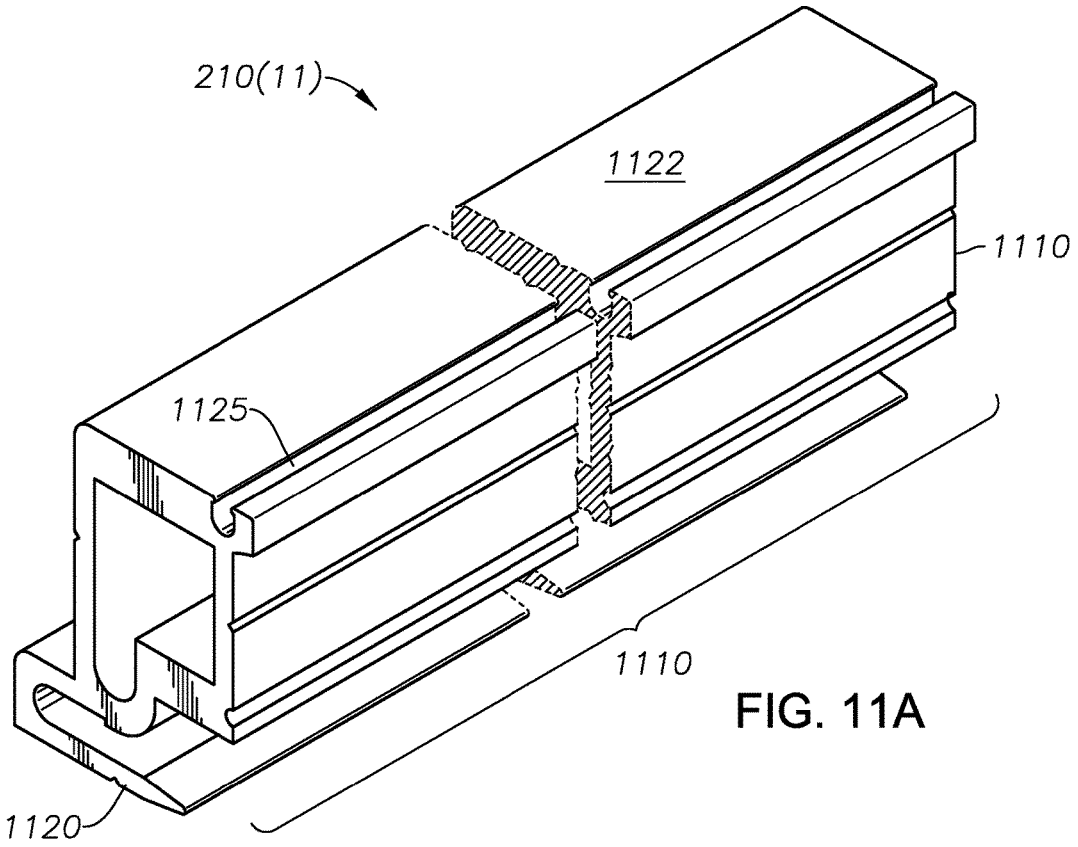
FIG. 11A is a perspective view of a perimeter strip that may be used as one of the components in FIG. 2, in an alternate embodiment.
Figure 11B:
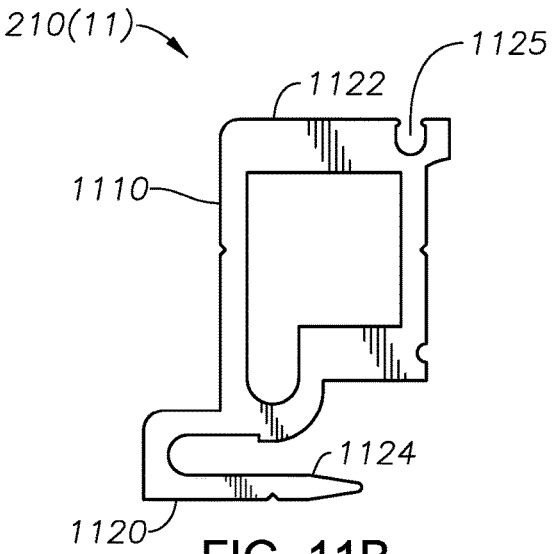
FIGS. 11B and 11C are opposing end views of the perimeter strip of FIG. 11A. In this arrangement, the perimeter strip again does not have stiffener legs.
Figure 11C:
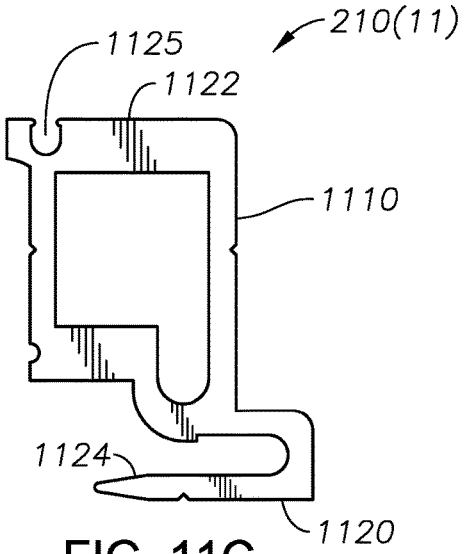

FIG. 11A is a perspective view of a perimeter strip 210(11) that may be used in lieu of the embodiment of FIG. 10A. Here, the designation "210(11)" refers to the embodiment shown in FIGS. 11A-11C. FIGS. 11B and 11C are opposing end views of the perimeter strip 210(11) of FIG. 11A. The perimeter strip 210(11) comprises an elongated body 1110 fabricated from a metal, and preferably from aluminum.

The body 1110 includes an outward-facing surface 1122, wherein the outward-facing surface 1122 includes a recessed portion 1125. As with recessed portion 1025, recessed portion 1125 is configured to receive an elongated spacing element, such as gasket strip 430 or 730. The perimeter strip 210(11) also includes an integrally formed receiving member 1120.

Figure 1A:
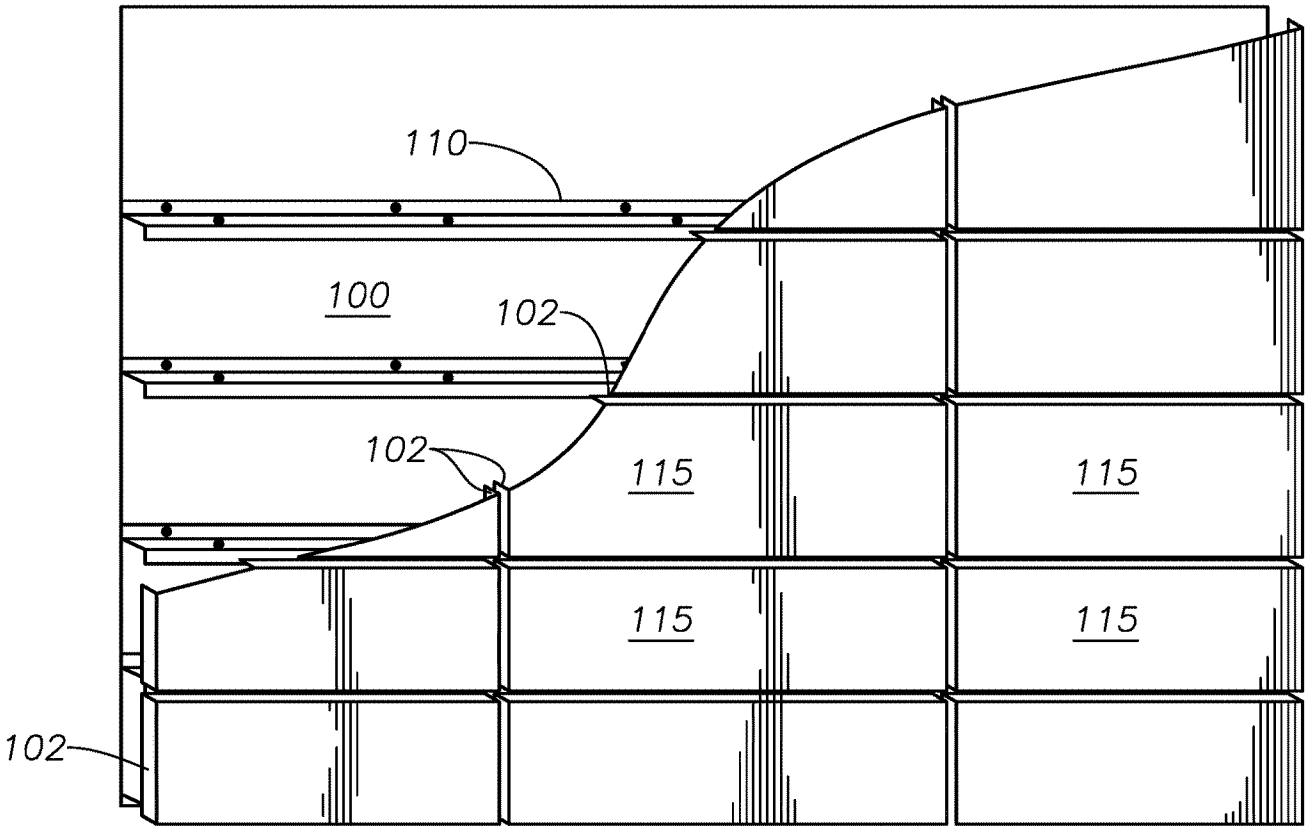
FIG. 1A (Prior Art)
FIG. 1A is a partial cutaway perspective view of a known wall panel system. The wall panel system consists of a series of wall panels that have been hung onto horizontally-placed bracket assemblies. The gravitational connection is made using perimeters strips (connected to the panels) that mate with attachment clips (connected to the bracket assemblies).
Figure 1B:
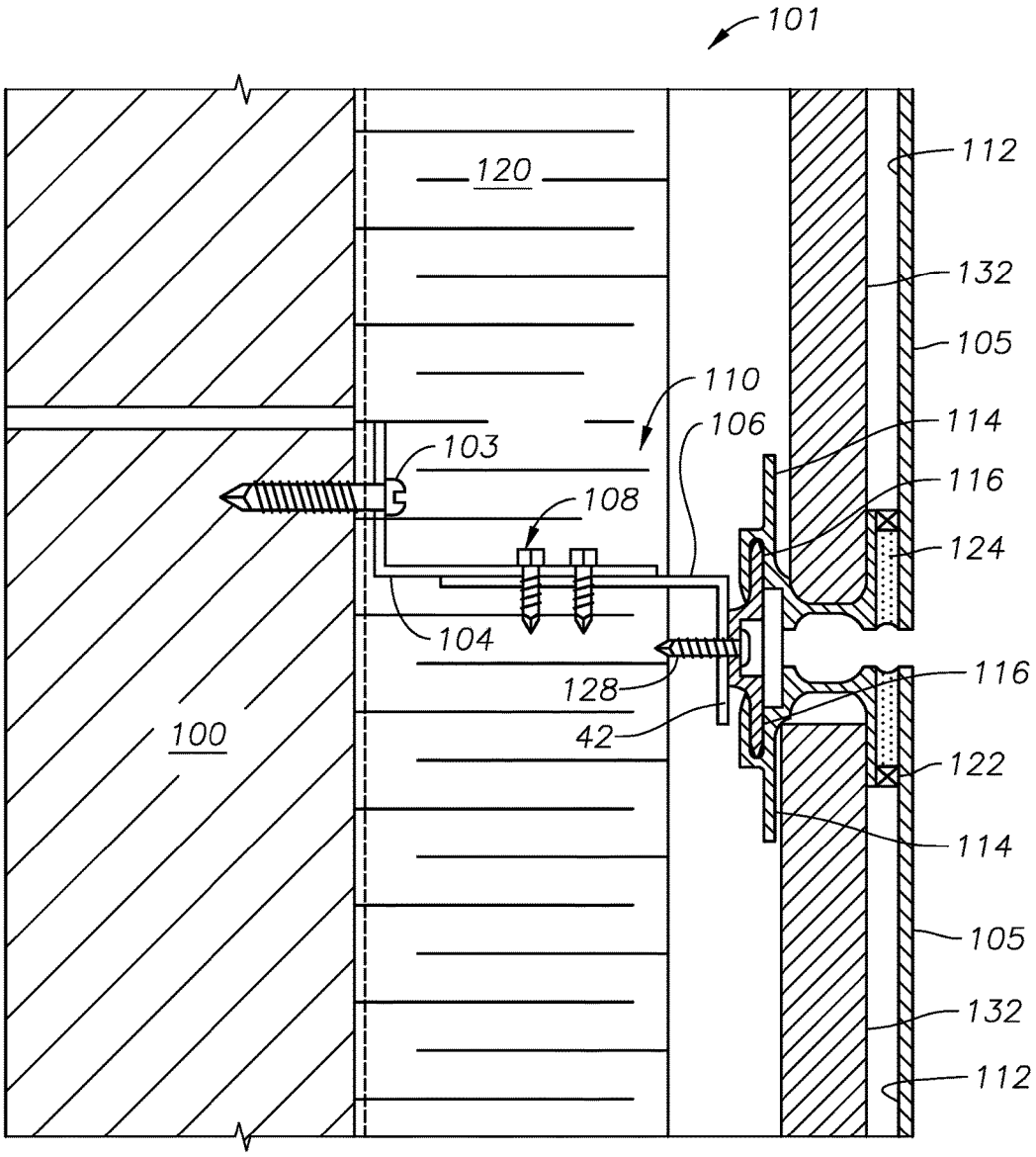
FIG. 1B (Prior Art)
FIG. 1B is a cross-sectional view of a known bracket assembly connected to a wall. An attachment clip is shown secured to the bracket assembly, while perimeter strips are matingly attached to wing members of the attachment clip. Ceramic panels are adhesively secured to the perimeter strips.

The receiving member 1120 is configured to be gravitationally hung onto an attachment clip, such as the attachment clip 116 of FIG. 1B. A beveled end 1224 is provided along the receiving member 1220 to facilitate this.

Note that neither perimeter strip 210(10) nor perimeter strip 210(11) employ stiffener legs (as are shown in other embodiments described below). Thus, they are not configured to receive a panel stiffener (shown at 2100 in FIG. 21A through 21C).

Figure 12A:
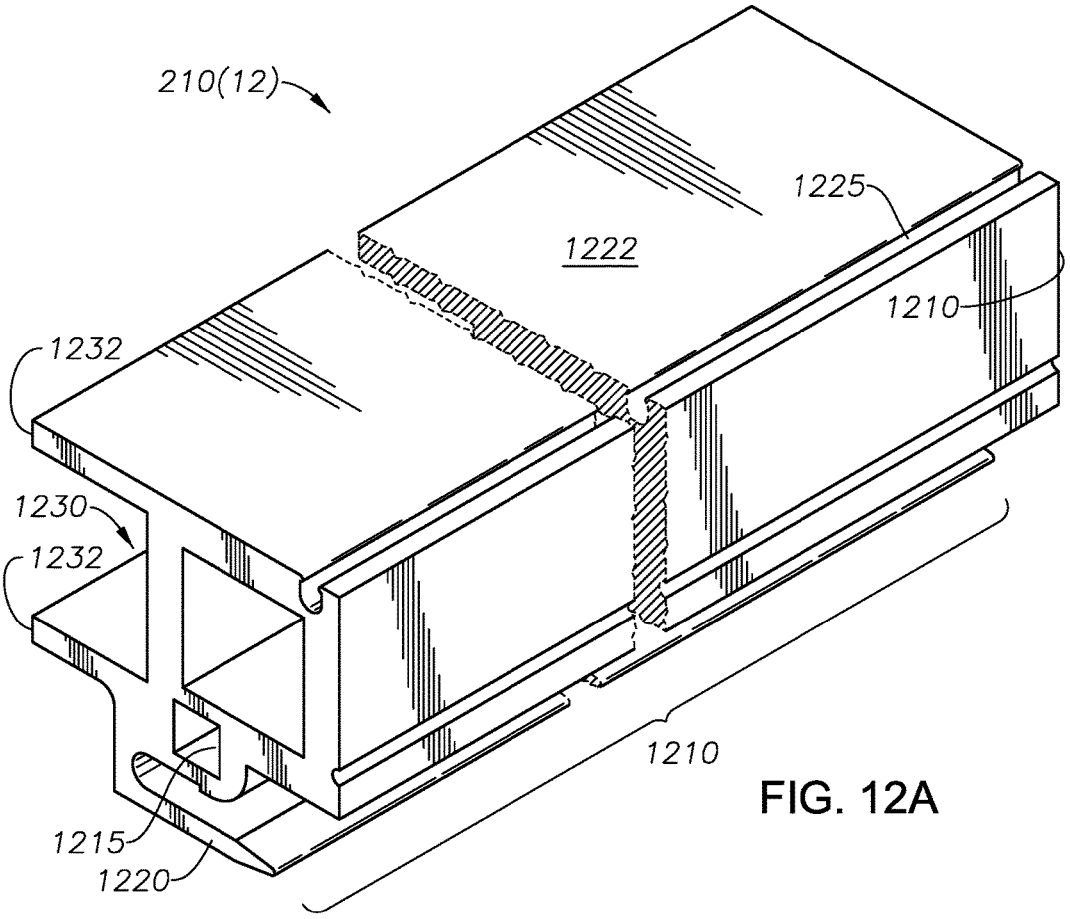
FIG. 12A is a first perspective view of a perimeter strip that may be used as one of the components in FIG. 2, in another alternate embodiment.
Figure 12B:
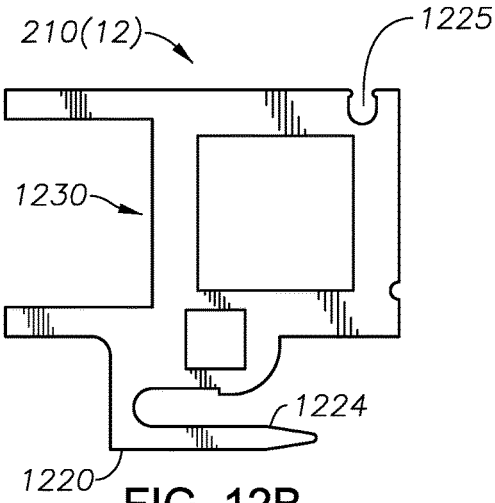
FIGS. 12B and 12C are opposing end views of the perimeter strip of FIG. 12A. In this instance, the perimeter strip includes integral stiffener legs.
Figure 12C:
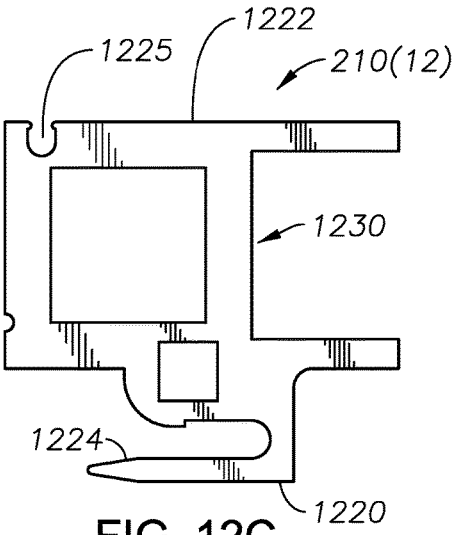

FIG. 12A is a perspective view of a perimeter strip 210(12) that may be used in lieu of the embodiment of FIG. 10A or 11A, in another alternate embodiment. Here, the designation "210(12)" refers to the embodiment shown in FIGS. 12A-12C. FIGS. 12B and 12C are opposing end views of the perimeter strip 210(12) of FIG. 12A. Here, the perimeter strip 210(12) includes a pair of integral stiffener legs 1232. In addition, the perimeter strip 210(12) includes a rectangular slot 1215 provided primarily for structural and aesthetic purposes.

The perimeter strip 210(12) comprises an elongated body 1210 fabricated from a metal, and preferably from aluminum. The body 1210 includes an outward-facing surface 1222, wherein the outward-facing surface 1222 includes a recessed portion 1225. As with recessed portion 1025, recessed portion 1225 is configured to receive an elongated spacing element, such as gasket strip 430 or 730. The panel perimeter strip 210(12) also includes an integrally formed receiving member 1220.

The receiving member 1220 is configured to be gravitationally hung onto an attachment clip, such as the attachment clip 116 of FIG. 1B. A beveled end 1224 is provided along the receiving member 1220 to facilitate this.

Of interest, panel perimeter strip 210(12) includes a pair of parallel legs 1232. The legs 1232 extend away from the direction of the Receiving member 1220. The legs 1232 define a slot 1230, with the slot being dimensioned to receive an optional panel stiffener, such as panel stiffener 2100 of FIGS. 21A, 21B and 21C. As will be described further below, the panel stiffener 2100 resides immediately below a rigid panel 450 and provides support to keep the panel 450 from bowing, or "oil-canning."

Figure 13A:
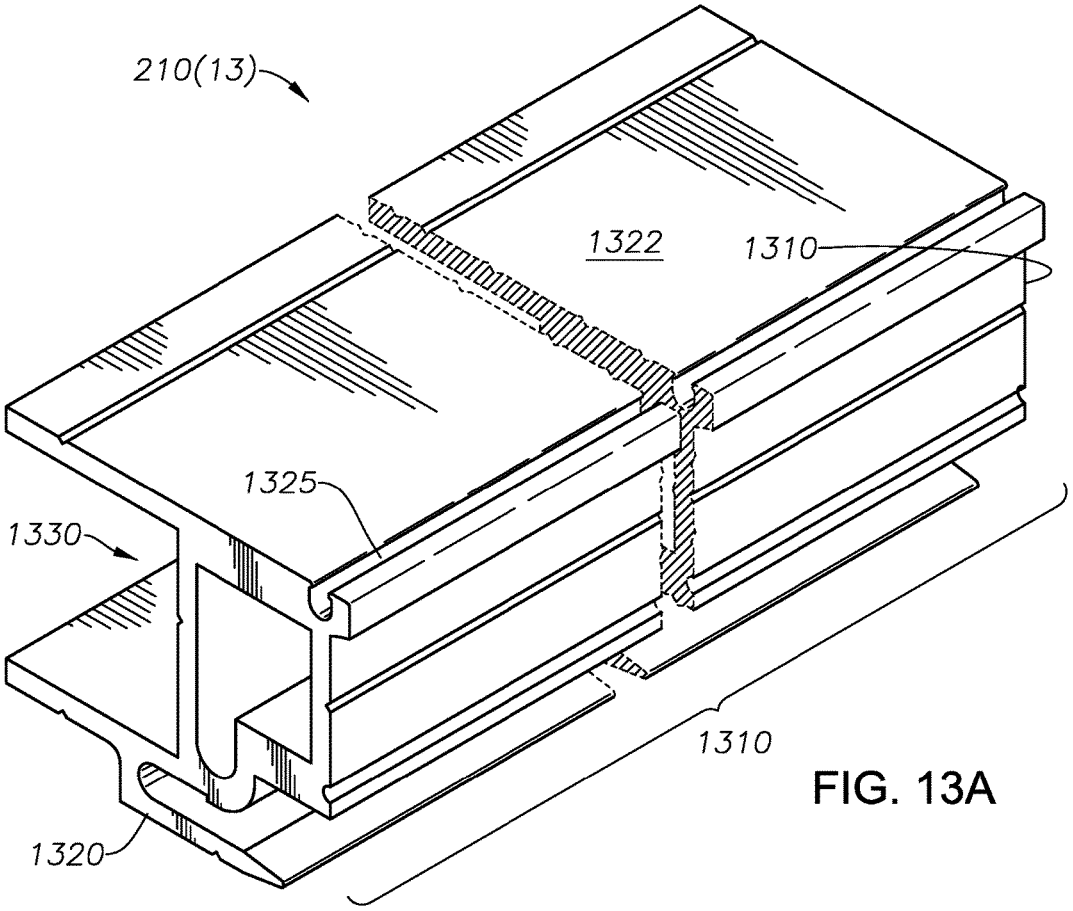
FIG. 13A is a first perspective view of a perimeter strip that may be used as one of the components in FIG. 2, in still another alternate embodiment.
Figure 13B:
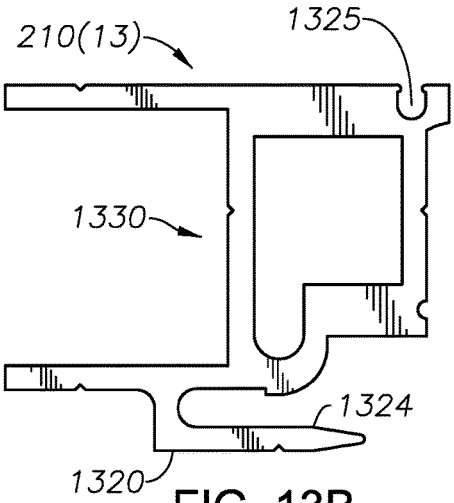
FIGS. 13B and 13C are opposing end views of the perimeter strip of FIG. 13A. This perimeter strip also includes one pair of integral stiffener legs.
Figure 13C:
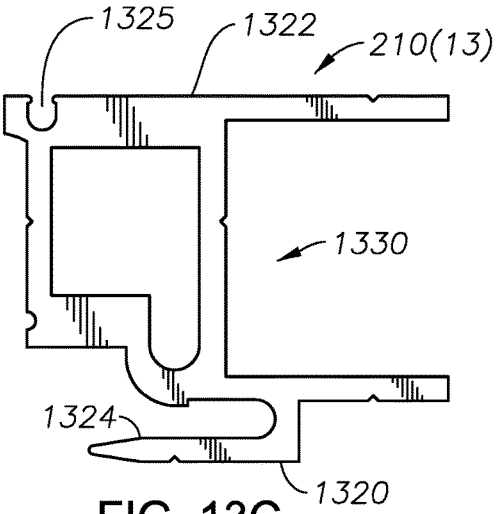

FIG. 13A is a perspective view of a perimeter strip 210(13) that may be used in lieu of the embodiments of FIG. 10A, 11A, or 12A in still another alternate embodiment. Here, the designation "210(13)" refers to the embodiment shown in FIGS. 13A-13C. FIGS. 13B and 13C are opposing end views of the perimeter strip 210(13) of FIG. 13A.

The perimeter strip 210(13) comprises an elongated body 1310 fabricated from a metal, and preferably from aluminum. The body 1310 includes an outward-facing surface 1322, wherein the outward-facing surface 1322 includes a recessed portion 1325. As with recessed portion 1025, recessed portion 1325 is configured to receive an elongated spacing element, such as gasket strip 430 or 730. The panel perimeter strip 210(13) also includes an integrally formed receiving member 1320.

The receiving member 1320 is configured to be gravitationally hung onto an attachment clip, such as the attachment clip 116 of FIG. 1B. A beveled end 1324 is provided along the receiving member 1320 to facilitate this.

Figure 21A:
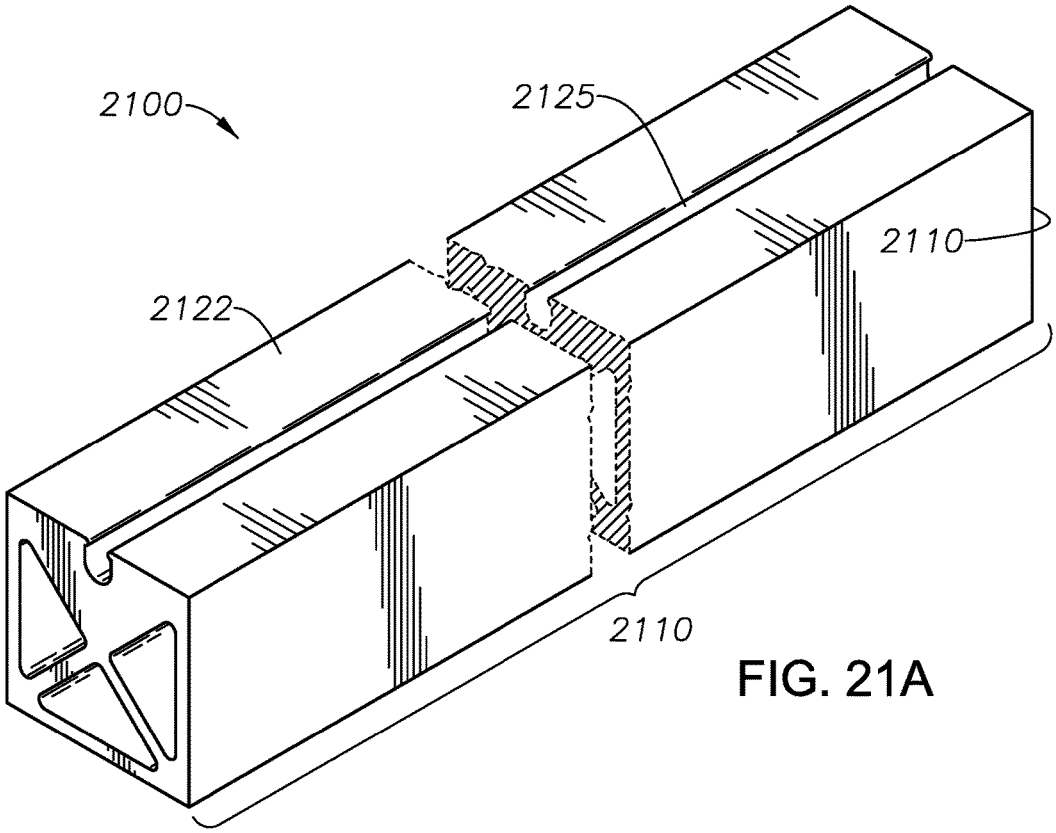
FIG. 21A is a perspective view of a panel stiffener that may be used as one of the components in the three-dimensional structure of FIG. 2, in one embodiment.
Figure 21B:
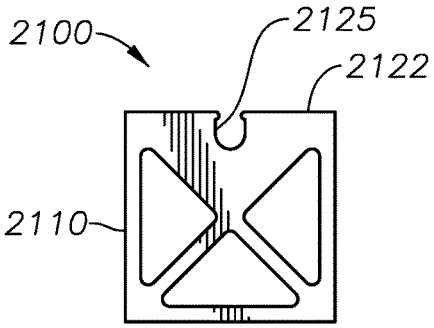
FIGS. 21B and 21C are opposing end views of the panel stiffener of FIG. 21A.
Figure 21C:
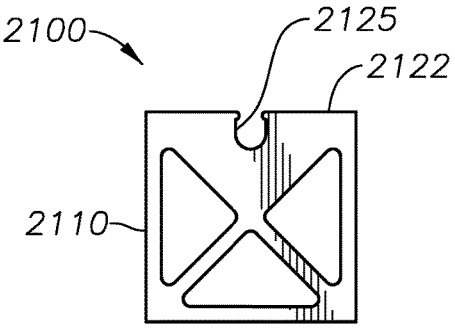

Note also that the perimeter strip 210(13) includes the slot 1330 for slidably and/or frictionally receiving an end of a panel stiffener, such as panel stiffener 2100 of FIGS. 21A, 21B and 21C. The perimeter strip 210(13) includes elongated stiffener legs 1322 for this purpose.

Figure 14A:
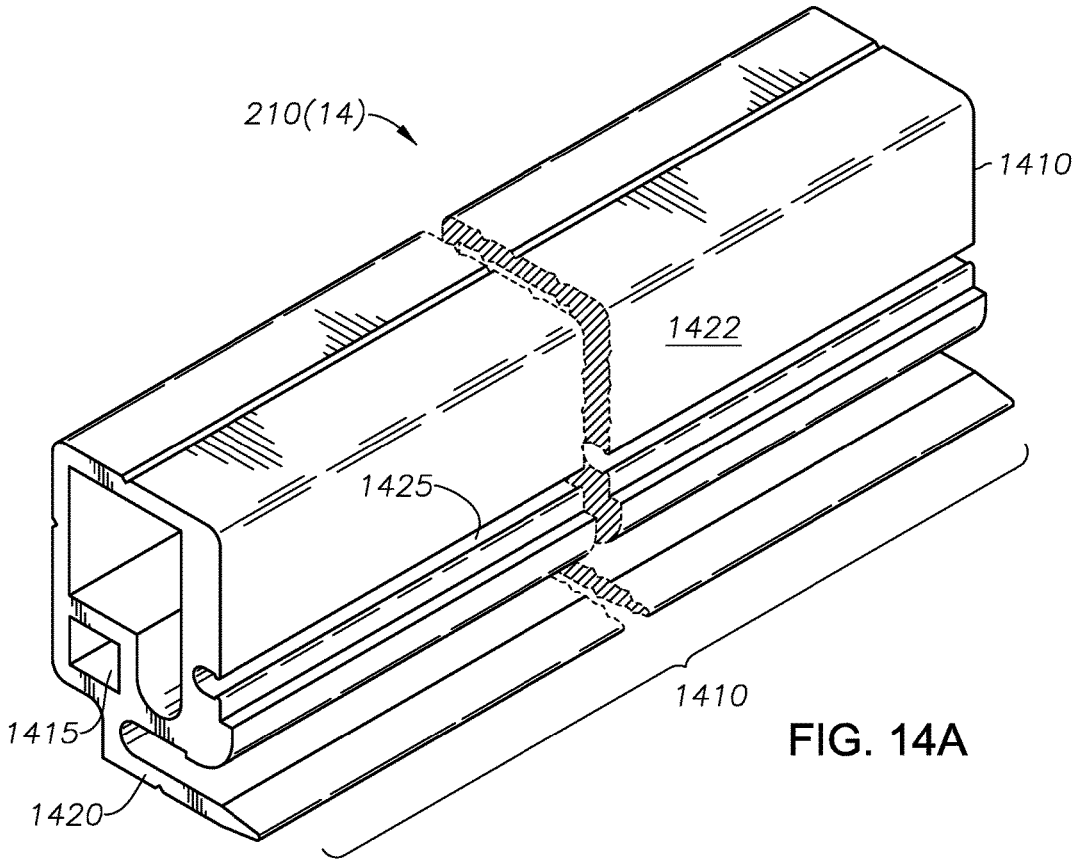
FIG. 14A is a first perspective view of a perimeter strip that may be used as one of the components in FIG. 2, in yet another alternate embodiment.
Figure 14B:
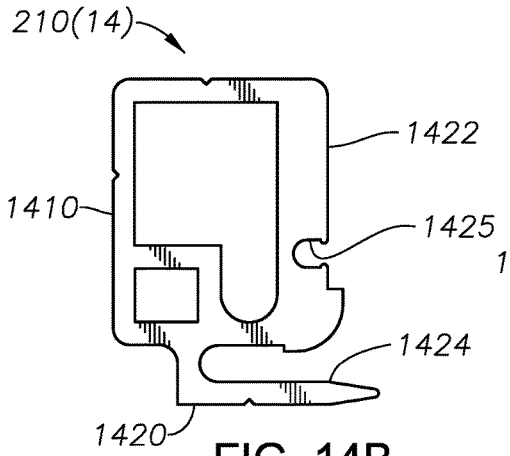
FIGS. 14B and 14C are opposing end views of the perimeter strip of FIG. 14A. This perimeter strip does not have stiffener legs but does employ a PCT support edge.
Figure 14C:
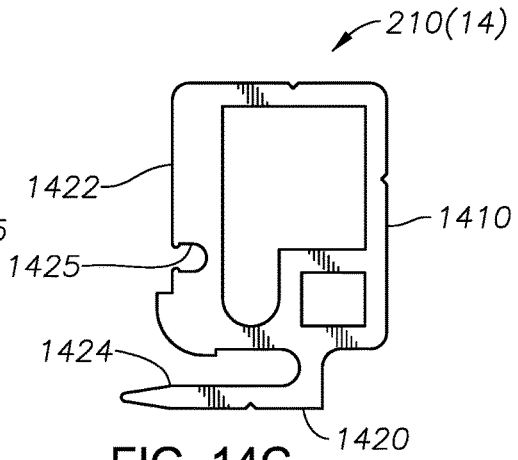

FIG. 14A is a perspective view of a perimeter strip 210(14) that may be used lieu of the embodiments of FIG. 10A, 11A, 12A, or 13A in yet another alternate embodiment. Here, the designation "210(14)" refers to the embodiment shown in FIGS. 14A-14C. FIGS. 14B and 14C are opposing end views of the perimeter clip of FIG. 14A.

The perimeter strip 210(14) comprises an elongated body 1410 fabricated from a metal, and preferably from aluminum. The body 1410 includes an outward-facing surface 1422, wherein the outward-facing surface 1422 includes a recessed portion 1425. As with recessed portion 1025, recessed portion 1425 is configured to receive an elongated spacing element, such as gasket strip 430 or 730. The perimeter strip 210(14) also includes an integrally formed receiving member 1420.

The receiving member 1420 is configured to be gravitationally hung onto an attachment clip, such as the attachment clip 116 of FIG. 1B. A beveled end 1424 is provided along the receiving member 1420 to facilitate this.

It is observed that the panel perimeter strip 210(14) does not include stiffener legs; however, it does offer a porcelain ceramic tile "return." The "return" is a mitered edge, or shoulder 1422, that is dimensioned to allow the PCT to return back into the joint, using only a single row of aluminum extrusions and castings to create a projection. The shoulder 1422 is placed adjacent the receiving member 1420 so that a rigid wall panel may be uniquely placed perpendicular to wall 100.

The perimeter strip 210(14) also includes a rectangular slot 1415. The slot 1415 is provided somewhat for structural but primarily for economic purposes.

Figure 15A:
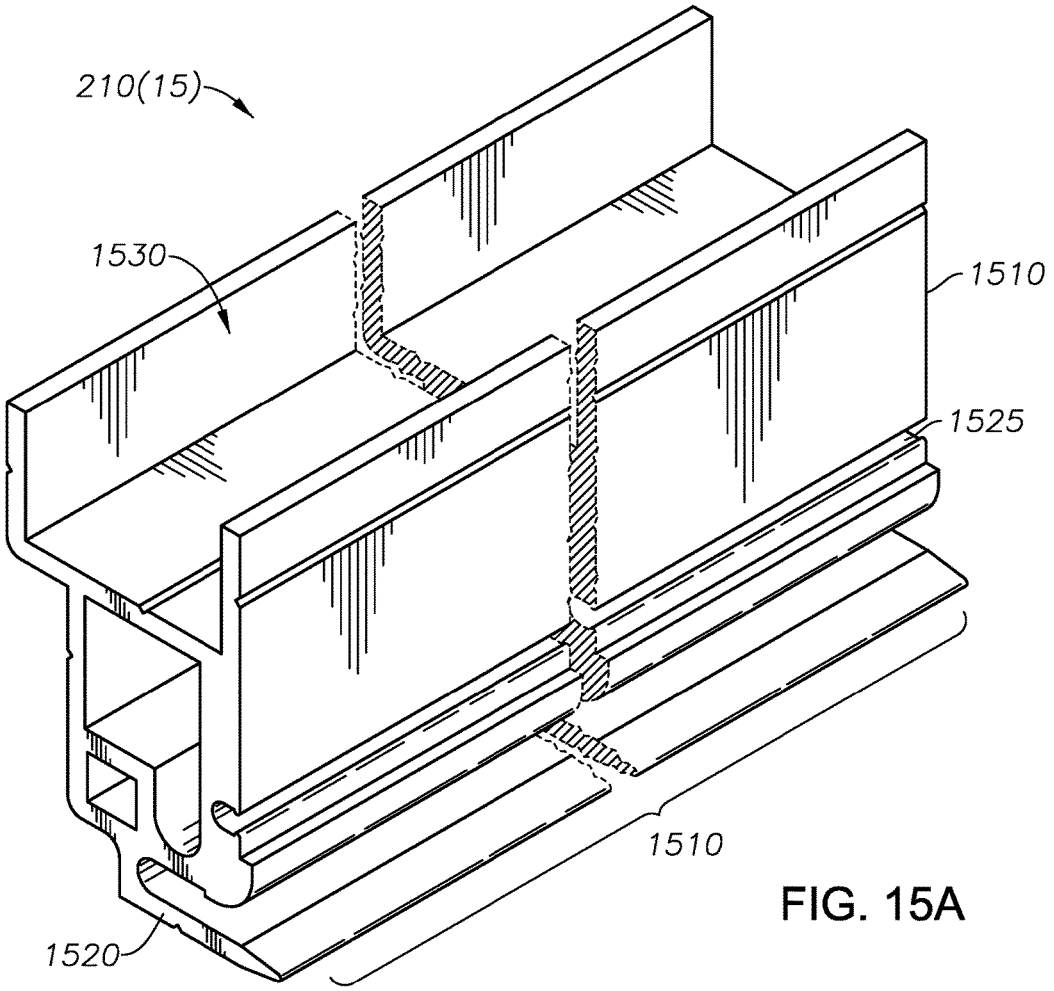
FIG. 15A is a first perspective view of a perimeter inside corner strip that may be used as one of the components in FIG. 2, in yet another alternate embodiment.
Figure 15B:
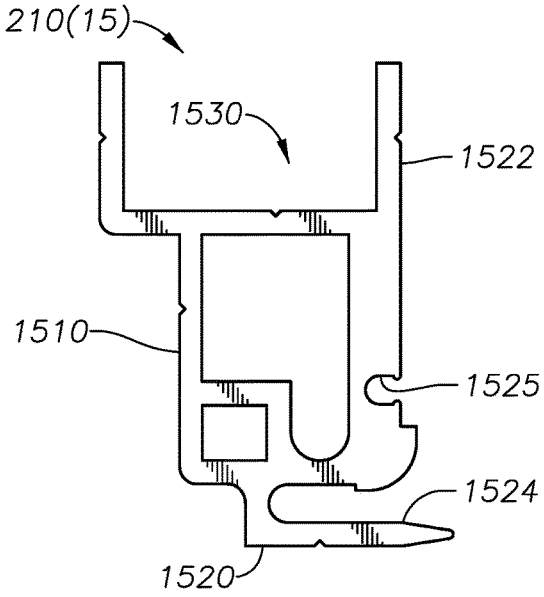
FIGS. 15B and 15C are opposing end views of the perimeter clip of FIG. 15A. This perimeter strip employs both stiffener legs and a PCT support edge.
Figure 15C:
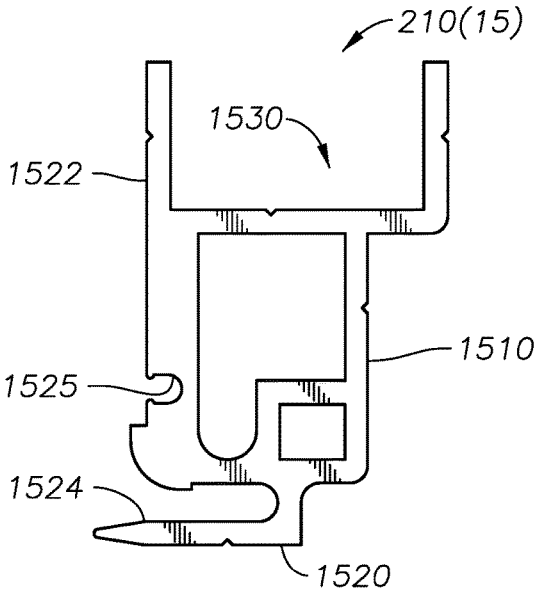

Finally, FIG. 15A provides a perspective view of a perimeter strip 210(15), in yet another alternate embodiment. Here, the designation "210(15)" refers to the embodiment shown in FIGS. 15A-15C. FIGS. 15B and 15C are opposing end views of the perimeter clip of FIG. 15A. The perimeter strip 210(15) is uniquely configured to serve as an inside corner strip.

The perimeter strip 210(15) comprises an elongated body 1510 fabricated from a metal, and preferably from aluminum. The body 1510 includes an outward-facing surface 1522, wherein the outward-facing surface 1522 includes a recessed portion 1525. As with recessed portion 1025, recessed portion 1525 is configured to receive an elongated spacing element, such as gasket strip 430 or 730. The perimeter strip 210(15) also includes an integrally formed receiving member 1520.

The receiving member 1520 is configured to be gravitationally hung onto an attachment clip, such as the attachment clip 116 of FIG. 1B. A beveled end 1524 is provided along the receiving member 1520 to facilitate this.

Note also that the perimeter strip 210(15) also includes a slot 1530 for slidably and/or frictionally receiving an end of a panel stiffener, such as panel stiffener 2100 of FIGS. 21A, 21B and 21C. However, in this arrangement, the slot 1530 is oriented perpendicular to the receiving member 1520.

The perimeter strip 210(15) also offers the PCT return feature 1526. The strip 210(15) may be used with a panel that would be returned into an inside corner, or for columns (such as columns that project out from a common wall that connects perpendicular to the wall). This extrusion, in most cases, will not work for parapets.

Each of the perimeter strips 210(10), 210(11), 210(12), 210(13), 210(14), and 210(15) described above includes the receiving member. The functionality of the perimeter strips 210(10), 210(11), 210(12), 210(13), 210(14), and 210(15) may be seen in FIGS. 26A to 28, described below. However, some linear extrusions will not include the receiving member. These are referred to herein as corner connectors, or sometimes as "box connectors." Some box connectors are "inside corner" strips, while others are "outside corner" strips.

Figure 16A:
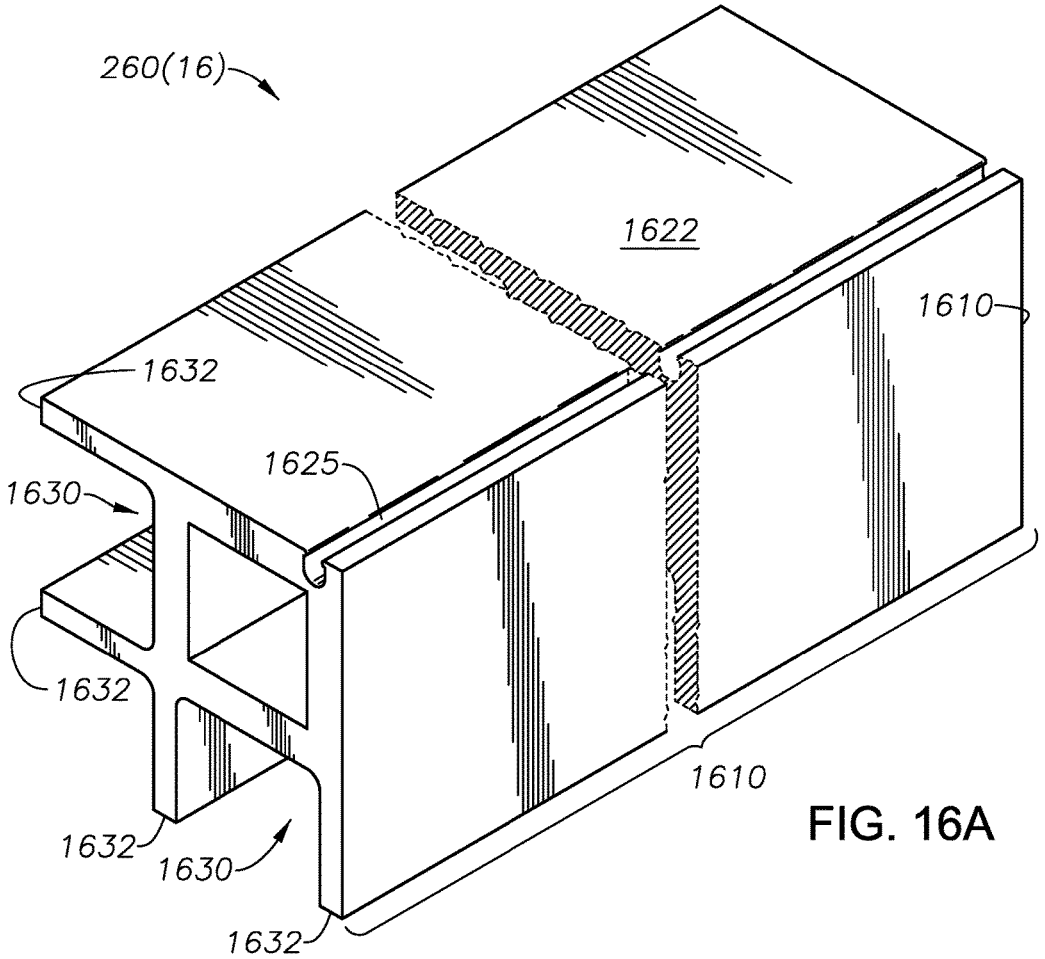
FIG. 16A is a perspective view of an outside corner connector that may be used as one of the components in FIG. 2.
Figure 16B:
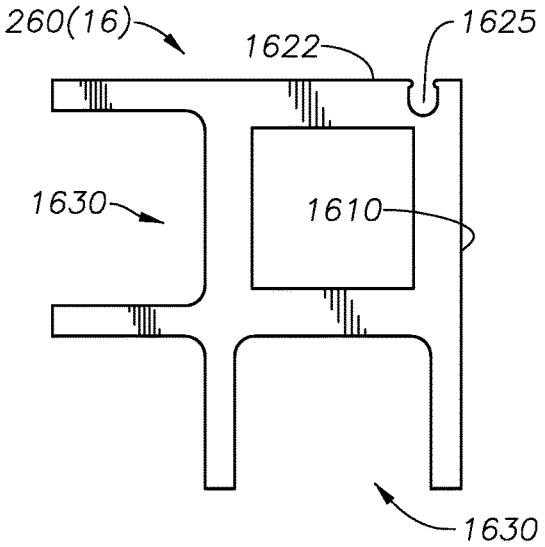
FIGS. 16B and 16C are opposing end views of the outside corner connector of FIG. 16A. This corner connector utilizes two pairs of stiffener legs.
Figure 16C:
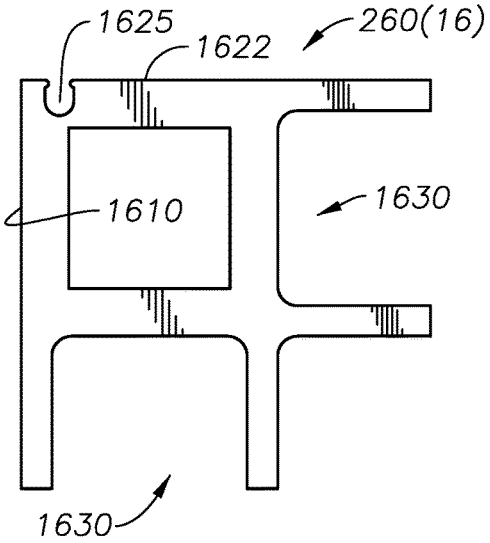

FIG. 16A is a perspective view of an illustrative outside corner connector 260(16). The outside corner connector 260(16) is an example of a linear extrusion member that may be used as one of the components of the three-dimensional structure 200 of FIG. 2, in one embodiment. FIGS. 16B and 16C are opposing end views of the outside corner connector 260(16) of FIG. 16A. The designation "260(16)" refers to the embodiment shown in FIGS. 16A-16C in which the connector 260(16) is configured to serve as an outside corner strip for a three-dimensional structure.

In the embodiment of FIG. 16A, the outside connector 260(16) is generally square in its geometry. For this reason, the connector 260(16) is referred to herein as a "box connector."

The outside corner connector 260(16) comprises an elongated body 1610 fabricated from a metal, and preferably from aluminum. The body 1610 includes an outward-facing surface 1622, wherein the outward-facing surface 1622 includes a recessed portion 1625. As with recessed portions 325, 425, 525, 625, 725, 825 and 925, recessed portion 1625 is configured to receive an elongated spacing element, such as gasket strip 430 or 730. Thus, the outside connector 260(16) may also be used to adhesively receive and support a rigid panel 450 or 750.

It is again noted that the outside corner connector 260(16) does not have a receiving member. Therefore, the corner connector 260(16) is not secured to an attachment clip 116 and is not used to aid in gravitationally holding the frame structure 200 to a wall 100.

Of interest, the illustrative outside corner connector 260(16) includes a pair of parallel stiffener legs 1632. More specifically, the corner connector 260(16) offers two pairs of parallel legs 1632. Each pair of stiffener legs 1632 extends away from the body 1610, and defines a slot 1630. The slots 1630 are dimensioned to receive a panel stiffener, such as panel stiffener 2100 of FIGS. 21A, 21B and 21C. The panel stiffener 2100 resides immediately below a rigid panel 450 and provides support to keep the panel 450 from bowing, or "oil-canning."

Figure 17A:
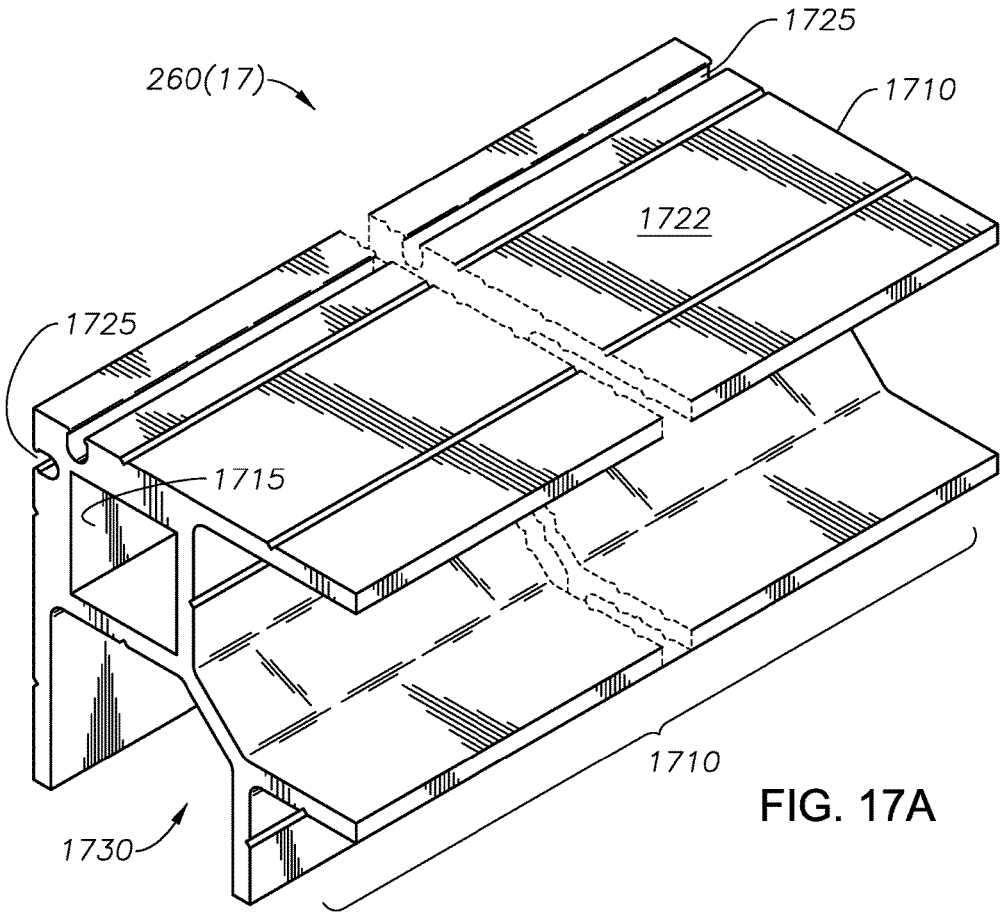
FIG. 17A is a perspective view of another outside corner connector that may be used as one of the components in FIG. 2, in an alternate embodiment.
Figure 17B:
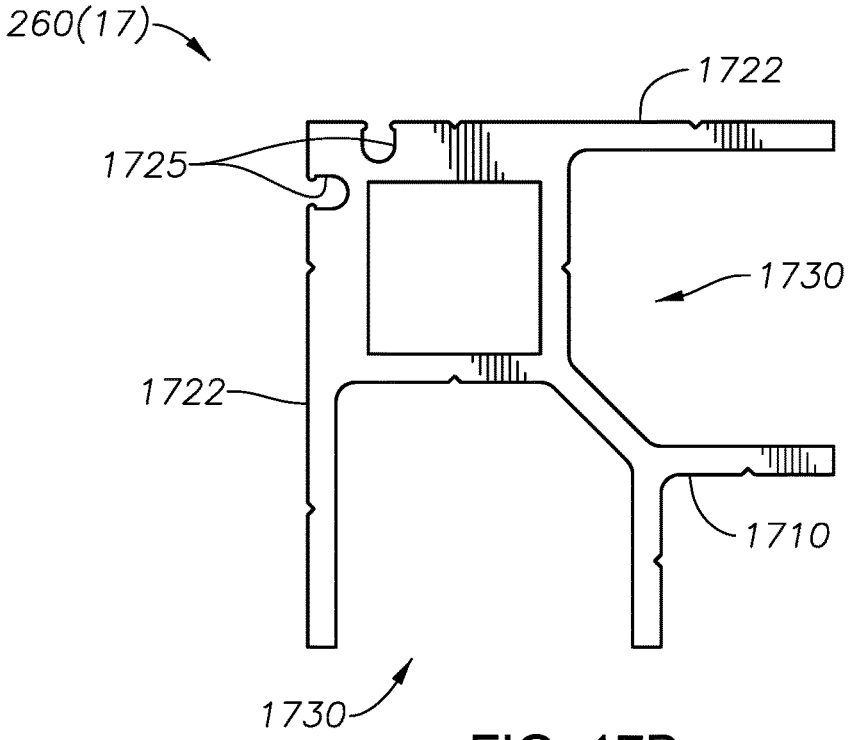
FIGS. 17B and 17C are opposing end views of the outside corner connector of FIG. 17A. This connector also utilizes two pairs of stiffener legs.
Figure 17C:
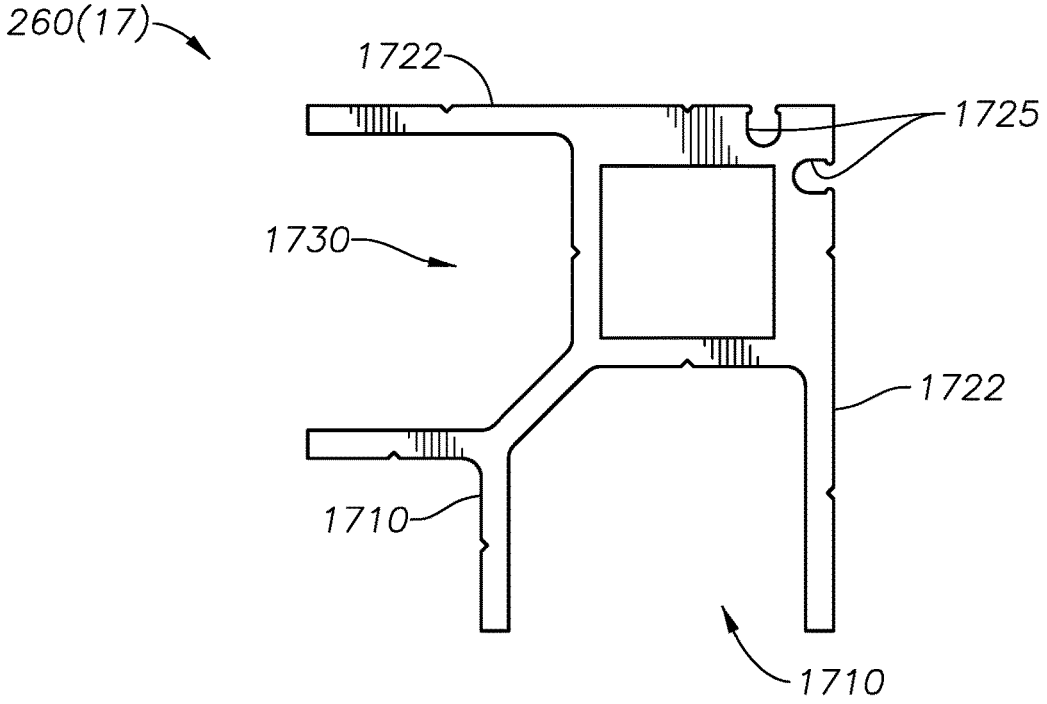

FIG. 17A is a perspective view of another outside corner connector 260(17). This may be used in lieu of the embodiment 260(16) of FIG. 16. FIGS. 17B and 17C are opposing end views of the outside corner connector 260(17) of FIG. 17A. The designation "210(17)" refers to the embodiment shown in FIGS. 17A-17C in which connector 260(17) is also uniquely configured to serve as an outside corner strip.

As can be seen, the outside corner connector 260(17) defines an elongated body 1710 fabricated from a metal. The body 1710 includes an outward-facing surface 1722, wherein the outward-facing surface 1722 includes a recessed portion 1725. As with recessed portion 1625, recessed portion 1725 is configured to receive an elongated spacing element, such as gasket strip 430 or 730. Thus, the outside connector 260(17) may also be used to adhesively receive and support a rigid panel 450 or 750.

Figure 18A:
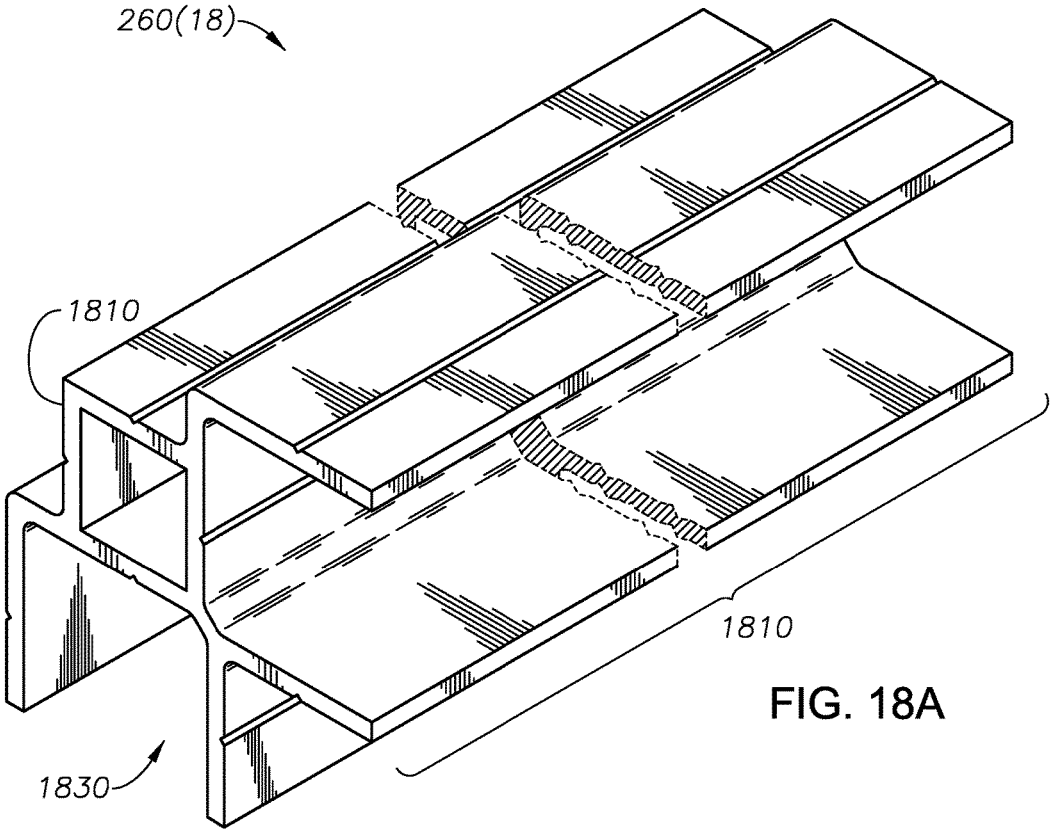
FIG. 18A is a perspective view of an inside corner connector that may be used as one of the components in FIG. 2.
Figure 18B:
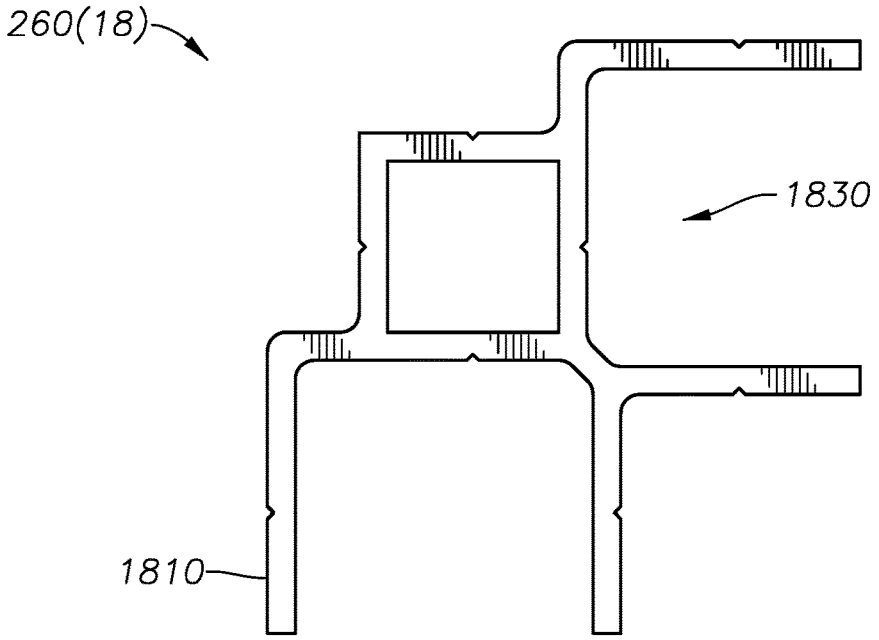
FIGS. 18B and 18C are opposing end views of the inside corner connector of FIG. 18A. This corner connector also utilizes stiffener legs.
Figure 18C:
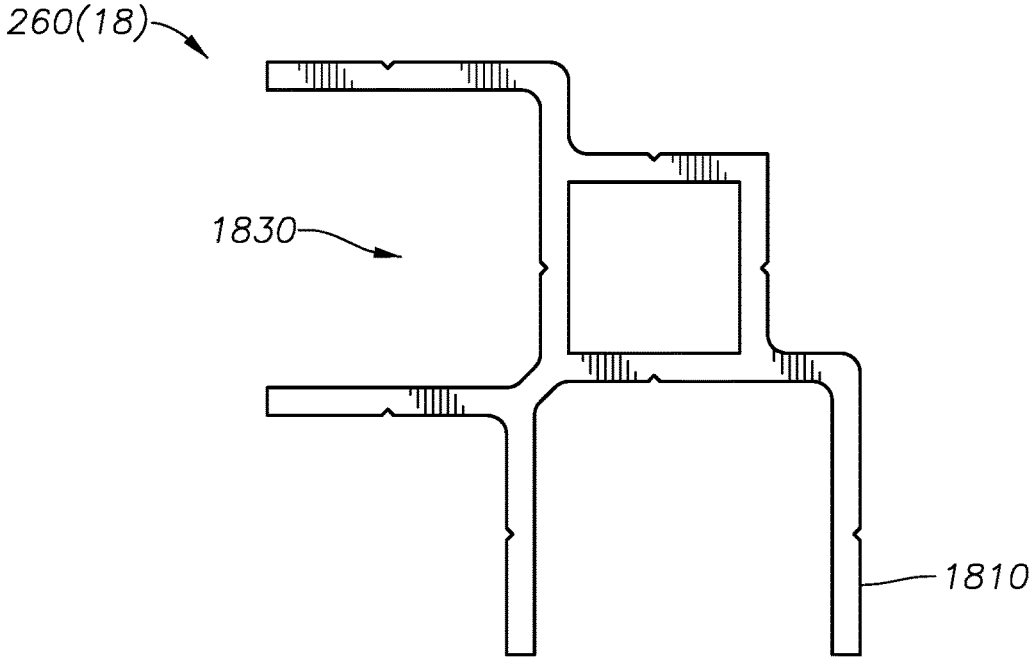

FIG. 18A is a perspective view of an inside corner connector 260(18). FIGS. 18B and 18C are opposing end views of the inside corner connector 260(18) of FIG. 18A. The designation "260(18)" refers to the embodiment shown in FIGS. 18A-18C in which inside corner connector 260(18) is configured to serve as an inside corner strip for an L-shaped jamb. The inside corner connector 260(18) defines an elongated body 1810 fabricated from a metal. However, in this arrangement the body 1810 does not include a recessed portion and is not used to receive a gasket or preserve a space for adhesive.

As with corner connector 260(16), each of corner connectors 260(17) and 260(18) includes at least one slot 1730 or 1830. The slots 1730, 1830 comprise parallel legs dimensioned and configured to receive stiffeners under ceramic tiles.

Figure 18D:
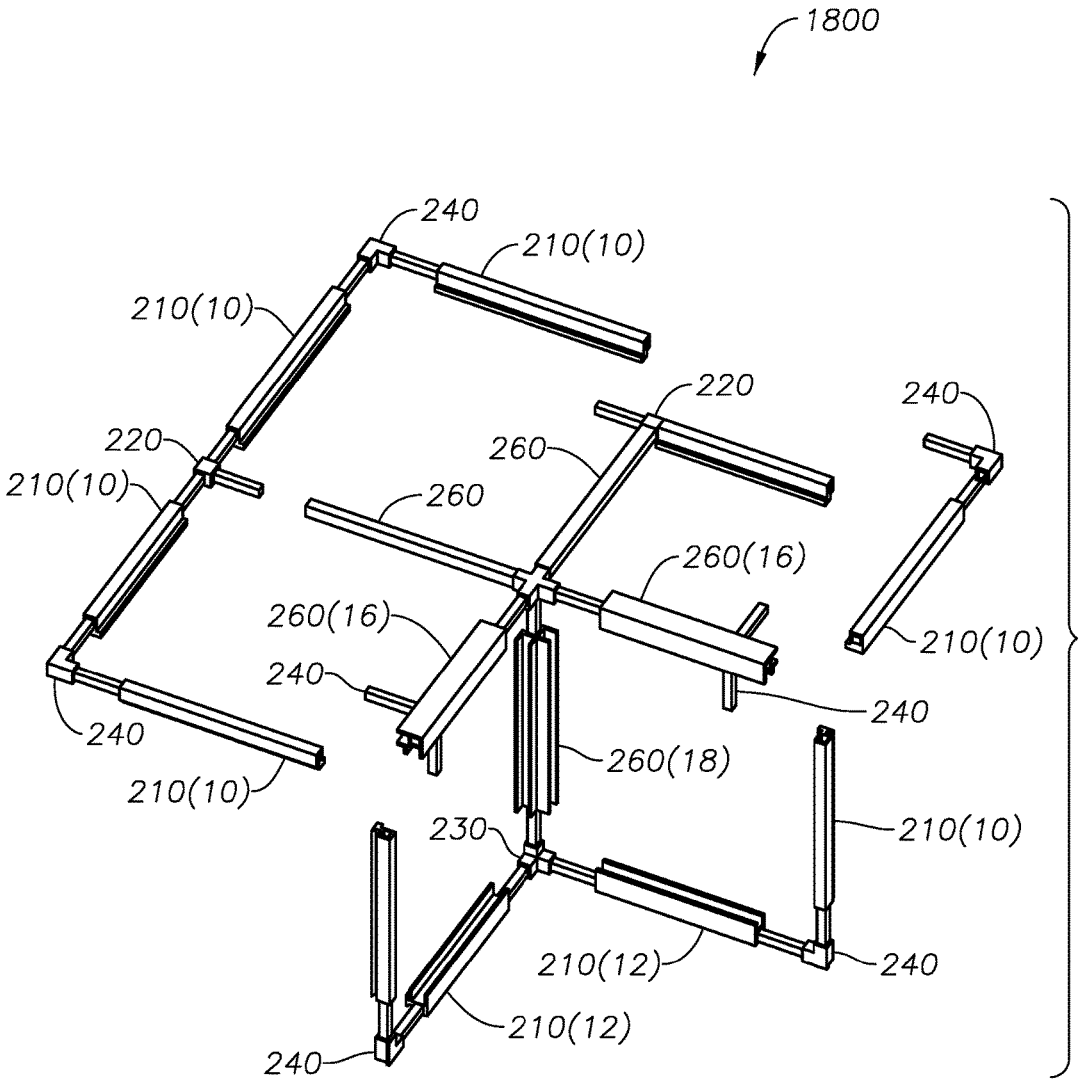
FIGS. 18D through 18F demonstrate use of the inside corner connector of FIGS. 18A through 18C.
Figure 18E:
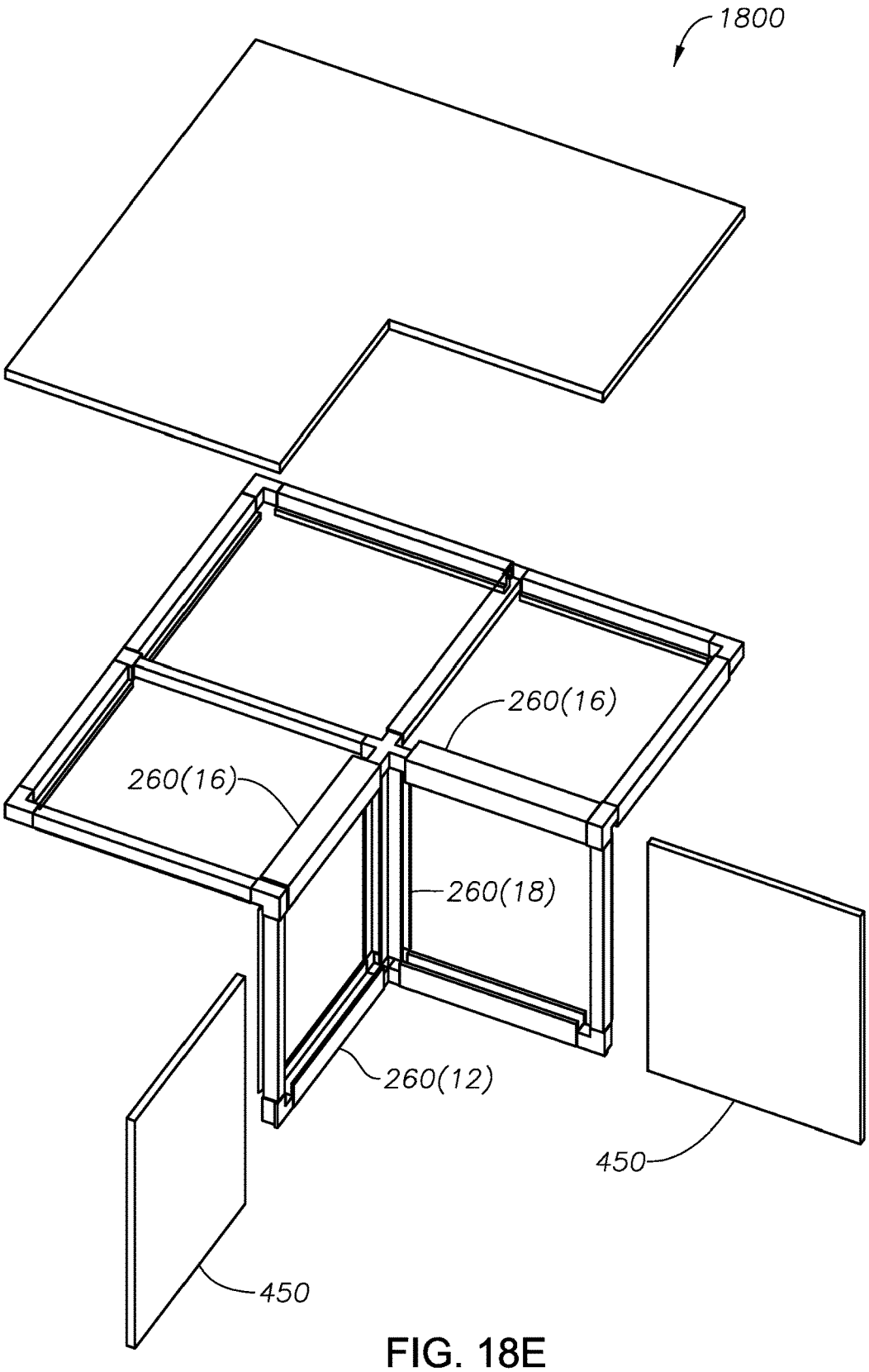
Figure 18F:
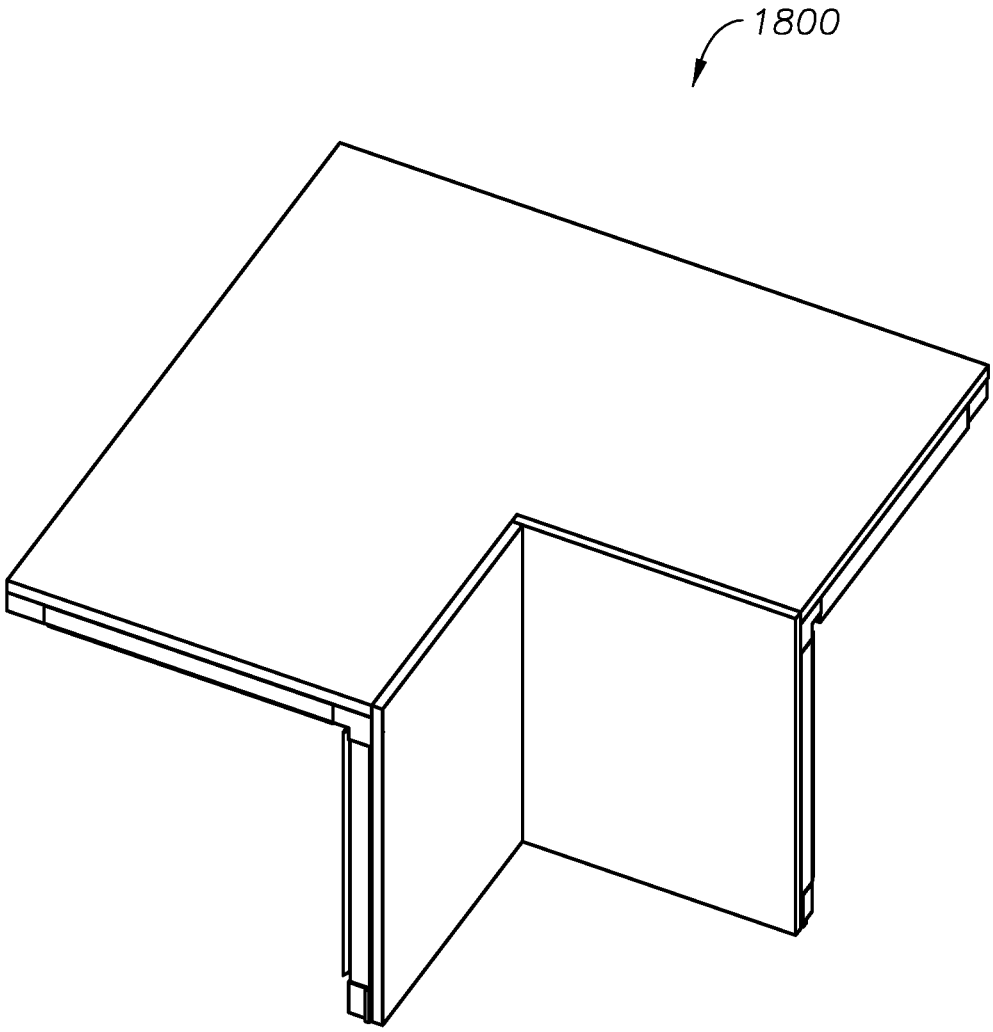

FIGS. 18D through 18F demonstrate the use of the inside corner connector 260(18) of FIGS. 18A through 18C. FIG. 18D is an exploded view of a three-dimensional structure 1800 using components of the wall panel system of the present invention 200, in one embodiment. An inside corner connector 260(18) is shown vertically between an orthogonal three-legged cube connector 230 and a four-legged cube connector 250.

Also visible in FIG. 18D are additional cube connectors. These include two-legged connectors 240, one planar three-legged connector 220, one orthogonal three-legged cube connector 230 and even one five-legged cube connector 2320. Also visible in FIG. 18D are panel perimeter strips 210 (without stiffener legs, which may be arranged according to strip 210(10)), panel perimeter strips 210 (with stiffener legs, which may be arranged according to strip 210(12)) and box connector 260 (which may be arranged according to connector 260(16)).

In FIG. 18E, the cube connectors and the linear extrusion members of the three-dimensional frame structure 1800 have been moved together to form a frame structure. In FIG. 18F, the three-dimensional frame structure 1800 has received rigid wall panels 450. In this example, the wall panels 450 may be porcelain ceramic tiles, non-porcelain ceramic tiles, natural stone tiles, synthetic rigid panels, and composite rigid panels and may have layers of glass, layers of rigid metal, and/or photovoltaic cell panels.

Figure 19A:
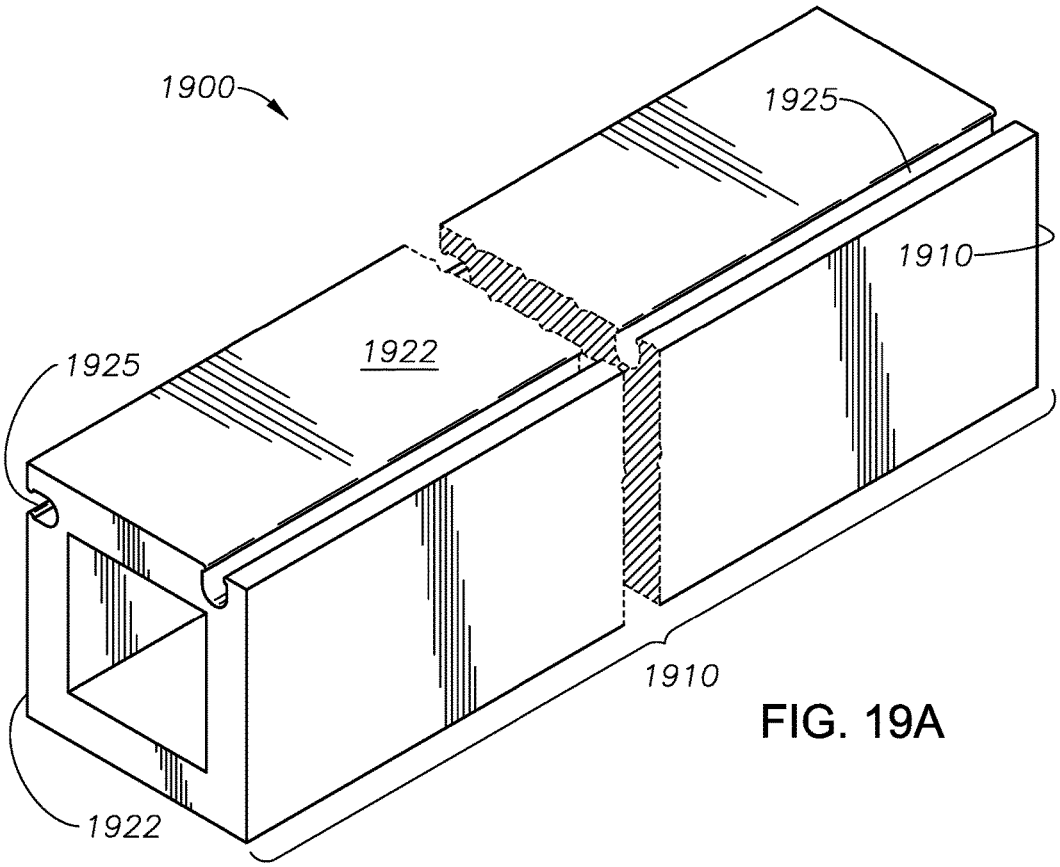
FIG. 19A is a perspective view of an outside corner connector that may be used as one of the components in FIG. 2.
Figure 19B:
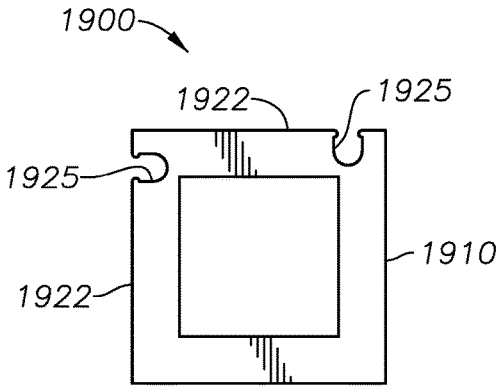
FIGS. 19B and 19C are opposing end views of the outside corner connector of FIG. 19A, which does not have stiffener legs.
Figure 19C:
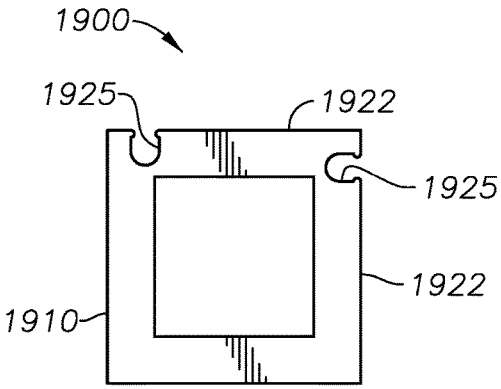

FIG. 19A is a perspective view of an outside corner connector 1900 in one embodiment. FIGS. 19B and 19C are opposing end views of the outside corner connector 1900 of FIG. 19A. No panel stiffener legs are used in this extrusion.

Figure 20A:
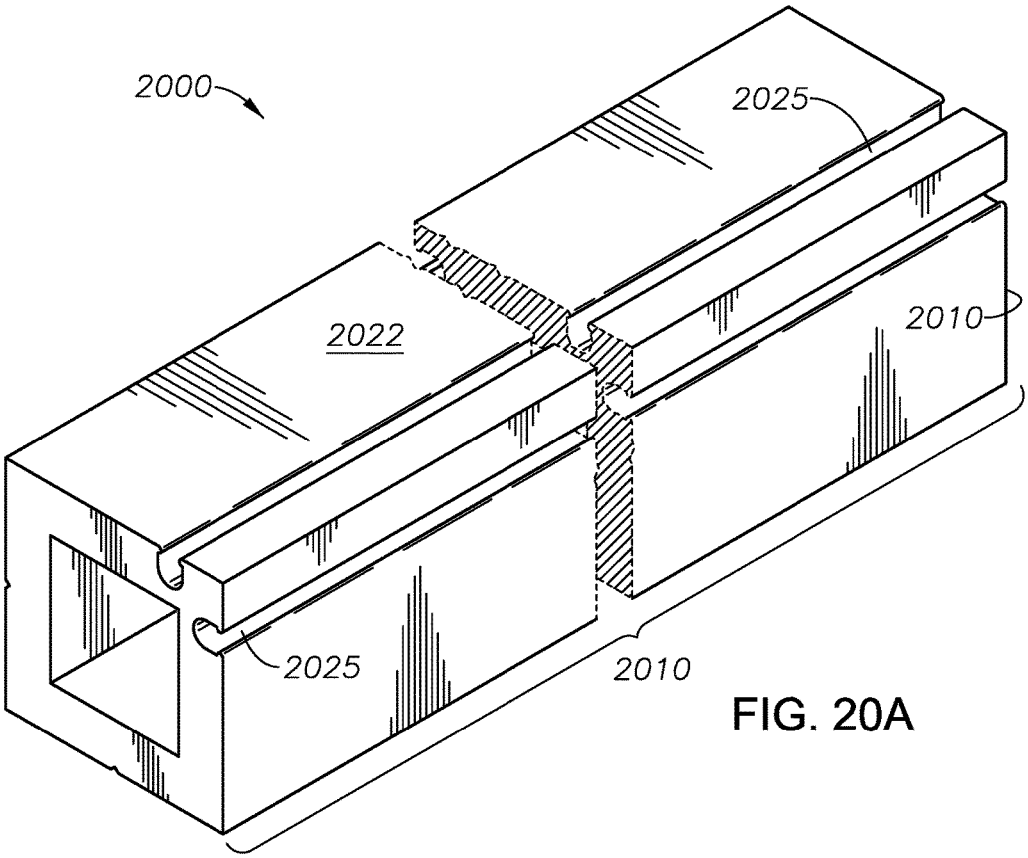
FIG. 20A is a perspective view of an outside corner connector that may be used as one of the components in FIG. 2, in another alternate embodiment.
Figure 20B:
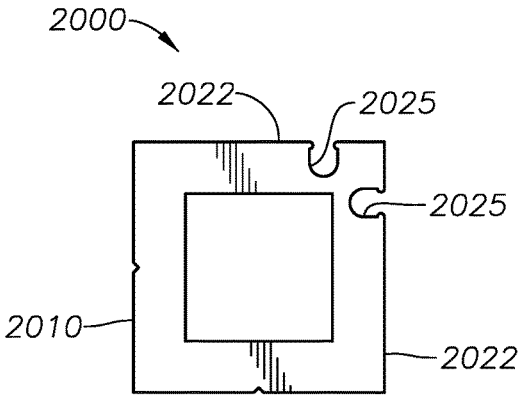
FIGS. 20B and 20C are opposing end views of the outside corner connector of FIG. 20A.
Figure 20C:
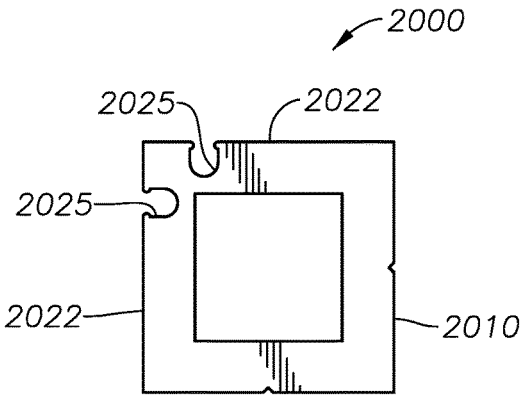

FIG. 20A is a perspective view of another embodiment of an outside corner connector 2000. FIGS. 20B and 20C are opposing end views of the outside corner connector 2000 of FIG. 20A. Again, no panel stiffener legs are used for this extrusion.

Each of the outside corner connectors 1900 and 2000 (without stiffener legs) defines an elongated body 1910, 2010. The bodies 1910, 2010 are fabricated from a metal, and preferably from aluminum. Each of the bodies 1910, 2010 includes an outward-facing surface 2022, 2122, wherein the outward-facing surface 1922, 2022 presents a recessed portion 1925, 2025. The recessed portions 1925, 2025 are configured to receive an elongated spacing element, such as gasket strip 430 or 730.

Of interest, for each of the outside corner connectors 1900, 2000 a recessed portion 2125 is actually placed on two different sides, or faces of the body 1910, 2010. This is of benefit when the corners 1900, 2000 are being placed beneath two wall panels 450 that meet at a corner. In this instance, the corner would be an outside corner.

As noted numerous times above, the three-dimensional structure 200 may take advantage of panel stiffeners to support the rigid wall panels 450 or 750. FIG. 21A is a perspective view of a panel stiffener 2100 that may be used as one of the components in FIG. 2, in one embodiment. FIGS. 21B and 21C are opposing end views of the panel stiffener 2100 of FIG. 21A.

The panel stiffener 2100 defines an elongated body 2110. The body 2110 is fabricated from a metal, and preferably from aluminum. The body 2110 includes an outward-facing surface 2122, wherein the outward-facing surface 2122 presents a recessed portion 2125. As with recessed portions 325, 425, 525, 625, 725, 825 and 925, recessed portion 2125 is configured to receive an elongated spacing element, such as gasket strip 430 or 730. The adhesive adheres to the surfaces of 2122 and to the back side of a rigid wall panel, such as the PCT panel 450. Thus, the panel stiffener 2100 may also be used to adhesively receive and support a rigid panel 450 or 750.

It is noted here that all recessed portions 325, 425, 525, 625, 725, 825, 925, 1025 for cube connectors will have the same dimension. In addition, all recessed portions 1025, 1125, 1225, 1325, 1425, 1525 for linear extrusions having receiving members will have the same dimension. Further, all recessed portions 1625, 1725, 1825, 1925, 2025 for linear extrusions that are box connectors will preferably have the same dimension. Also, the gaskets as indicated at 430 or 730 are dimensionally the same. The gaskets fit into any of the recessed portions listed above, as well as recessed portion 2125 of the panel stiffener 2100.

Additional components may be used in the three-dimensional framing structure 200 of FIG. 2 which are not shown. Specifically, additional cube connectors having multiple legs may be employed. These include, for example, a planar four-legged cube connector and a five-legged cube connector. These optional connectors are shown in FIGS. 22 and 23.

Figure 22:
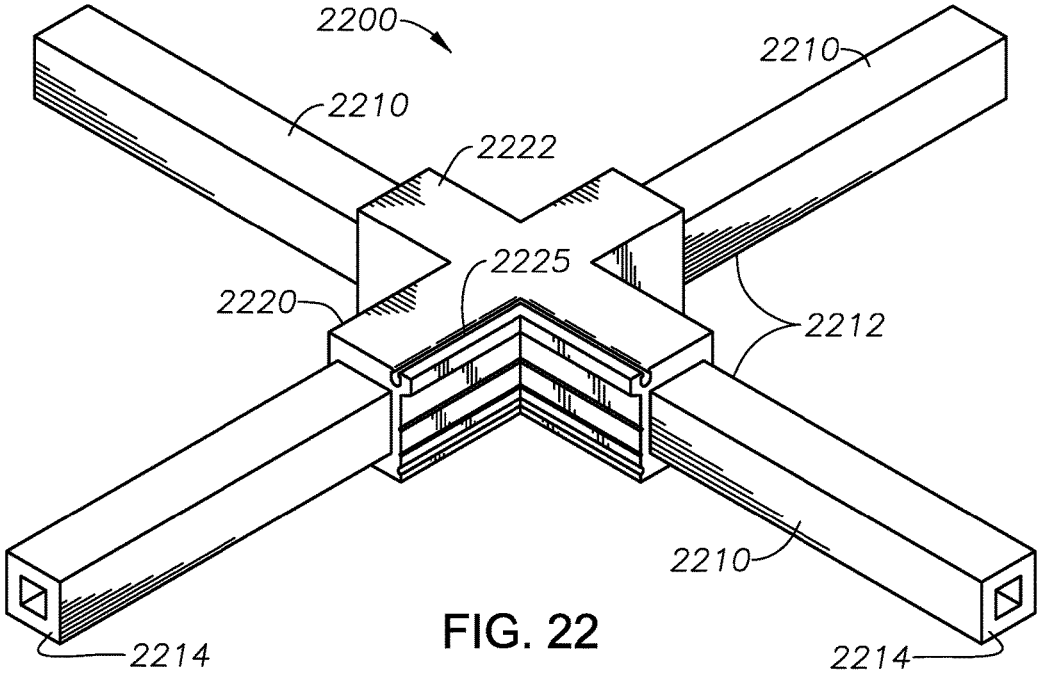
FIG. 22 is a perspective view of a four-way cube connector that may be used as one of the components in the three-dimensional structure of FIG. 2, in one embodiment.
Figure 23:
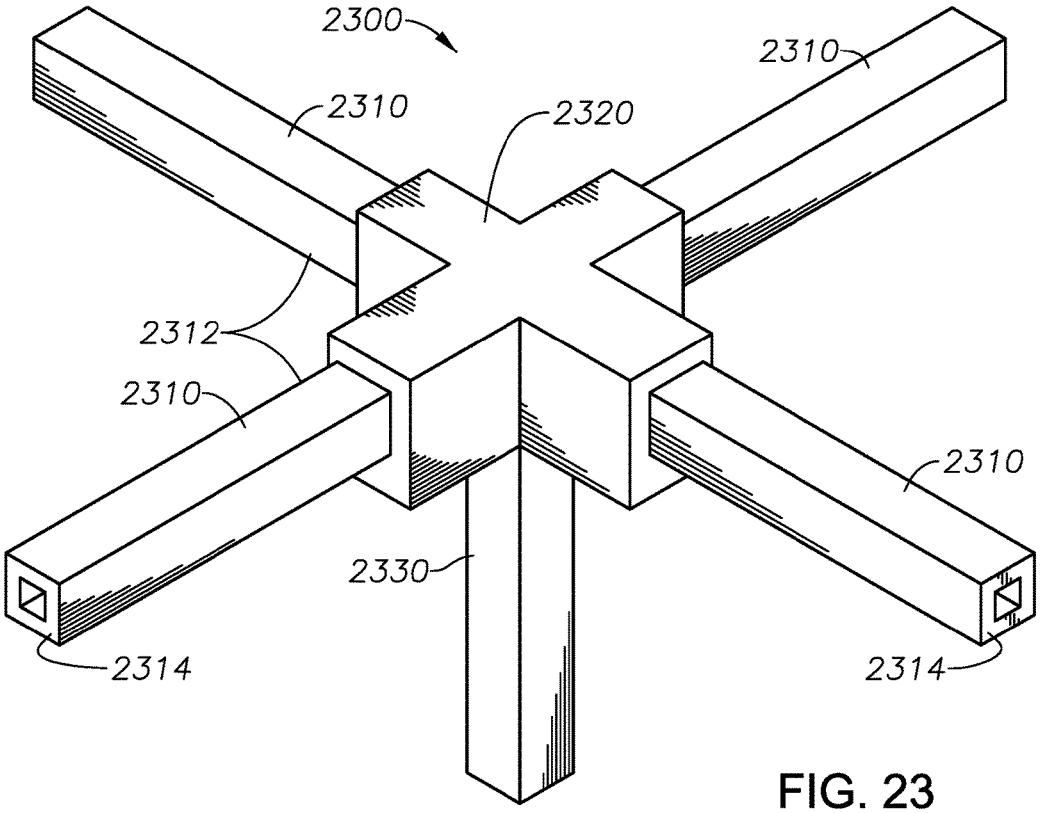
FIG. 23 is a perspective view of a five-way cube connector that may be used as one of the components in FIG. 2, in one embodiment.

FIG. 22 is a perspective view of a four-way cube connector 2200. This is a planar four-way cube connector, to be distinguished from the orthogonal four-way cube connector 250 shown in FIG. 2 and in FIGS. 9A and 9B. Thus, the cube connector 2200 presents legs in an x-y orthogonal relation.

FIG. 22 shows four legs 2210 that extend out from a cube 2220 to form a planar array. Each leg 2210 has a proximal end 2212 and a distal end 2214. Each leg 2210 preferably forms a four-sided polygon, though other geometries may be used. Preferably, each leg 2210 serves as a male component that is slidably received within an end of a linear extrusion member, such as the panel perimeter strip (without stiffener legs) 210(11) or the panel perimeter strip (with stiffener legs) 260(16).

The planar four-legged cube connector 2200 is beneficial in forming a three-dimensional framing structure that includes an unusually large surface area. An example is a surface area having a length or having a width in excess of 8 feet. Rather than using extremely long linear extrusion members which may experience fatigue, the contractor may connect standard-length linear extrusion members 210 or 260 using the planar four-legged cube connector of FIG. 22.

FIG. 23 is a perspective view of a five-legged cube connector 2300. This five-legged cube connector 2300 has four separate legs 2310 making up a planar four-way cube connector with an additional connector leg 2330 that extends out orthogonally from a cube member 2320. The connector leg 2330 extends in a centrally downward direction. Thus, the cube connector 2300 presents five legs 2310 and 2330 in an x-y-z orthogonal relation.

Each leg 2310 has a proximal end 2312 and a distal end 2314. The cube member 2320 has an outward-facing surface 2322.

FIGS. 24A through 25E demonstrate several examples of three-dimensional structures that may be formed using the cube connectors, linear extrusion members and panel stiffener described above.

Figure 24B:
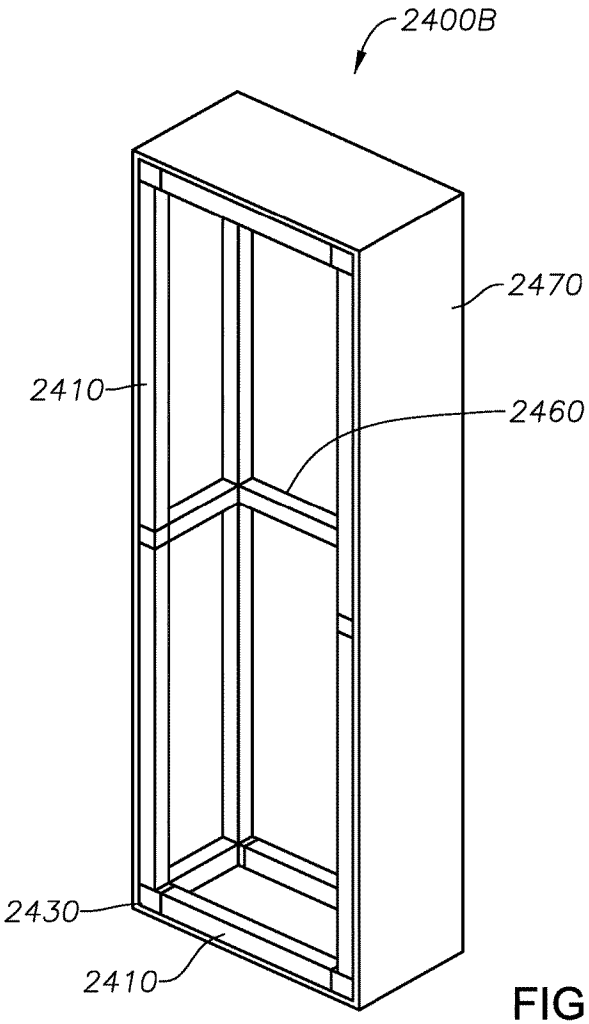
FIG. 24B is another perspective view of the three-dimensional structure of FIG. 24A. Here, ceramic panels have been adhered to panel perimeter strips.
Figure 24A:
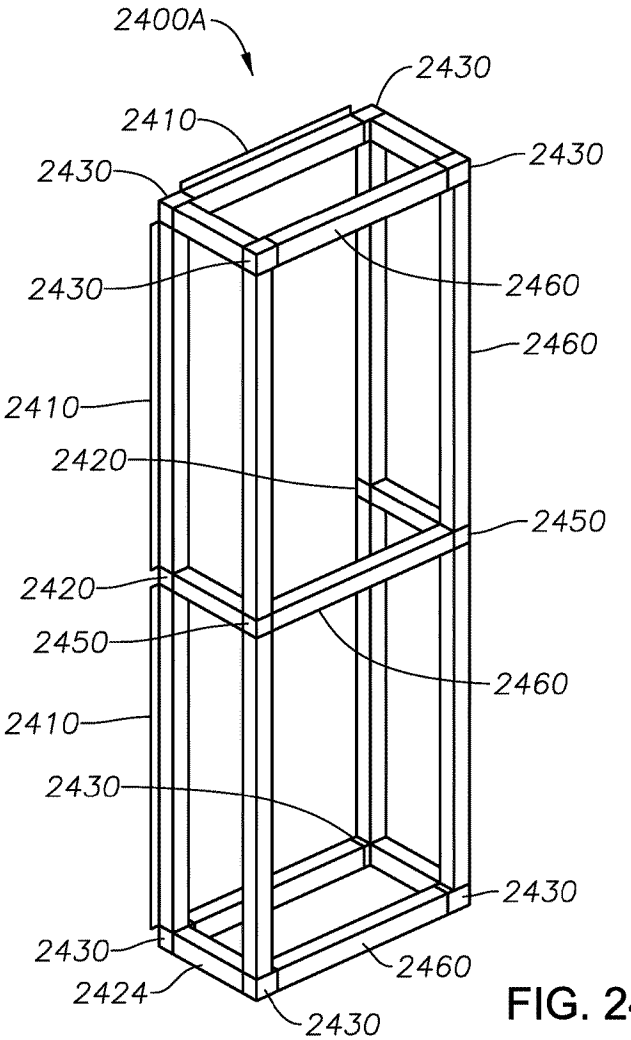
FIG. 24A is a perspective view of a three-dimensional structure formed using selected components for a wall panel system, according to a method of the present invention.

FIG. 24A is a perspective view of a three-dimensional structure 2400A formed using selected components for a wall panel system, according to a method of the present invention. FIG. 24A shows four-legged cube connectors 2450. Each four-legged cube connector 2450 has four legs that form an orthogonal x-y-z coordinate in accordance with four-legged cube connector 250 described above.

FIG. 24A also shows orthogonal three-legged cube connectors 2430. Each three-legged cube connector 2430 has three legs that form an orthogonal x-y-z coordinate in accordance with three-legged cube connector 230 described above.

FIG. 24A also shows tee cube connectors (also described as a planar three-legged cube connectors) 2420. Each tee cube connector 2420 has three legs that form an x-y plane in accordance with three-legged cube connector 220 described above.

FIG. 24A also has a plurality of panel perimeter strips 2410. The perimeter strips 2410 are in accordance with perimeter strips 210 described above. Finally, the three-dimensional structure 2400A of FIG. 24A shows outside corners (without stiffener legs) 2460. The panel perimeter strips 2460 are in accordance with panel perimeter strips 260 described above. The perimeter strips 2410 and the box connectors 2640 matingly connect with the various cube connectors 2450, 2430, 2420 in a manner already described above.

FIG. 24B is another perspective view of the three-dimensional structure 2400A of FIG. 24A. Here, ceramic panels (including tile 2470) have been adhered to perimeter strips 2410 and box connectors 2460, forming structure 2400B. In this way, an exterior surface is formed that is both functional and highly aesthetic. It is understood that one or more of the cube connectors and perimeter strips may include recessed slots for receiving spacers (such as gasket 430) that in turn function to secure a panel to the three-dimensional frame 2400A in a manner already described above.

Figure 24C:
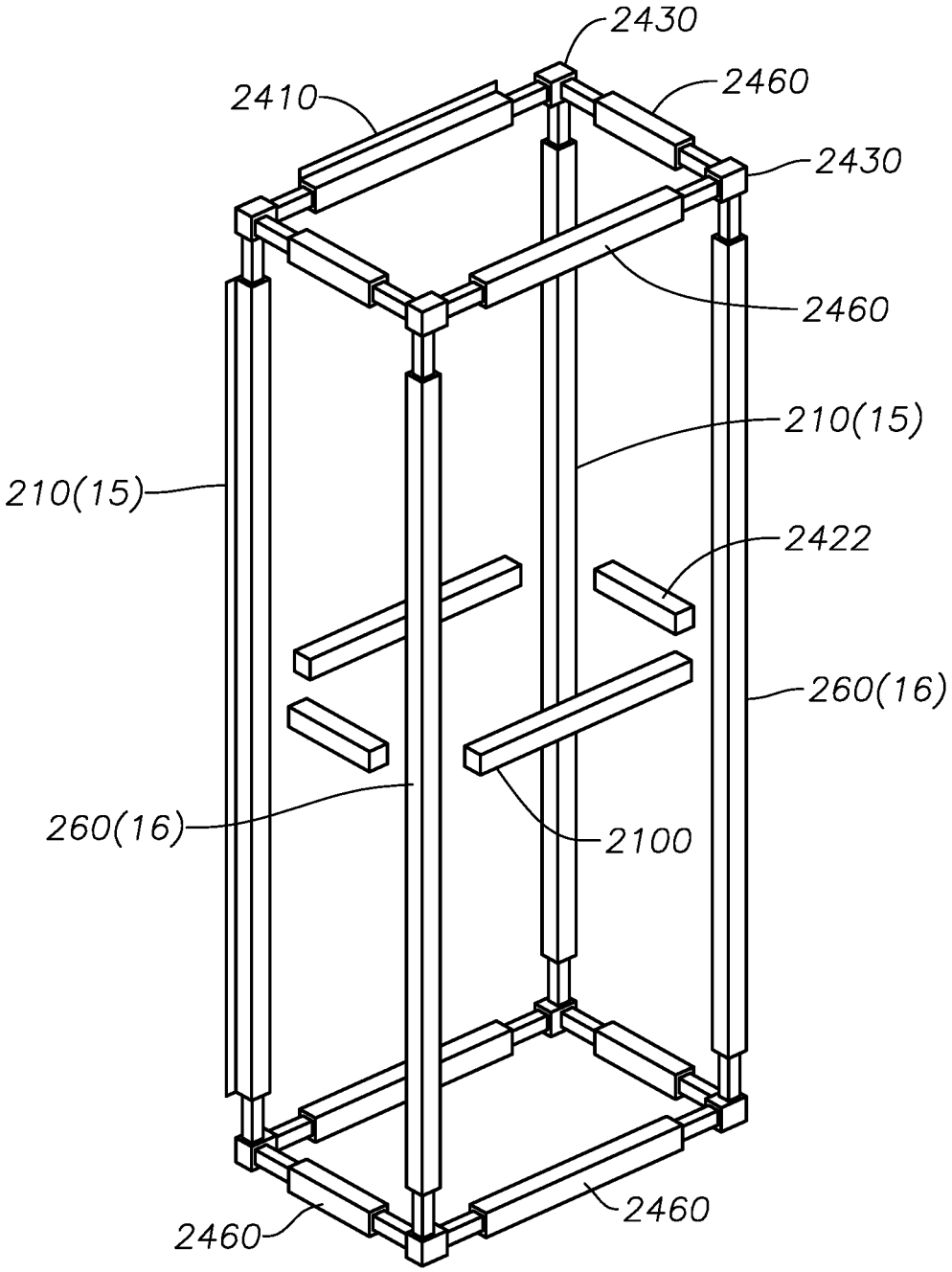
FIG. 24C is an exploded view of the three-dimensional structure of FIG. 24A, modified to use panel stiffeners.

FIG. 24C is an exploded view of the three-dimensional structure 2400A of FIG. 24A. However, the embodiment 2400C of FIG. 24C uses panel stiffeners 2100 added to the wall panel system. One or more of the panel stiffeners 2100 may include recessed slots for receiving spacers that in turn function to secure a rigid panel to the three-dimensional structure 2400C in a manner already described above. In this view 2400C, perimeter strip 2410 may be in accordance with the inside corner strip 210(15) with PCT return and stiffener legs shown in FIGS. 15A-15C. The outer box connectors 2460 will be in accordance with the outside box connectors 260(16) of FIG. 16A, or could be either of outside box connectors 1900 or 2000. A stiffener like 2100 can be used but bigger to fit the slot 1630.

Figure 24E:
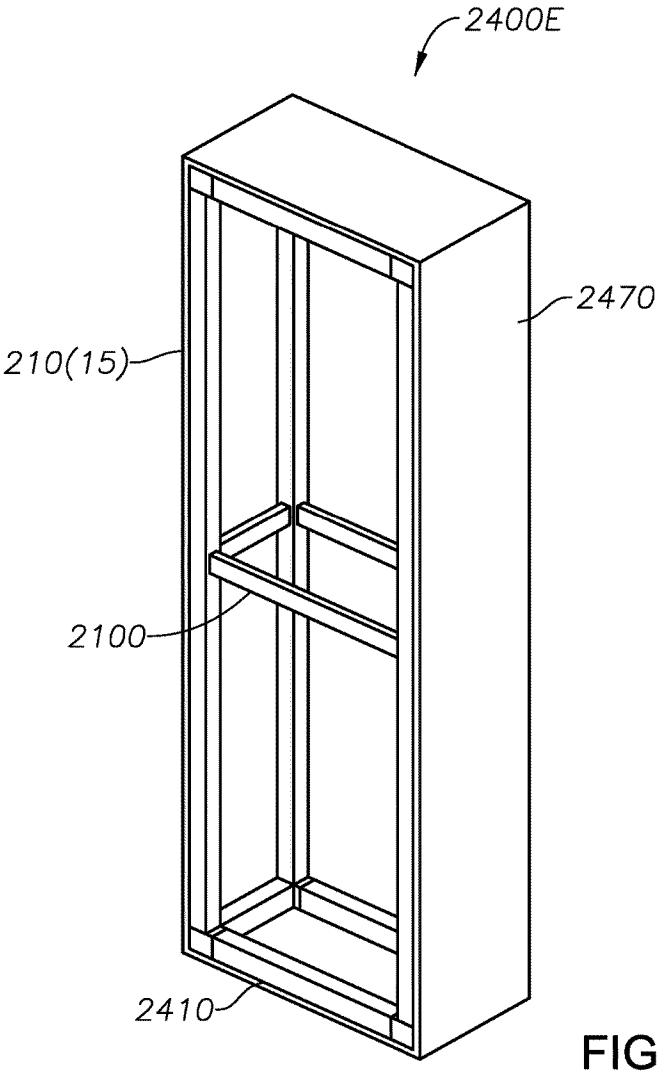
FIG. 24E is another perspective view of the three-dimensional structure of FIG. 24C. Here, ceramic panels have been adhered to perimeter strips.
Figure 24D:
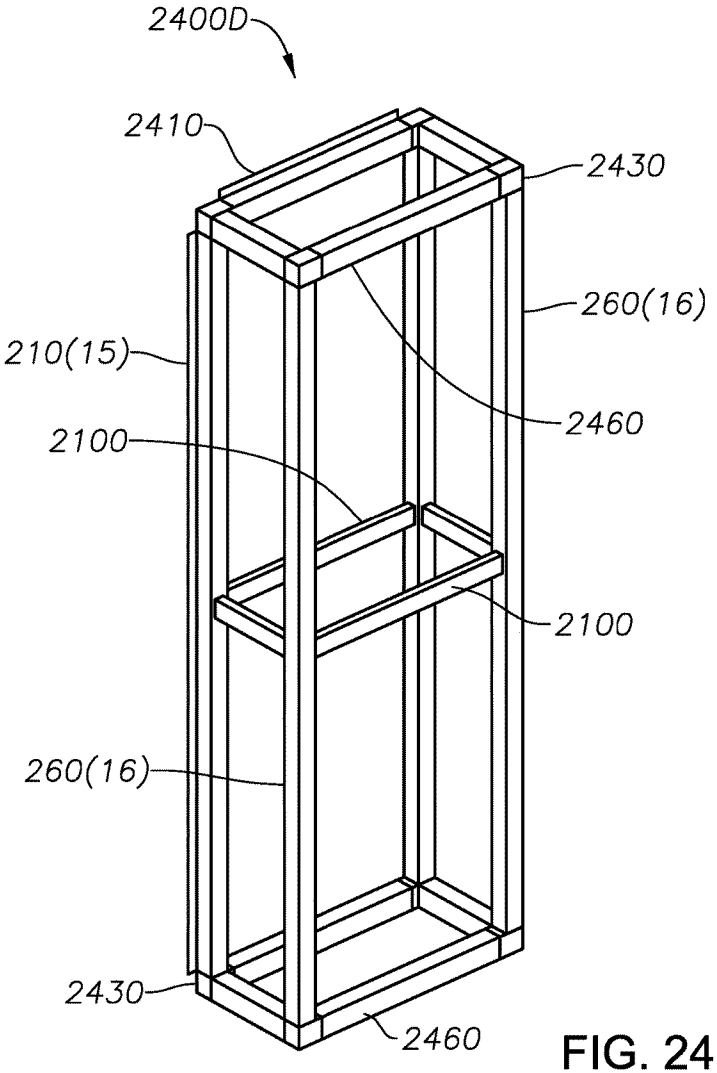
FIG. 24D is a perspective view of the three-dimensional structure of FIG. 24C, using panel stiffeners.

FIG. 24D is a perspective view 2400D of the three-dimensional structure of FIG. 24C, showing the components of the frame put together, but without the rigid wall panels. FIG. 24E is another perspective view 2400E of the three-dimensional structure 2400C of FIG. 24C. In this step, ceramic panels (including tile 2470) have been adhered to the perimeter strips 2410, 210(15), the box connectors 260(16), 2460 and the panel stiffeners 2100.

Figure 25A:
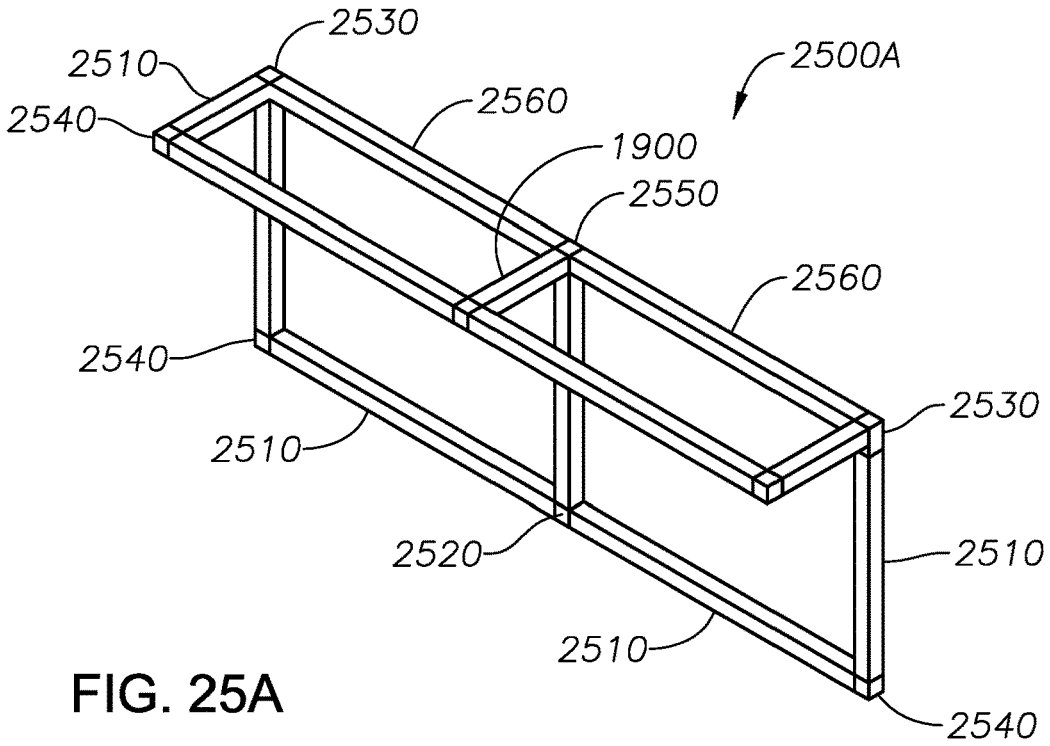
FIG. 25A is a perspective view of a three-dimensional structure formed using selected components for a wall panel system, according to a method of the present invention.

FIG. 25A is a perspective view of another three-dimensional structure 2500A formed using selected components for a wall panel system, according to a method of the present invention. FIG. 25A shows use of various cube connectors and perimeter strips to form the three-dimensional structure 2500A. For example, FIG. 25A shows a four-legged cube connector 2550. The four-legged cube connector 2550 has four legs that form an orthogonal x-y-z coordinate in accordance with four-legged cube connector 250 described above.

FIG. 25A also shows orthogonal three-legged cube connectors 2530. Each three-legged cube connector 2530 has three legs that form an orthogonal x-y-z coordinate in accordance with three-legged cube connector 230 described above.

FIG. 25A also shows planar three-legged cube connectors 2520. Each three-legged cube connector 2520 has three legs that form an x-y plane in accordance with three-legged cube connector 220 described above.

FIG. 25A also shows two-legged cube connectors 2540. Each two-legged cube connector 2540 has two legs that form a plane in accordance with two-legged cube connector 240 described above.

FIG. 25A also has a plurality of panel perimeter strips 2510. These may be, for example, outside corner connectors 1900 or 2000. Finally, the three-dimensional structure 2500A of FIG. 24A shows perimeter strip 2560. The panel perimeter strips 2560 may be in accordance with panel perimeter strips 260(10) or 260(11) (without stiffeners) described above. The perimeter strips (with receiving members) 2510 and the perimeter strips (without receiving members) 2560 telescopically connect with the various cube connectors 2550, 2530, 2540, 2520 in a manner already described above.

Figure 25B:
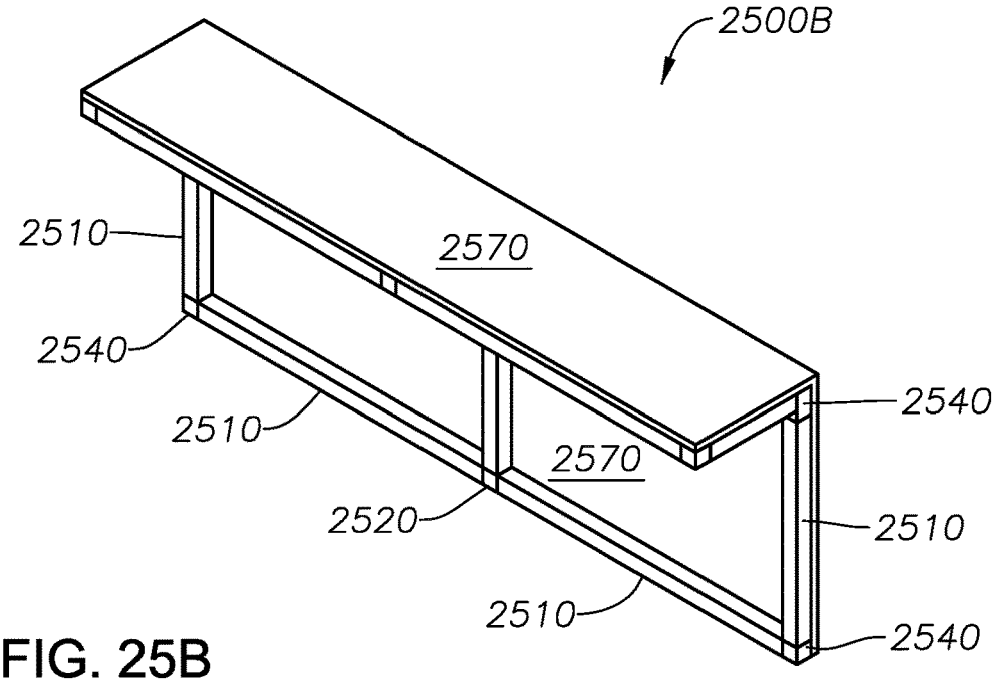
FIG. 25B is another perspective view of the three-dimensional structure of FIG. 25A. Here, ceramic panels have been adhered to perimeter strips.

FIG. 25B is another perspective view of the three-dimensional structure of FIG. 25A, indicated at 2500B. Here, ceramic panels (including tile 2570) have been adhered to the perimeter strips 2510, 2560. In this way an exterior surface is formed that is both highly aesthetic. It is understood that one or more of the cube connectors and perimeter strips may include recessed slots for receiving spacers (such as gasket 430) that in turn function to secure a tile panel to the three-dimensional structure in a manner already described above.

Figure 25C:
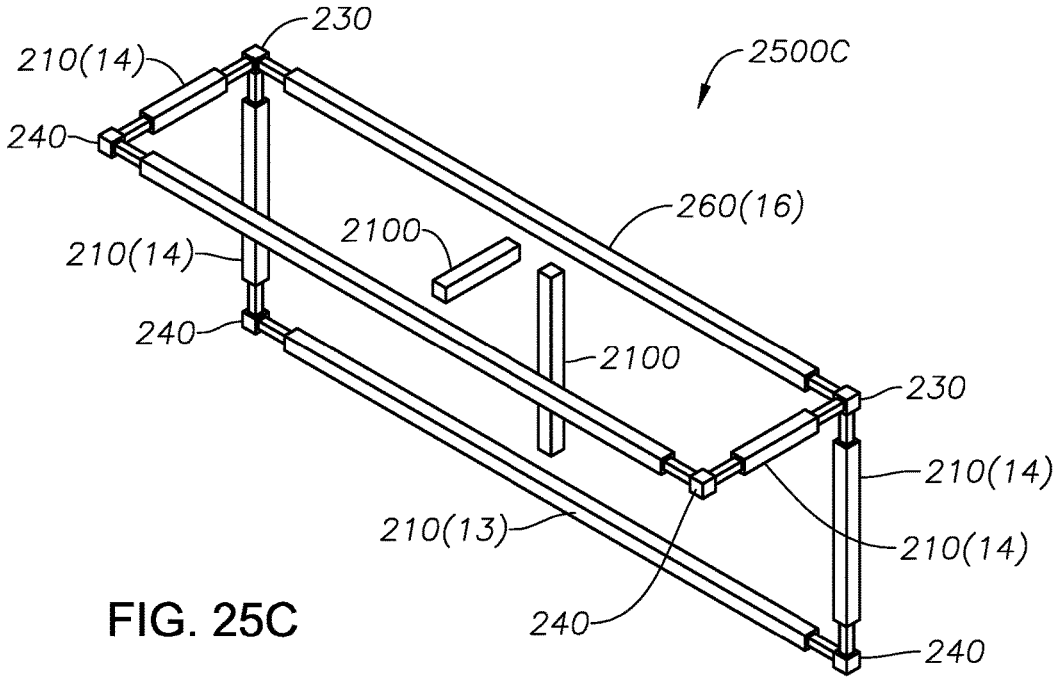
FIG. 25C is an exploded view of the three-dimensional structure of FIG. 25A, modified to use panel stiffeners.

FIG. 25C is an exploded view of the three-dimensional structure of FIG. 25A in a modified form. Here, the embodiment of FIG. 25C includes panel stiffeners 2100 added to a wall panel system 2500C. The panel stiffeners 2500C may include recessed slots for receiving spacers that in turn function to secure a rigid wall panel 2570 to the three-dimensional structure 2500C in a manner already described above. In this view, some perimeter strips 2510 may be in accordance with perimeter strip 210(13) (with stiffener legs) shown in FIGS. 13A-13C (or perimeter strip 210(12) (with stiffener legs) shown in FIGS. 12A-12C. Other perimeter strips 2510 may be in accordance with perimeter strip 210(14) (without stiffener legs) shown in FIGS. 14A-14C.

Corner connector 2560 may be in accordance with outside corner connector 260(16)—two pairs of stiffener legs but no receiving member. Alternatively, outside corner connector 260(17) may be used.

Figure 25D:
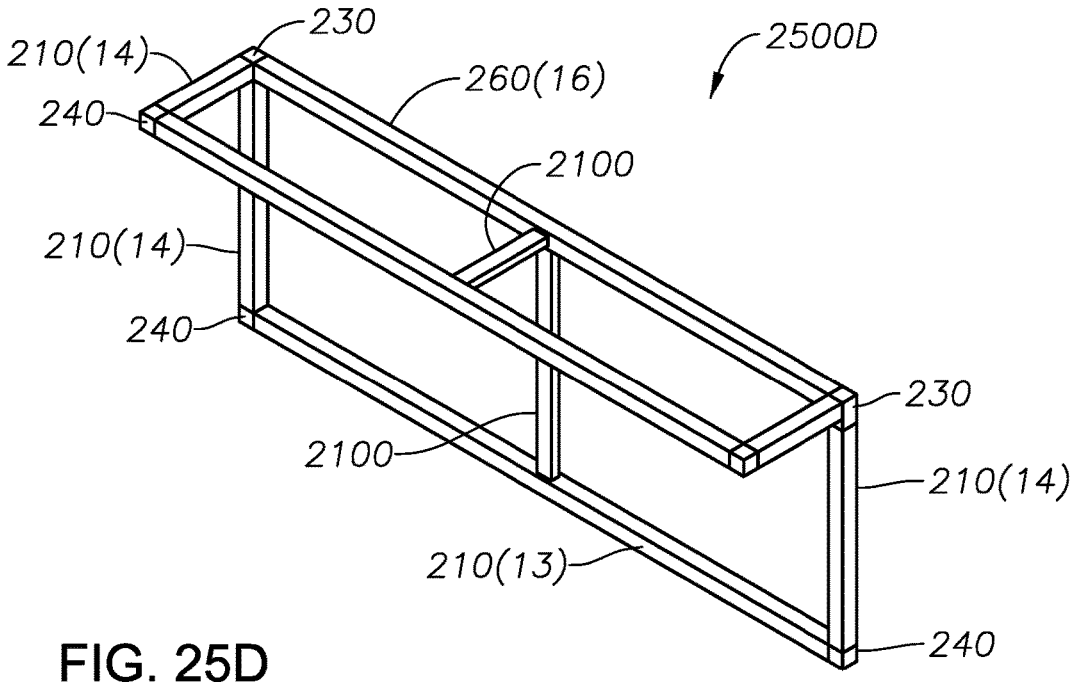
FIG. 25D is a perspective view of the three-dimensional structure of FIG. 25C, using the panel stiffeners.
Figure 25E:
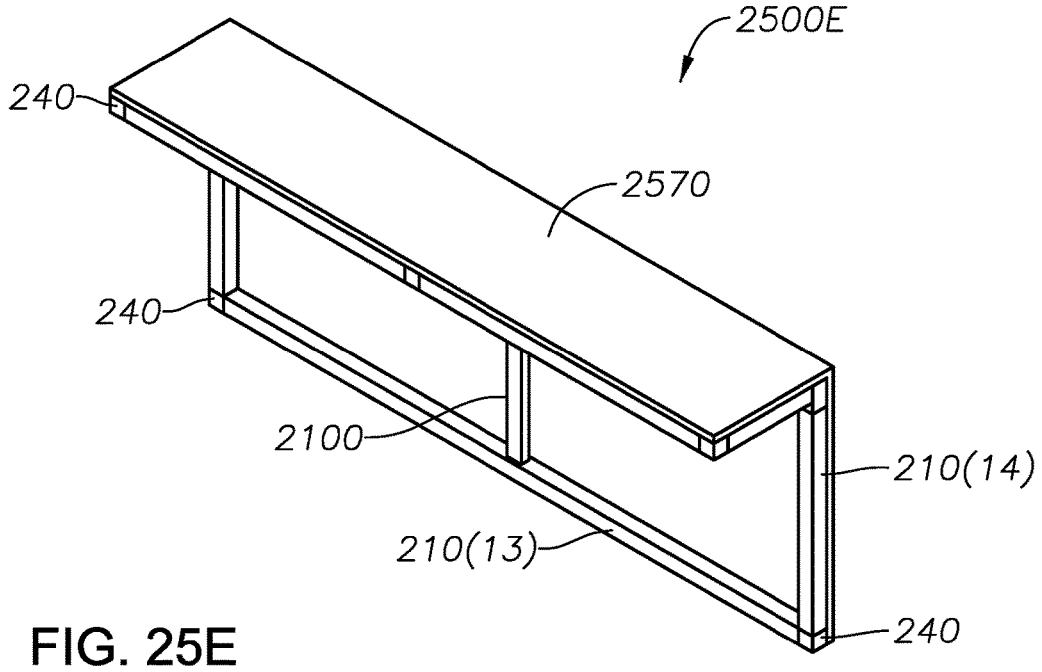
FIG. 25E is another perspective view of the three-dimensional structure of FIG. 25C. Here, ceramic panels have been adhered to perimeter strips.

FIG. 25D is a perspective view of the three-dimensional structure of FIG. 25C, showing panel stiffeners. In this view, the three-dimensional structure 2500D has been put together. FIG. 25E is another perspective view of the three-dimensional structure 2500C of FIG. 25C. Here, ceramic panels (including tile 2570) have been adhered to perimeter strips to form a final frame structure 2500E.

Figure 26A:
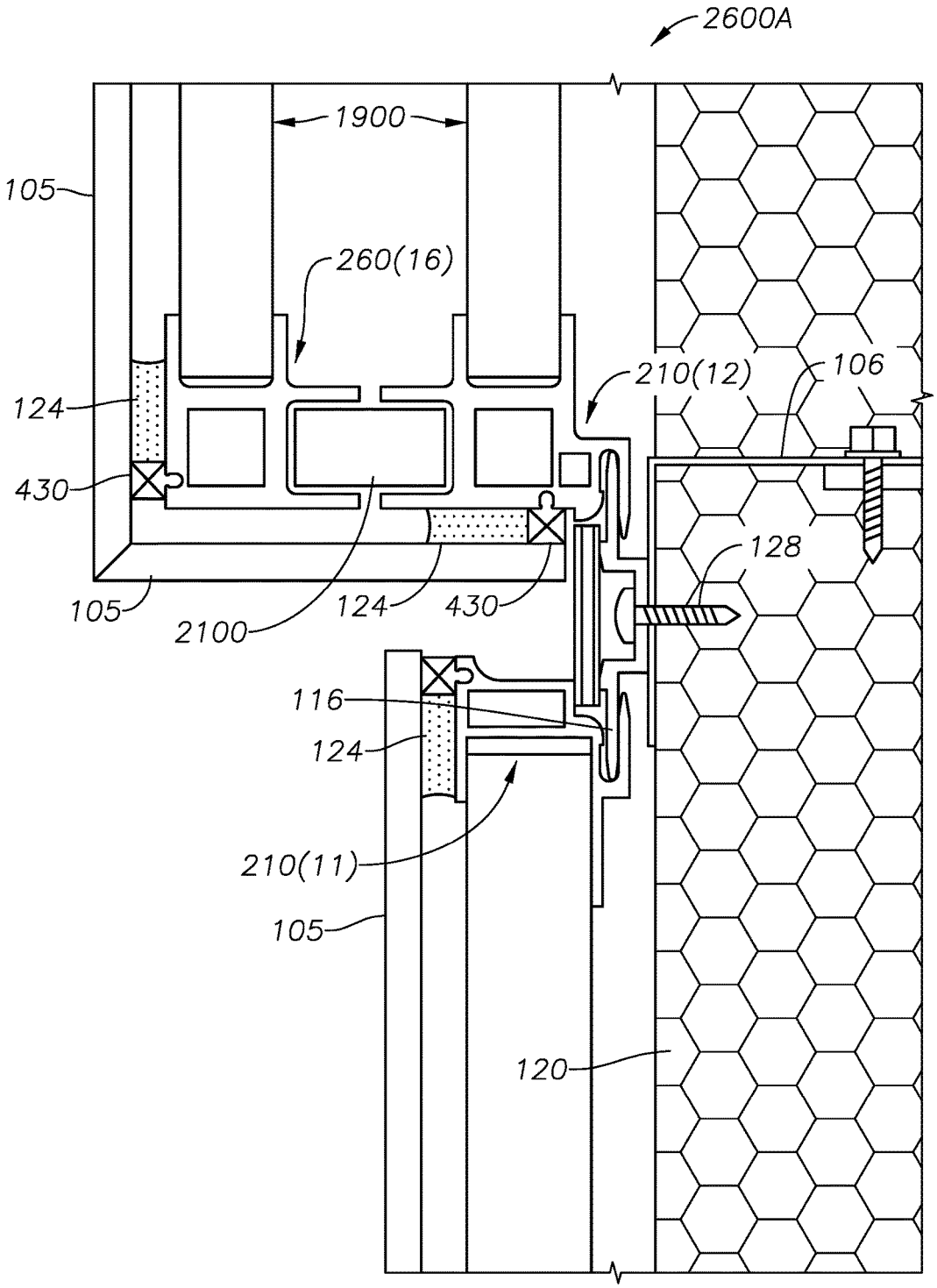
FIG. 26A is a cross-sectional view of a wall panel attachment system as may be formed using the methods of the present invention, wherein ceramic panels are placed side-by-side, but are offset from one another in height. Note that the new three-dimensional system offered herein can be seamlessly tied together with an existing two-dimensional panel on one attachment platform.

FIG. 26A is a cross-sectional view of a wall panel attachment system 2600A as may be formed using the methods of the present invention, wherein ceramic panels 105 are placed side-by-side, but are offset from one another in height. FIG. 26A first shows a first perimeter strip 210(11). The first perimeter strip 210(11) connects together with other perimeter strips 210(11) using a key, such as key 2900 of FIGS. 29A and 29B. The perimeter strip 210(11) is secured to a wall 120 using an attachment clip 116, which connects to a bracket assembly 106 by a fastener screw 128. In this way, the strip 210(11) is secured to the wall 120.

Opposite the first perimeter strip 210(11) is a second perimeter strip 210(12). The second perimeter strip 210(12) has also engaged a wing member of the attachment clip 116. In this way, the attachment clip 116 is supporting the dead load of both perimeter strips 210(11), 210(12) and their connected panels 105.

FIG. 26A also shows an example of a ceramic tile 105 attached to a perimeter strip 260(16). The perimeter strip 260(16) adhesively supports a separate ceramic tile 105 placed at a right angle with the panel along the perimeter strip 210(12).

The panel connections are made using an adhesive 124 such as structural silicone In the embodiment shown in FIG. 26A, adhesive 124 is squeezed into the gap formed between the panel perimeter strip 260(16) and a rear surface of the adjacent tile panel 105, and between the attachment clips 210(11), 210(12) and a rear surface of the adjacent tile panels 105 as the case may be. The gaps are formed through the use of spacer elements 430.

Also visible in FIG. 26A are two panel stiffeners 2100. The panel stiffeners 2100 have been slid into openings along the outside corner strips 260(16) and the perimeter strip 210(12).

Figure 26B:
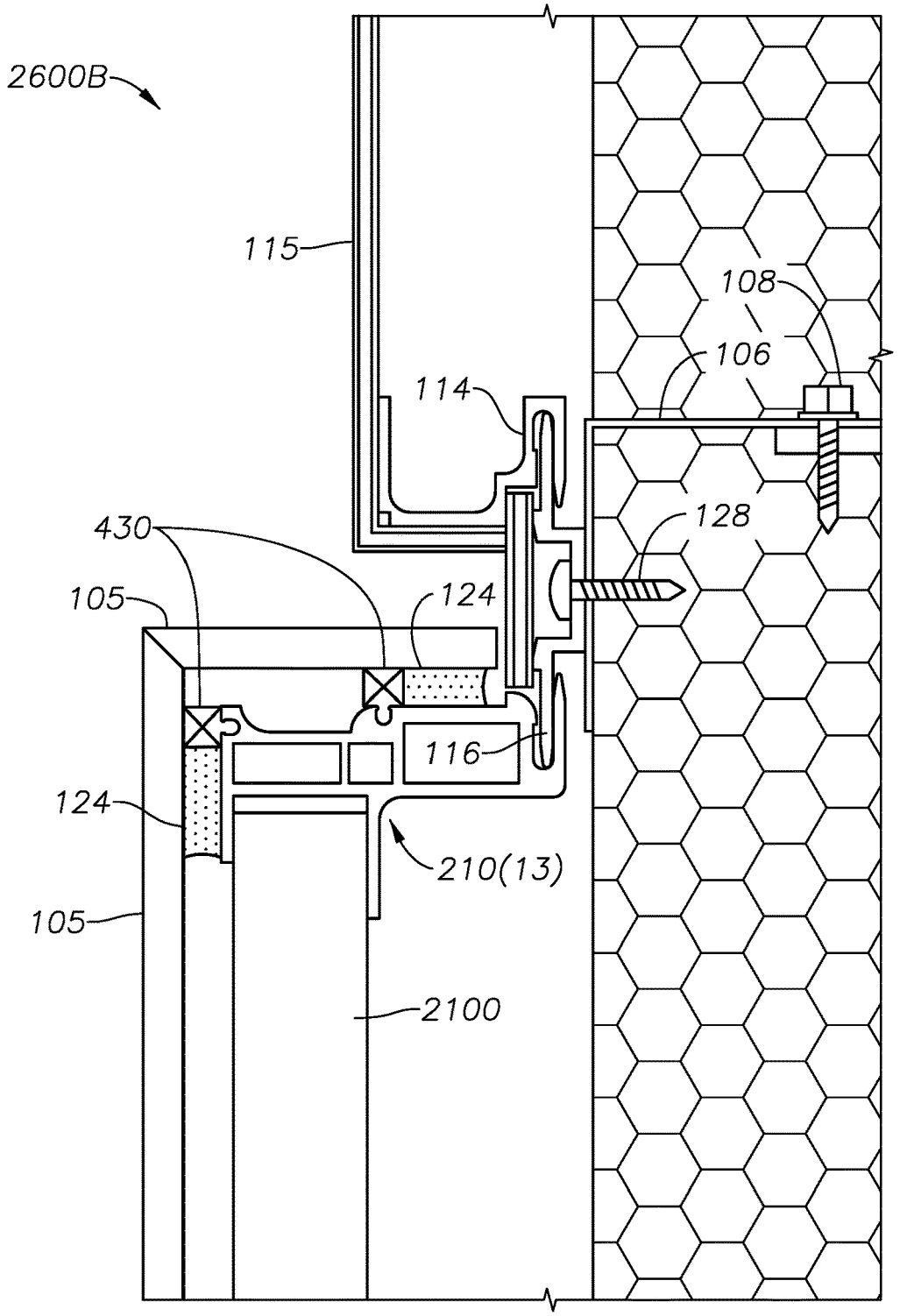
FIG. 26B is a cross-sectional view of a wall panel attachment system as may be formed using the methods of the present invention, wherein a ceramic tile is placed side-by-side and offset from an ACM panel. This demonstrates that the attachment system can join ACM panels together with porcelain ceramic panels, and also other veneer types.

FIG. 26B is a cross-sectional view of a wall panel attachment system 2600B as may be formed using the methods of the present invention. In the system 2600B, a panel perimeter clip 114 is used to support an ACM panel 115 on one side of the attachment clip.

On the other side of the attachment clip is a panel perimeter strip 210(13). This is a modified, "bumped-out" perimeter strip with stiffeners. The perimeter strip 210(13) is adhesively connected to a ceramic tile 105 using an adhesive 124. The bumped-out extrusion represents one piece that goes entirely around the panel, creating four sides. The corners are crimped with corner keys and the PCT returned on the edges. Spacer elements 430 provide space below the panels 105 for receiving the liquid adhesive before setting.

It can be seen from the system 2700B that ceramic panels 105 may be placed side-by-side and offset from ACM panels 115. It can be seen that the attachment system can join ACM panels together with porcelain ceramic panels. It can alternatively join many other different veneer types such as aluminum plates, photo voltaic cell panels, glass layers and certain metals.

Figure 27A:
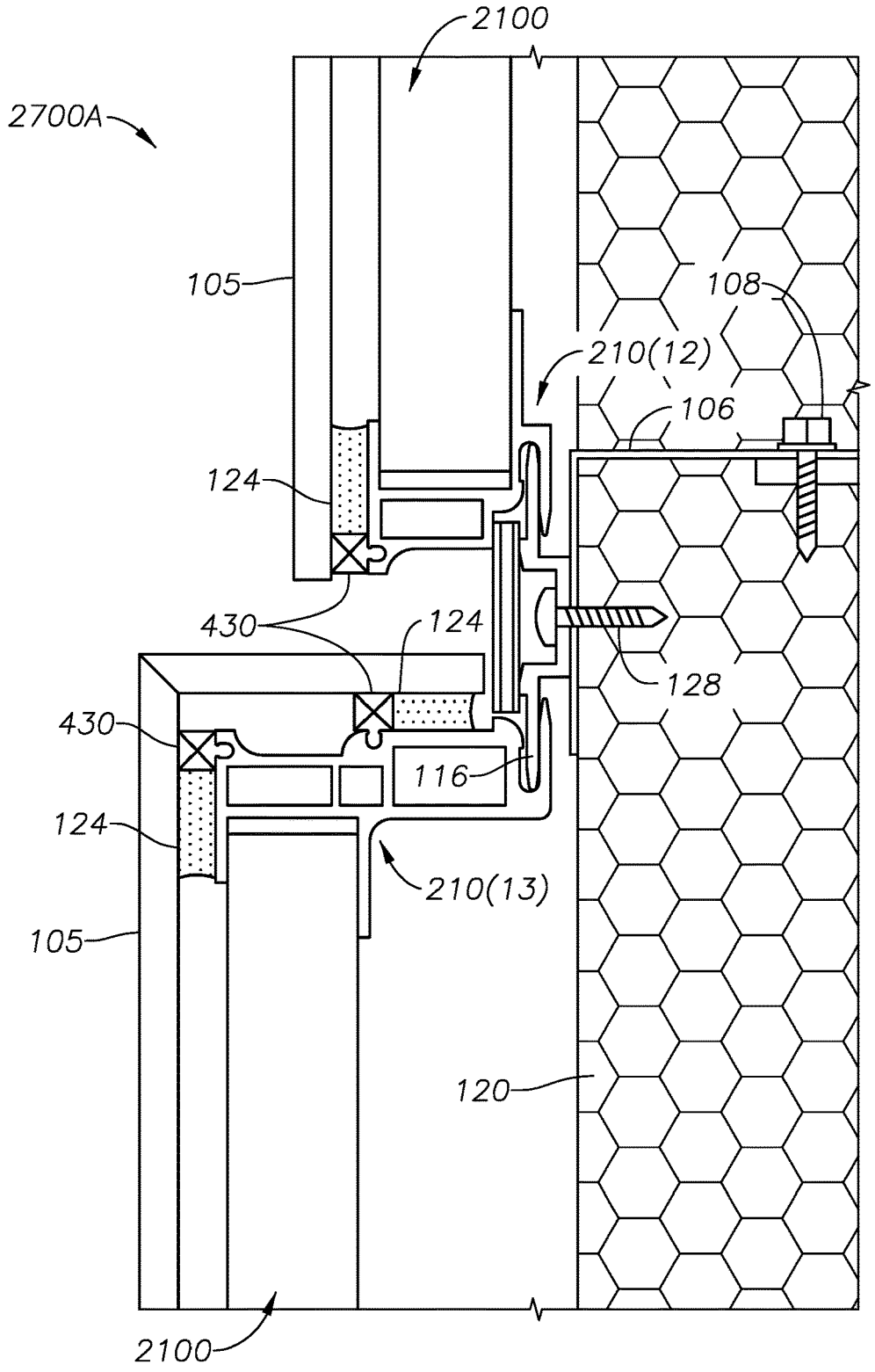
FIG. 27A and FIG. 27B are cross-sectional views of a wall panel attachment systems as may be formed using the methods of the present invention, wherein ceramic panels are placed side-by-side, but are again offset from one another in height.
Figure 27B:
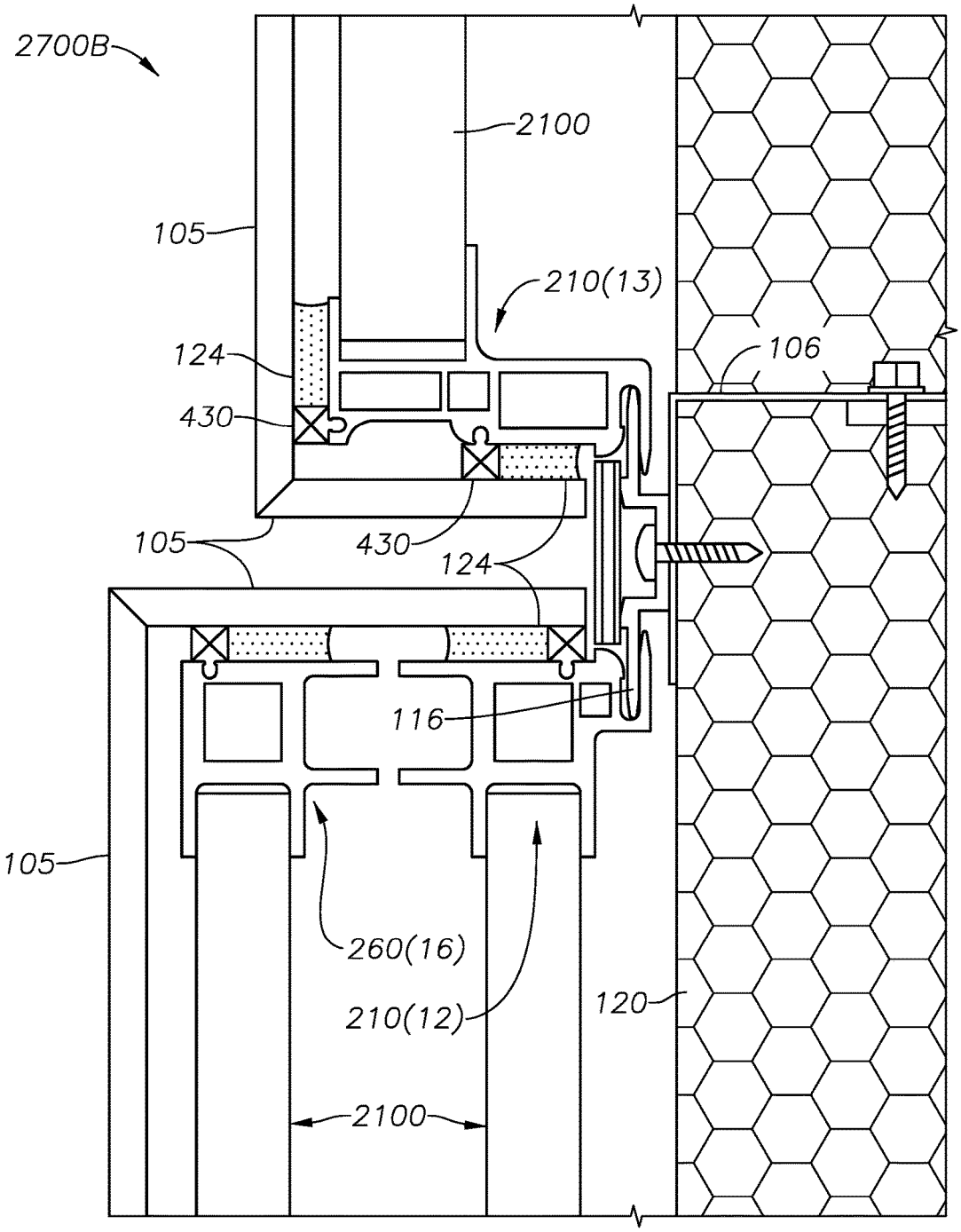

FIG. 27A and FIG. 27B are cross-sectional views of wall panel attachment systems 2700A and 2700B as may be formed using the methods of the present invention, in alternate embodiments. Ceramic panels 105 are placed side-by-side, but are offset from one another in height.

In FIG. 27A, a panel perimeter strip similar to strip 210(11) is secured to a wing member on one side of an attachment clip 116, while a panel perimeter strip similar to perimeter strip 210(13) is secured to a wing member on the opposite side of the attachment clip 116. The perimeter strips 210(12), 210(13) are configured to have different heights, but each one receives a ceramic tile panel 105 using an adhesive 124. Panel stiffeners 2100 are placed in slots along each of the perimeter strips 210(12), 210(13).

The attachment system 2700B of FIG. 27B is similar in design to the attachment system of 2700A. However, in this view one of the ceramic panels 105 is secured to a perimeter strip 260(16) to add additional height.

Figure 28:
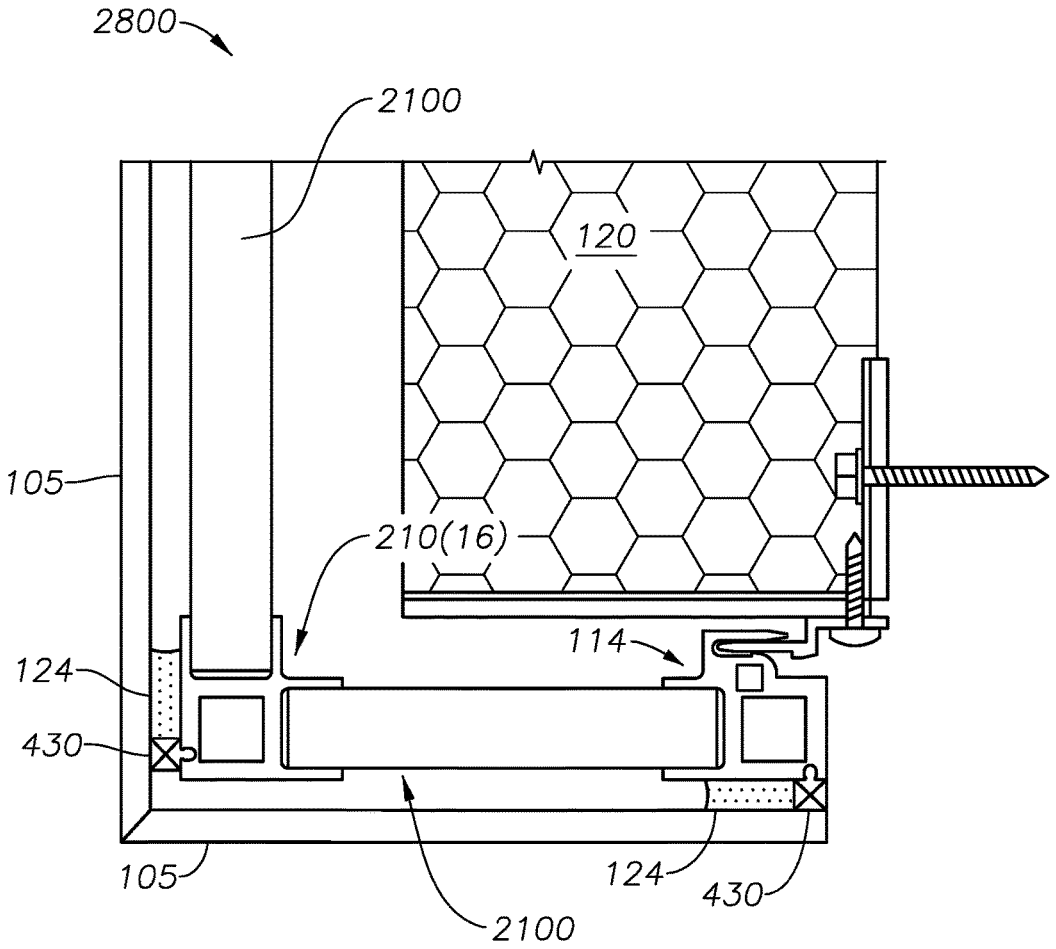
FIG. 28 is a cross-sectional view of a wall panel attachment system as may be installed using the methods of the present invention, in another embodiment. In this arrangement, wall panels wrap around the corner of a building structure.

FIG. 28 is a cross-sectional view of a wall panel attachment system 2800 as may be installed using the methods of the present invention, in another embodiment. FIG. 28 shows an example of ceramic panels 105 attached at right angles to an outside box corner strip 216(16) (with stiffener legs) using adhesive 124 and spacer elements 430. The panels 105 wrap around the corner of a wall 120. Panel stiffeners 2100 provide support to the adjacent panels 105.

It is understood that a wide variety of options exist for using panel perimeter clips and tile perimeter strips. The perimeter clips secure a three-dimensional wall panel structure to a wall through an attachment clip, while the perimeter strips provide lateral support for the panels between wall connectors. Numerous separate design patent applications are pending for the connection hardware including configurations of panel perimeter clips, box connector perimeter strips and panel stiffeners. In addition, numerous separate design patent applications are pending for the various cube connectors themselves.

Finally, it is observed that the operator may wish to secure tile perimeter strips at fixed right angles, or near right angles. To this end, various key configurations may be used.

Figure 29A:
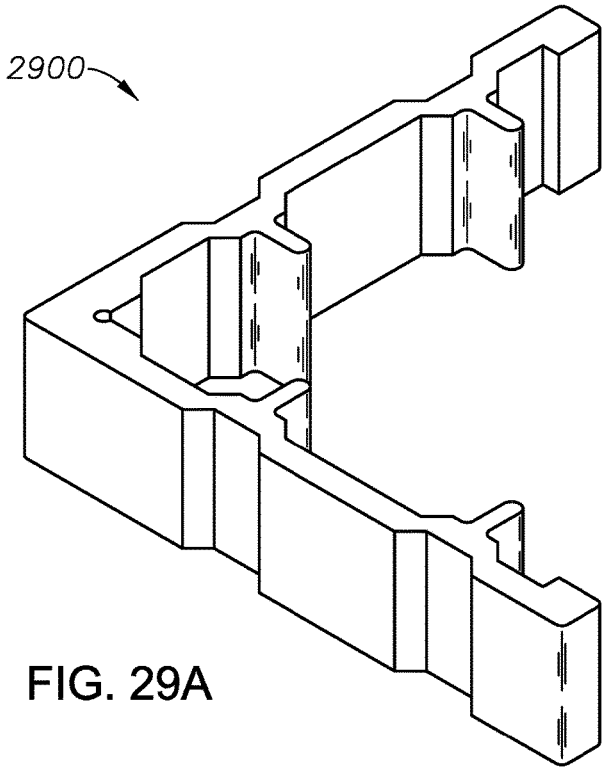
FIG. 29A is a first perspective view of a key as may be used to connect ends of perimeter strips for purposes of forming panel frames.
Figure 29B:
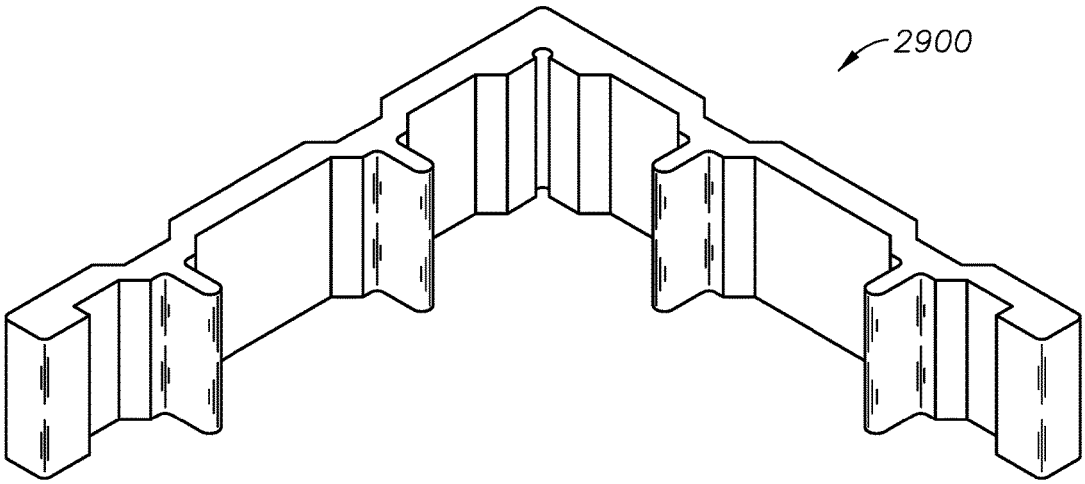
FIG. 29B is a second perspective view of the key of FIG. 29A. The key is at a 90-degree angle.

FIG. 29A is a first perspective view of a key 2900 as may be used to connect ends of perimeter strips for purposes of forming panel frames. FIG. 29B is a second perspective view of the key 2900 of FIG. 29A. The key is at a 90-degree angle.

Figure 30A:
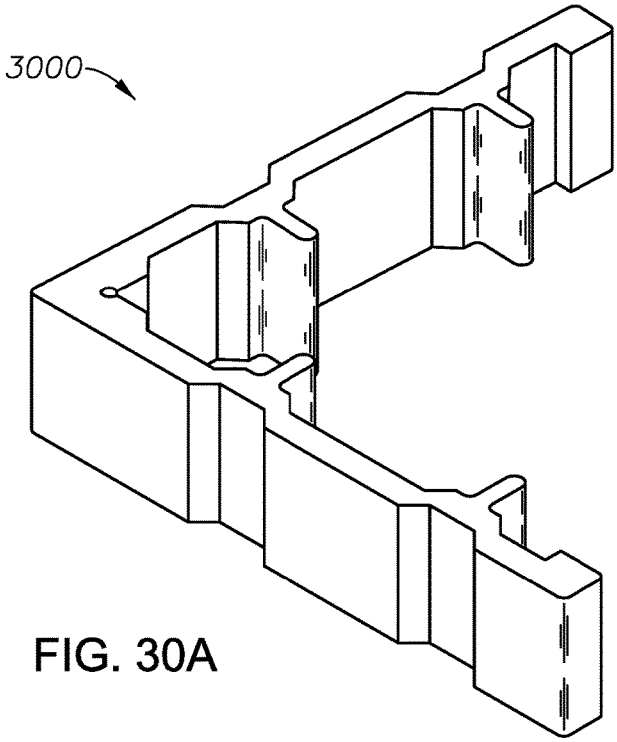
FIG. 30A is a first perspective view of a key as may be used to connect ends of perimeter strips for purposes of forming panel frames.
Figure 30B:
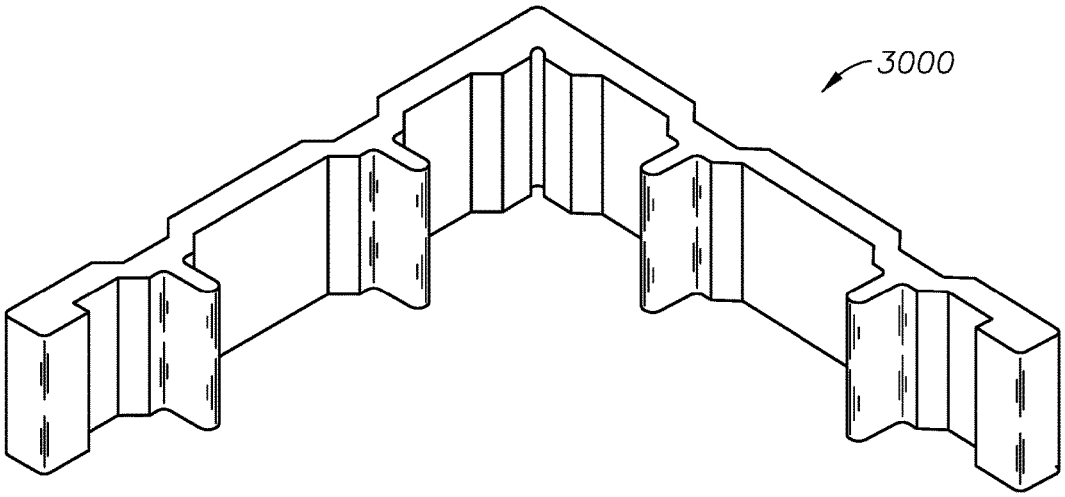
FIG. 30B is a second perspective view of the key of FIG. 30A. The key is at an 87-degree angle.

FIG. 30A is a first perspective view of a key 3000 as may be used to connect ends of perimeter strips for purposes of forming panel frames. FIG. 30B is a second perspective view of the key 3000 of FIG. 30A. The key is at an 87-degree angle.

Figure 31A:
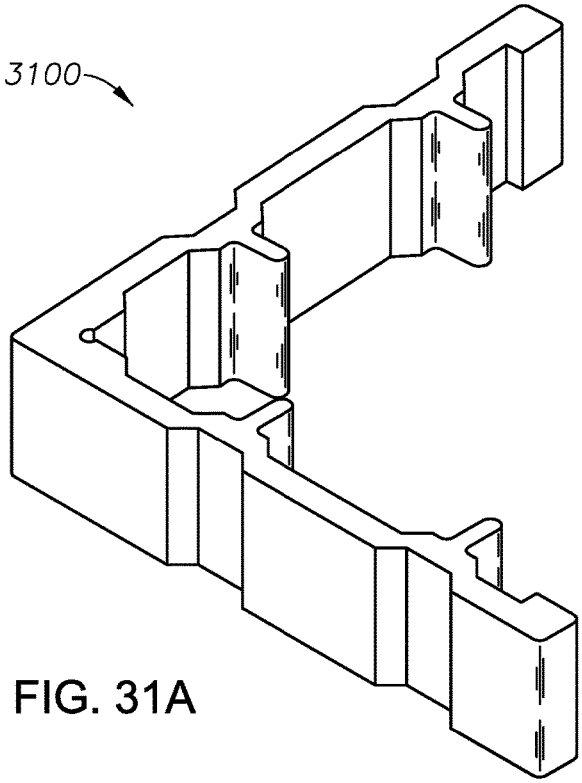
FIG. 31A is a first perspective view of a key as may be used to connect ends of perimeter strips for purposes of forming panel frames.
Figure 31B:
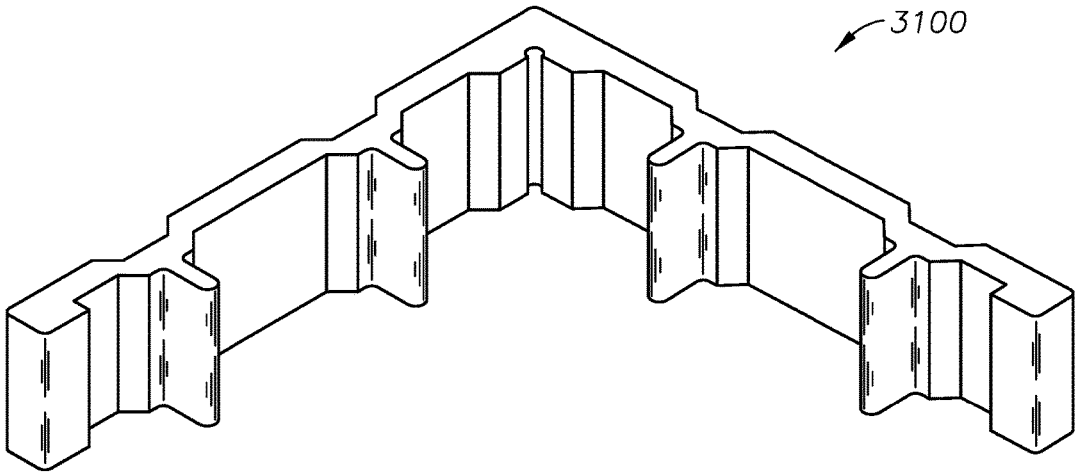
FIG. 31B is a second perspective view of the key of FIG. 31A. The key is at a 93-degree angle.

FIG. 31A is a first perspective view of a key 3100 as may be used to connect ends of perimeter strips for purposes of forming panel frames. FIG. 31B is a second perspective view of the key 3100 of FIG. 31A. The key is at a 93-degree angle.

In view of FIGS. 29A-29B, 30A-30B and 31A-31B, a unique method of forming a three-dimensional frame structure for a wall is provided. The method first includes providing a series of corner castings. The corner castings include:

- two or more two-legged cube connectors, wherein legs of each of the two-legged cube connectors form an orthogonal x-y coordinate,
- two or more planar three-legged cube connectors, wherein legs of each of the planar three-legged cube connectors also form an orthogonal x-y coordinate, and
- two or more orthogonal three-legged cube connectors, wherein legs of each of the orthogonal three-legged cube connectors form an orthogonal x-y-z coordinate.

The method also comprises providing a series of linear extrusion members. Each linear extrusion member also comprises an opening at both a first end and a second end, with the openings being configured to slidably receive the legs of the two-legged and the three-legged cube connectors. Some of the series of linear extrusion members serve as panel perimeter strips and comprise a receiving member configured to gravitationally hang onto wing members of respective attachment clips secured to an edifice of a building to support a dead load of the three-dimensional structure. In addition, some of the linear extrusion members serve as corner connector strips and do not have a receiving member for an attachment clip and are not configured to gravitationally support the three-dimensional structure.

The method further includes providing a plurality of keys. Each key defines a generally orthogonal metal component dimensioned and configured to be received within slots of some of the series of linear extrusion members serving as panel perimeter strips. Preferably, providing the plurality of keys further includes selecting keys from the group consisting of (i) a 90-degree perimeter clip key, (ii) an 87-degree perimeter clip key, (iii) a 93-degree perimeter clip key, and combinations thereof. For purposes of the present disclosure, each of these angles, and intermediate angles therebetween, is "generally orthogonal."

The method additionally comprises:

- inserting keys into the slots of adjacent panel perimeter strips in order to orient and secure the panel perimeter strips in generally orthogonal relation;
- connecting the series of corner castings and the plurality of linear extrusion members to form a three-dimensional structure; and
- securing rigid wall panels to exterior surfaces of the three-dimensional structure to form the frame structure.

Preferably, the securing rigid wall panels to exterior surfaces of the three-dimensional structure comprises adhesively securing the wall panels to the linear extrusion members to enclose or "finish" the frame structure.

The two-legged cube connectors, the planar three-legged cube connectors, and the orthogonal three-legged cube connectors are interchangeable. In this respect, because of the telescoping nature of the connections with the linear extrusion members, "off-the-shelf" connectors may be brought to a construction location and quickly connected to extrusion members, without custom cutting. This enables the architect or builder to provide different shaped corner castings to create a wide variety of exterior façade shapes and dimensions.

As an optional step, some linear extrusion members may be cut at the construction site, depending on original length. Alternatively, linear extrusion members of different lengths may be provided "off-the-shelf" to enable the contractor to readily select linear extrusion members of appropriate lengths in order to connect corner castings without any cutting. "Off-the-shelf" linear extrusion members may be selected from lengths of 1 foot, 2 feet, 3 feet, 4 feet and so forth, up to 10 feet.

Variations of the methods for forming a three-dimensional frame structure may fall within the spirit of the claims, below. It will be appreciated that the inventions are susceptible to modification, variation and change without departing from the spirit thereof.

We claim:

1. A method of forming a three-dimensional frame structure for a wall, comprising:

- providing a series of corner castings including:
  - two or more two-legged cube connectors, wherein legs of each of the two-legged cube connectors form a two-legged orthogonal x-y coordinate,
  - two or more planar three-legged cube connectors, wherein legs of each of the planar three-legged cube connectors form a three-legged orthogonal x-y coordinate, and
  - two or more orthogonal three-legged cube connectors, wherein legs of each of the orthogonal three-legged cube connectors form an orthogonal x-y-z coordinate;
- providing a series of linear extrusion members, wherein:
  - each linear extrusion member comprises an opening at both a first end and a second end, with the openings being configured to slidably receive the legs of the two-legged and the three-legged cube connectors;
  - at least two of the series of linear extrusion members serve as panel perimeter strips and comprise a receiving member that gravitationally hangs onto wing members of respective attachment clips secured to an edifice of a building to support a dead load of the three-dimensional frame structure; and
  - at least two others of the linear extrusion members serve as corner connector strips and do not have the receiving member for the attachment clip;
- connecting the series of corner castings and the series of linear extrusion members to form a three-dimensional framework; and
- securing rigid wall panels to exterior surfaces of the three-dimensional framework to form the three-dimensional frame structure.

2. The method of claim 1, wherein the securing rigid wall panels to exterior surfaces of the three-dimensional framework comprises adhesively securing the rigid wall panels to the exterior surfaces of the three-dimensional framework to form the frame structure.

3. The method of claim 1, further comprising:

providing a plurality of keys, with each key defining an approximately orthogonal metal component dimensioned and configured to be received within slots of selected adjacent panel perimeter strips;

inserting keys into the slots of adjacent panel perimeter strips in order to orient and secure the panel perimeter strips in approximately orthogonal relation;

adhesively securing a square rigid wall panel to the panel perimeter strips that have been joined together using the keys, without securing the rigid wall panel to a respective said cube connector; and hanging the square rigid wall panel onto a wall adjacent the three-dimensional frame structure;

and wherein the providing the plurality of keys comprises selecting keys from the group consisting of (i) a 90-degree perimeter clip key, (ii) an 87-degree perimeter clip key, (iii) a 93-degree perimeter clip key, and combinations thereof.

4. The method of claim 1, wherein the two-legged cube connectors, the planar three-legged cube connectors, and the orthogonal three-legged cube connectors are interchangeable, without cutting, to provide different shaped corner castings.

5. The method of claim 4, wherein the linear extrusion members are provided in various lengths, off-the-shelf, to enable the connection of corner castings at a construction site, without cutting.

6. A method of forming a three-dimensional frame structure for a wall, comprising:

providing a series of corner castings, with the series of corner castings comprising:

two or more two-legged cube connectors, wherein legs of each of the two-legged cube connectors form a two-legged orthogonal x-y coordinate;

two or more planar three-legged cube connectors, wherein legs of each of the planar three-legged cube connectors form a three-legged orthogonal x-y coordinate; and two or more orthogonal three-legged cube connectors, wherein legs of each of the orthogonal three-legged cube connectors form a three-legged orthogonal x-y-z coordinate;

providing a series of linear extrusion members, wherein:

each linear extrusion member comprises an opening at both a first end and a second end, with the openings being configured to slidably receive the legs of the two-legged and the three-legged cube connectors;

at least two of the series of linear extrusion members serve as panel perimeter strips and comprise a receiving member that gravitationally hangs onto wing members of respective attachment clips secured to an edifice of a building to support a dead load of the three-dimensional frame structure; and at least two others of the linear extrusion members serve as corner connector strips and do not have the receiving member for the attachment clip;

connecting the series of corner castings and the series of linear extrusion members to form a three-dimensional framework; and adhesively securing rigid wall panels to exterior surfaces of the three-dimensional framework to form the three-dimensional frame structure.

7. The method of claim 6, wherein:

the series of corner castings further comprises one or more orthogonal four-legged cube connectors, wherein legs of each of the four-legged cube connectors form a four-legged orthogonal x-y-z coordinate;

each of the orthogonal four-legged cube connectors comprises a cube member from which the legs of the one or more orthogonal four-legged cube connectors extend; and each of the cube members of the one or more orthogonal four-legged cube connectors comprises a first outward-facing surface having at least one recessed portion dimensioned to receive and anchor a spacing element.

8. The method of claim 6, wherein:

the series of corner castings further comprises one or more planar four-legged cube connectors, wherein legs of each of the four-legged cube connectors form a four-legged orthogonal x-y coordinate;

each of the planar four-legged cube connectors comprises a cube member from which the legs of the one or more planar four-legged cube connectors extend; and each of the cube members of the one or more planar four-legged cube connectors comprises a first outward-facing surface having at least one recessed portion dimensioned to receive and anchor a spacing element.

9. The method of claim 6, wherein:

the series of corner castings further comprises one or more five-legged cube connectors, wherein legs of each of the five-legged cube connectors form a five-legged orthogonal x-y-z coordinate;

each of the five-legged cube connectors comprises a cube member from which the legs of the one or more five-legged cube connectors extend; and each of the cube members of the one or more five-legged cube connectors comprises a first outward-facing surface having at least one recessed portion dimensioned to receive and anchor a spacing element.

10. The method of claim 6, wherein:

the series of corner castings further comprises:

one or more planar four-legged cube connectors, wherein legs of each of the four-legged cube connectors form a four-legged orthogonal x-y coordinate;

one or more orthogonal four-legged cube connectors, wherein legs of each of the four-legged cube connectors form a four-legged orthogonal x-y-z coordinate; and one or more five-legged cube connectors, wherein legs of each of the five-legged cube connectors form a five-legged orthogonal x-y-z coordinate;

and wherein:

each of the planar four-legged cube connectors, each of the orthogonal four-legged cube connectors and each of the five-legged cube connectors comprises a cube member from which the legs of the respective cube connectors extend; and each of the cubes of each of the connectors comprises a first outward-facing surface having at least one recessed portion dimensioned to receive and anchor a spacing element.

11. The method of claim 6, wherein the wall panels comprise at least one of porcelain ceramic tiles, non-porcelain ceramic tiles, natural stone tiles, synthetic rigid panels, and composite rigid panels.

12. The method of claim 6, wherein the wall panels comprise at least one of layers of glass, layers of rigid metal, photovoltaic cell panels, or combinations thereof.

13. The method of claim 6, wherein:

each leg of each of the corner castings has a polygonal geometry; and each of the openings of each of the linear extrusion members defines a polygonal opening dimensioned to slidably receive respective legs.

14. The method of claim 13, wherein:

each of the polygonal legs defines a four-sided profile; and each of the polygonal openings defines a mating four-sided profile.

15. The method of claim 6, wherein:

connecting the series of corner castings and the series of linear extrusion members comprises sliding the legs of the corner castings into respective polygonal openings of the linear extrusion members to provide the three-dimensional structure; and the method further comprises slidably adjusting the positions of the linear extrusion members along the panel perimeter strips before adhesively securing the rigid wall panels to the panel perimeter strips.

16. The method of claim 15, wherein:

each of the two-legged cube connectors comprises a cube member from which the legs of the respective two-legged cube connectors extend;

each of the planar three-legged cube connectors also comprises a cube member from which the legs of the respective planar three-legged cube connectors extend;

each of the orthogonal three-legged cube connectors also comprises a cube member from which the legs of the respective orthogonal three-legged cube connectors extend; and each of the cubes of the two-legged cube connectors, the planar three-legged cube connectors and the orthogonal three-legged cube connectors comprises a first outward-facing surface having at least one recessed portion dimensioned to receive and anchor a spacing element.

17. The method of claim 16, wherein the cube of at least one of the orthogonal three-legged cube connectors comprises a second outward-facing surface having at least one recessed portion dimensioned to receive and anchor a spacing element, wherein the first and second outward-facing surfaces are in 90-degree relation.

18. The method of claim 16, wherein each linear extrusion member of the series of linear extrusion members includes a recessed portion for receiving a spacing element.

19. The method of claim 18, wherein:

each of the spacing elements comprises a strip of elastomeric material having a base, wherein the base frictionally or slidingly fits within the respective recessed portions; and adhesively securing rigid wall panels to the three-dimensional structure comprises:

inserting the base of each spacing element into selected recessed portions;

placing the rigid wall panels onto the spacing elements;

applying a liquid adhesive to the outward-facing surfaces of cube members adjacent to the spacing elements; and allowing the liquid adhesive to set.

20. The method of claim 19, wherein the recessed portion of each of the cube members of each of the two-legged cube connectors comprises two recessed portions residing in 90-degree relation along the first outward-facing surface.

21. The method of claim 19, wherein:

the three-dimensional structure comprises three or more planar surfaces, with each planar surface having rigid wall panels adhesively secured thereto to form the frame structure.

22. The method of claim 21, further comprising:

providing a plurality of keys, with each key defining an approximately orthogonal metal component dimensioned and configured to be received within slots of panel perimeter strips;

inserting keys into the slots of adjacent panel perimeter strips in order to orient and secure the panel perimeter strips in approximately orthogonal relation: and adhesively securing a square rigid wall panel to the panel perimeter strips that have been joined together using the keys, without securing the rigid wall panel to a respective said cube connector.

23. The method of claim 22, wherein:

the providing the plurality of keys comprises selecting keys from one of (i) a 90-degree perimeter clip key, (ii) an 87-degree perimeter clip key, and (iii) a 93-degree perimeter clip key; and the method further comprises hanging the square rigid wall panel onto a wall adjacent the three-dimensional frame structure.

24. The method of claim 21, wherein applying a liquid adhesive to the outward-facing surfaces of cube members comprises applying the liquid adhesive around an outer perimeter of the spacing elements.

25. The method of claim 24, further comprising:

securing attachment clips to the edifice of the building; and gravitationally hanging the receiving member portions of the panel perimeter strips onto respective attachment clips.

26. The method of claim 24, wherein:

the frame structure is fabricated at a location remote from the building; and the method further comprises:

transporting the frame structure to the building; and securing the frame structure to an outside edifice of the building.

27. The method of claim 26, wherein securing the frame structure to an outside edifice of the building comprises:

securing at least two bracket assemblies to an exterior surface of the building;

securing a plurality of attachment clips to the at least two bracket assemblies; and hanging the receiving member of each of the panel perimeter strips onto attachment clips.

28. The method of claim 19, wherein:

two or more of the corner connectors comprise parallel stiffener legs, wherein the parallel legs form slots; and the method further comprises:

providing a plurality of panel stiffeners, with each panel stiffener having a first end, a second opposing end, and an exterior surface between the first and second ends; and placing the first and second ends of the panel stiffeners within respective slots of parallel stiffener legs such that the exterior surface of each panel stiffener faces outwardly.

29. The method of claim 28, further comprising:

while adhesively securing rigid wall panels to exterior surfaces of the three-dimensional structure, also adhesively securing the rigid wall panels to the panel stiffeners.

30. The method of claim 29, wherein:

each of the outward surfaces of the panel stiffeners comprises a recessed portion; and the method further comprises placing spacers into the recessed portion of each of the panel stiffeners before adhesively securing the rigid wall panels to the panel stiffeners.

* * * * *